US005352572A

United States Patent [19]

Seto et al.

[11] Patent Number: 5,352,572

[45] Date of Patent: * Oct. 4, 1994

[54] SILVER HALIDE COLOR PHOTOGRAPHIC MATERIAL

[75] Inventors: Nobuo Seto; Akira Ogawa; Masakazu Morigaki, all of Kanagawa, Japan

[73] Assignee: Fuji Photo Film Co., Ltd., Kanagawa, Japan

[ * ] Notice: The portion of the term of this patent subsequent to May 25, 2010 has been disclaimed.

[21] Appl. No.: 913,946

[22] Filed: Jul. 17, 1992

[30] Foreign Application Priority Data

Jul. 19, 1991 [JP] Japan ..... 3-203545

[51] Int. Cl.[5] ..... G03C 1/08; G03C 7/26; G03C 7/32

[52] U.S. Cl. ..... 430/551; 430/557; 430/372; 430/607; 430/610; 430/613

[58] Field of Search ..... 430/607, 610, 613, 551, 430/372, 264, 557

[56] References Cited

U.S. PATENT DOCUMENTS

| | | | |
|---|---|---|---|
| 4,865,947 | 9/1989 | Kuwabara et al. | 430/264 |
| 4,910,126 | 3/1990 | Sato et al. | 430/546 |
| 4,914,003 | 4/1990 | Yagihara et al. | 430/613 |
| 4,980,275 | 12/1990 | Goddard | 430/610 |
| 5,028,519 | 7/1991 | Morigaki et al. | 430/613 |
| 5,139,931 | 8/1992 | Seto et al. | 430/610 |
| 5,190,853 | 3/1993 | Seto et al. | 430/551 |
| 5,213,958 | 5/1993 | Motoki et al. | 430/557 |

FOREIGN PATENT DOCUMENTS

| | | |
|---|---|---|
| 0265196 | 4/1988 | European Pat. Off. . |
| 0286431 | 10/1988 | European Pat. Off. . |
| 0337784 | 10/1989 | European Pat. Off. . |
| 0482552 | 4/1992 | European Pat. Off. . |
| 3730557 | 3/1989 | Fed. Rep. of Germany . |
| 1558452 | 12/1967 | France . |
| 2148034 | 6/1990 | Japan . |
| 2150841 | 6/1990 | Japan . |
| 2181145 | 7/1990 | Japan . |
| 2181753 | 7/1990 | Japan . |
| 1477410 | 6/1977 | United Kingdom . |

*Primary Examiner*—Charles L. Bowers, Jr.
*Assistant Examiner*—Geraldine Letscher
*Attorney, Agent, or Firm*—Birch, Stewart, Kolasch & Birch

[57] ABSTRACT

A silver halide color photographic material comprises a combination of at least one yellow dye-forming coupler of the following general formula (1) with at least one discoloration inhibitor of special amide, phosphorus or hydrazine compound type to prevent the dye images, especially the yellow dye image, formed therein from discoloring or changing their colors;

(1)

wherein $X^3$ represents an organic residue completing a nitrogen-containing heterocyclyl group together with Y represents an aromatic or heterocyclic group; and Z represents a group capable of splitting off when the coupler represented by the foregoing formula reacts with the oxidation product of an aromatic primary amine color developing agent.

16 Claims, No Drawings

SILVER HALIDE COLOR PHOTOGRAPHIC MATERIAL

FIELD OF THE INVENTION

This invention relates to a silver halide color photographic material and, more particularly, to a silver halide color photographic material in which dye images hardly causing discoloration and change in their colors are finally formed through development-processing.

BACKGROUND OF THE INVENTION

In general, silver halide color photographic materials contain silver halide emulsion layers sensitive to light beams having three primary colors, red, green and blue, respectively, and reproduce color images using a so-called subtractive color process, or a process in which three kinds of couplers incorporated in separate emulsion layers are made to form their colors bearing a complementary relationship to the colors of light beams to which the corresponding layers are sensitive respectively. Color images obtained by subjecting such silver halide color photographic materials as described above to photographic processing are generally constituted of azomethine or indoaniline dyes formed by the reaction of couplers with the oxidation product of an aromatic primary amine color developing agent.

However, even the color photographic materials which form color images on such an excellent system as described above have being come to cause dissatisfaction among users who continue to request a higher level of image quality. In particular, developed color images obtained from yellow dye forming couplers still have some disadvantages to be surmounted. Firstly, absorption coefficients of yellow dyes formed from conventional couplers were lower than those of dyes obtained from cyan dye- and magenta dye-forming couplers, so that it was necessary to use a yellow dye-forming coupler in a larger amount in order to ensure the same density to the yellow image as those of cyan and magenta images. Secondly, yellow dyes formed from conventional couplers did not always have a hue satisfactory for faithful reproduction of the color of a subject. Thirdly, yellow dyes formed and yellow dye-forming couplers remaining undeveloped were unstable to light, moisture and heat, so that the dye images suffered from discoloration or color change, and the white background stained when exposed to sunlight for a long time or when stored under high temperature and high humidity conditions, resulting in the deterioration of image quality.

With the intention of solving these problems, attempts have been made to promote color development by improving upon couplers themselves or by allowing particular compounds, e.g., specific phenol or sulfonamido compounds, to be present together with couplers. However, such attempts produced unsatisfactory results.

On the other hand, it is known to use a discoloration inhibitor and an ultraviolet absorbent to make improvements in image fastness. Examples of compounds known as discoloration inhibitors include hydroquinones, hindered phenols, catechols, gallic acid esters, aminophenols, hindered amines, chromanols, indanes, ethers or esters obtained by silylating, acylating or alkylating the phenolic hydroxyl groups of those compounds, metal complex salts of those compounds, and so on.

However, such compounds produced very little effect in increasing the absorption coefficients of the yellow dyes obtained. Moreover, their effects on yellow dyes were insufficient, even though they had considerable effects on magenta dyes. What was worse, they caused a change in hue, the generation of fog, a poorly dispersed condition, or the deposition of crystallites after coating emulsions.

More specifically, the application of amine or hydrazine derivatives with the intention of ensuring fastness for dye images obtained from yellow dye-forming couplers are described in JP-A-02-262654 (The term "JP-A" as used herein means an "unexamined published Japanese patent application"), JP-A-02-181145, Japanese Patent Application No. 02-35681, JP-A-02-150841, JP-A-02-181753, JP-A-02-148034, and so on.

In addition, the combined use of amine derivatives with a specific structure and other compounds with a special structure is proposed in JP-A-02-239149.

Moreover, pentavalent phosphorus compounds with a specific structure are proposed in JP-A-63-113536, JP-A-01-289952, JP-A-01-284853 and JP-A-63-256952 for affording fastness to the dye images obtained from yellow dye-forming couplers and for improving upon spectral absorption characteristics of said dye images.

Also, trivalent phosphorus compounds with a specific structure are proposed in JP-B-48-32728 (The term "JP-B" as used herein means an "examined Japanese patent publication"), JP-B-63-19518, JP-A-55-67741, JP-A-61-137150, JP-A-63-301941, JP-A-02-12146 and JP-A-03-25437.

The effects accomplished by the combination of those compounds and hitherto known yellow dye-forming couplers are insufficient with regard to the photographic characteristics as described above, image fastness and so on.

In this sense, it has been desired to not only make improvements in color formation characteristics of couplers and photographic characteristics of the dye images formed therefrom, but also to inhibit the dye images from discoloring or changing their colors, without affecting adversely the aforementioned characteristics.

SUMMARY OF THE INVENTION

One object of the present invention is to provide a silver halide color photographic material which can produce color images causing no change in their colors over a long period of time, or having a high level of keeping quality.

Another object of the present invention is to provide a silver halide color photographic material which contains a novel discoloration inhibitor having a sufficient effect in preventing yellow dye image from discoloring or changing its color but without being attended by any change in hue, inhibition of color formation from couplers and generation of fog, and what is more, not separating out as crystallites after a coating operation.

Still another object of the present invention is to provide a silver halide color photographic material containing a discoloration inhibitor which has high solubility in high boiling organic solvents and the like, does not separate out as crystallites before or after a coating operation, and does not have any adverse effects on other photographic additives.

A further object of the present invention is to provide a silver halide color photographic material which is excellent in color reproducibility and photographic characteristics, can produce a fast yellow color image and has reduced stain in unexposed areas.

As a result of our intensive studies, it has been found that the above-described objects of the present invention are attained with a silver halide color photographic material which contains at least one yellow dye-forming coupler represented by the following general formula (1) and at least one compound represented by the following general formula (a-I), (a-II), (a-III), (a-IV), (a-V), (a-VI), or (a-VII)

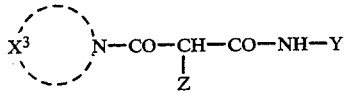

(1)

wherein $X^3$ represents an organic residue completing a nitrogen-containing heterocyclyl group together with

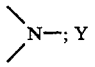

represents an aromatic or heterocyclic group, and Z represents a group capable of splitting off when the coupler represented by the foregoing formula reacts with the oxidation product of an aromatic primary amine color developing agent;

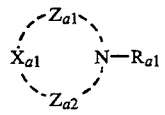

(a-I)

wherein $R_{al}$ represents —C(=O)—$R_{a21}$, —S(=O)$_{n3}$—$R_{a21}$, —C(=O)O$R_{a21}$, —P(=O)($R_{a22}$)($R_{a23}$), —C(=O)N($R_{a21}$)($R_{a24}$) or —S(=O)$_{n4}$N($R_{a21}$)($R_{a24}$), or a linkage group via which the compound can form a dimer or higher polymer; $Z_{a1}$ and $Z_{a2}$ may be the same or different, each being a divalent connecting group attached to the nitrogen atom via its carbon atom, and the nitrogen-containing hetero ring formed by $Z_{a1}$, $Z_{a2}$, $X_{a1}$ and the nitrogen atom is a 5 - to 8-membered ring; $X_{a1}$ represents —O—, —S(O)$_{n5}$—, —N($R_{a25}$)—, or —C($R_{a26}$)($R_{a27}$)—; $R_{a21}$ represents a $C_{1-40}$ aliphatic, $C_{6-56}$ aromatic or 5- to 8-membered $C_{1-50}$ heterocyclic group; $R_{a22}$ and $R_{a23}$ may be the same or different, each being a $C_{1-40}$ aliphatic, $C_{6-56}$ aromatic, $C_{1-40}$ aliphatic oxy or $C_{6-56}$ aromatic oxy group; $R_{a24}$ represents a hydrogen atom, or a $C_{1-40}$ aliphatic or $C_{6-56}$ aromatic group; $R_{a25}$ represents a $C_{1-40}$ aliphatic group, or the same as $R_{a1}$; $R_{a26}$ and $R_{a27}$ may be the same or different, each being a hydrogen atom, or a $C_{1-40}$ aliphatic, $C_{1-40}$ aliphatic oxy, $C_{6-56}$ aromatic oxy, $C_{2-42}$ aliphatic acyloxy or $C_{7-57}$ aromatic acyloxy group; n3 and n4 each represent 1 or 2; n5 represents 0, 1 or 2; and $R_{a22}$ and $R_{a23}$, $R_{a21}$ and $R_{a24}$, or $R_{a26}$ and $R_{a27}$ may combine to form a 5- to 8-membered ring; with the proviso that the nitrogen-containing hetero ring constituted of $Z_{a1}$, $Z_{a2}$, $X_{a1}$ and N which is a 2,2,6,6-tetraalkylpiperidine ring is excluded;

$$X_{a2}—Z_{a3}—X_{a3} \quad \text{(a-II)}$$

wherein $X_{a2}$ and $X_{a3}$ may be the same or different, each being —N($R_{a36}$)($R_{a32}$), —C(=O)N($R_{a31}$)($R_{a32}$), —S(=O)$_{n6}$N($R_{a31}$)($R_{a32}$), —P(=O)($R_{a33}$)N($R_{a31}$)($R_{a32}$), provided that the total number of carbon atoms contained in $X_{a2}$ and $X_{a3}$ is at least 6; $Z_{a3}$ represents a direct bond or a divalent aliphatic group in which the number of atoms depending on the chain between $X_{a2}$ and $X_{a3}$ is 7 or less; $R_{a36}$ represents —C(=O)$R_{a34}$, —S(=O)$_{n7}R_{a34}$ or —P(=O)($R_{a34}$)($R_{a35}$); $R_{a31}$ represents —C(=O)$R_{a34}$, —S(=O)$_{n7}R_{a34}$, —P(=O)($R_{a34}$)($R_{a35}$), or a $C_{1-40}$ aliphatic or $C_{6-56}$ aromatic group; $R_{a34}$ represents a $C_{1-40}$ aliphatic, $C_{6-56}$ aromatic, $C_{1-40}$ aliphatic oxy, $C_{6-56}$ aromatic oxy, $C_{1-50}$ aliphatic amino or $C_{6-56}$ aromatic amino group; $R_{a35}$ represents a $C_{1-40}$ aliphatic, $C_{6-56}$ aromatic, $C_{1-40}$ aliphatic oxy or $C_{6-56}$ aromatic oxy group; n6 represents 1 or 2; n7 represents 1 or 2; $R_{a32}$ represents a hydrogen atom, a 5-to 8-membered $C_{1-50}$ heterocyclic group, or a group defined as $R_{a31}$; $R_{a33}$ represents an $C_{1-40}$ aliphatic, $C_{6-56}$ aromatic, $C_{1-40}$ aliphatic oxy or $C_{6-56}$ aromatic oxy group; when $Z_{a3}$ represents a direct bond, the compound may form a dimer or higher polymer via $R_{a31}$ or $R_{a32}$; and 5- to 8-membered ring(s), excluding a 2,2,6,6-tetraalkylpiperidine ring, may be formed by combining $R_{a36}$ with $R_{a32}$, and/or $R_{a31}$ with $R_{a32}$; and with the further proviso that when both $X_{a2}$ and $X_{a3}$ are —C(=O)N($R_{a31}$) ($R_{a32}$), the compounds where $Z_{a3}$ represents methylene or a monosubstituted methylene are excluded;

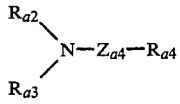

(a-III)

wherein $R_{a2}$ represents a hydrogen atom, a $C_{1-40}$ aliphatic group, a $C_{6-56}$ aromatic group, a 5- to 8-membered $C_{1-50}$ heterocyclic group, —C(=O)$R_{a41}$, —S(=O)$_{n8}R_{a41}$ or —P(=O)($R_{a41}$)($R_{a42}$), $R_{a3}$ represents —C(=O)$R_{a41}$, —S(=O)$_{n9}R_{a41}$ or —P(=O)($R_{a41}$)($R_{a42}$) and $R_{a4}$ represents a hydrogen atom, a $C_{1-40}$ aliphatic group, a $C_{6-56}$ aromatic group, —C(=O)$R_{a43}$ or —S(=O)$_{n9}R_{a43}$, provided that the total number of carbon atoms contained in $R_{a2}$, $R_{a3}$ and $R_{a4}$ is at least 8; $Z_{a4}$ represents —O— or —S—; $R_{a41}$ represents a $C_{1-40}$ aliphatic group, a $C_{6-56}$ aromatic group, a $C_{1-40}$ aliphatic oxy group, a $C_{6-56}$ aromatic oxy group, a $C_{1-50}$ aliphatic amino group or a $C_{6-56}$ aromatic amino group; $R_{a42}$ represents a $C_{1-40}$ aliphatic group, a $C_{6-56}$ aromatic group, a $C_{1-40}$ aliphatic oxy group or a $C_{6-56}$ aromatic oxy group; $R_{a43}$ represents a $C_{1-40}$ aliphatic group, a $C_{6-56}$ aromatic group, a $C_{1-50}$ aliphatic amino group or a $C_{6-56}$ aromatic amino group; n8 represents 1 or 2; and n9 represents 1 or 2; $R_{a2}$, $R_{a3}$ or $R_{a4}$ may form polymer of higher than dimer; and a 5- to 8-membered ring, excluding a 2,2,6,6-tetraalkylpiperidine ring, may be formed by combining $R_{a2}$ with $R_{a3}$; and which may form a dimer or higher polymer via $R_{a2}$, $R_{a3}$ or $R_{a4}$;

(a-IV)

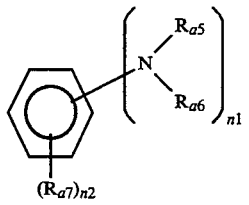

wherein $R_{a5}$ represents —C(=O)$R_{a51}$, —S(=O)$_{n10}R_{a51}$, or —P(=O)($R_{a51}$)($R_{a52}$); $R_{a6}$ represents a hydrogen atom, a $C_{1-40}$ aliphatic group, a $C_{6-56}$ aromatic group, a $C_{1-50}$ 5-to 8-membered heterocyclic group, or one of the groups defined as $R_{a5}$; $R_{a7}$ represents a halogen atom, a $C_{1-40}$ aliphatic group, a $C_{6-56}$ aromatic group, a 5- to 8-$C_{1-50}$ membered heterocyclic group, a nitro group, a cyano group, —C(=O)$R_{a53}$, or —S(=O)$_{n11}R_{a53}$; n1 represents an integer from 1 to 3 and n2 represents 0 or an integer from 1 to 4, provided that the sum of n1 and n2 is 6 or less;

$R_{a51}$ and $R_{a53}$ each independently represents a $C_{1-40}$ aliphatic group, a $C_{6-56}$ aromatic group, a $C_{1-40}$ aliphatic oxy group, a $C_{6-56}$ aromatic oxy group, a $C_{1-50}$ aliphatic amino group, or a $C_{6-56}$ aromatic amino group; $R_{a52}$ represents a $C_{1-40}$ aliphatic group, a $C_{6-56}$ aromatic group, a $C_{1-40}$ aliphatic oxy group, or a $C_{6-56}$ aromatic oxy group; n10 and n11 each represent 1 or 2; a 5- to 8-membered ring may be formed by combining $R_{a5}$ with $R_{a6}$; and when n2 is 2 or more, two adjacent $R_{a7}$'s may combine with each other to form a 5- to 8-membered ring: and which may form a dimer or higher polymer via $R_{a5}$ or $R_{a7}$;

(a-V)

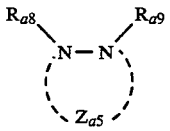

wherein $R_{a8}$ and $R_{a9}$ each represent a hydrogen atom, an aliphatic group, an aromatic group, a heterocyclic group, —C(=O)$R_{a61}$, —S(=O)$_{n12}R_{a61}$ or —P(=O)($R_{a61}$)($R_{a62}$), provided that the total number of carbon atoms contained in $R_{a8}$ and $R_{a9}$ is at least 6; $Z_{a5}$ represents nonmetal atoms completing a 5- to 8-membered $C_{1-50}$ hetero ring together with the two nitrogen atoms; $R_{a61}$ represents a $C_{1-40}$ aliphatic group, a $C_{6-56}$ aromatic group, a $C_{1-40}$ aliphatic oxy group, a $C_{6-56}$ aromatic oxy group, a $C_{1-50}$ aliphatic amino group, or a $C_{6-56}$ aromatic amino group; and $R_{a62}$ represents a $C_{1-40}$ aliphatic group, a $C_{6-56}$ aromatic group, a $C_{1-40}$ aliphatic oxy group, or a $C_{6-56}$ aromatic oxy group, and which may form a dimer or higher polymer via $R_{a8}$ or $R_{a9}$;

(a-VI)

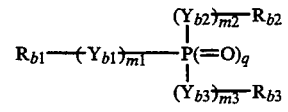

wherein $R_{b1}$, $R_{b2}$ and $R_{b3}$ each represent a $C_{1-40}$ aliphatic group or a $C_{6-56}$ aromatic group; $Y_{b1}$, $Y_{b2}$ and $Y_{b3}$ each represent —O—, —S—, or —N($R_{b4}$)—; m1, m2, m3 and q each represent 0 or 1, excluding compounds where m1=m2=m3=1 when q=1, and compounds where m1=m2=m3=0 when q=0; $R_{b4}$ represents a hydrogen atom, an aliphatic group, or an aromatic group; any two among $R_{b1}$, $R_{b2}$ and $R_{b3}$ may combine with each other to complete a 5- to 9-membered ring together with the phosphorus atom, wherein the case of m1=m2=m3=1 is allowed; and further, $R_{b4}$ may combine with $R_{b1}$, $R_{b2}$ or $R_{b3}$ to form a 5- or 6-membered ring.

(a-VII)

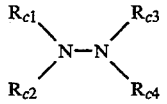

wherein $R_{c1}$, $R_{c2}$ and $R_{c3}$ each represent an $C_{1-50}$ aliphatic group; and $R_{c4}$ represents an aliphatic group having 6 or more carbon atoms; $R_{c1}$ and $R_{c2}$, and $R_{c3}$ and $R_{c4}$ may combine with each other to complete a 5- to 8-membered ring, whereas $R_{c1}$ and $R_{c3}$, and $R_{c2}$ and $R_{c4}$ do not combine with each other.

DETAILED DESCRIPTION OF THE INVENTION

The term "aliphatic group" used herein is intended to include $C_{1-40}$ straight-chain, branched and cyclic hydrocarbon residues which may be saturated or unsaturated, namely alkyl, alkenyl, alkynyl, cycloalkyl and cycloalkenyl groups, and further which may have substituent group(s). The term "aromatic group" used herein refers to $C_{5-56}$ aromatic hydrocarbon group (an aryl group). The term "heterocyclic group" used herein refers to a $C_{1-50}$ hetero atom-containing ring which includes aromatic ones, and which may be substituted.

A carbon number specified in each group of the present invention means total carbon numbers which include a carbon number of a substituent when the group is substituted.

Couplers represented by the general formula (1) are described below in detail.

A nitrogen-containing heterocyclyl group which $X^3$ forms together with

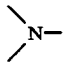

is a residue of a 3- to 12-membered, preferably 5- or 6-membered, substituted or unsubstituted, saturated or unsaturated, monocyclic or condensed polycyclic hetero ring which contains 1 to 20, preferably 1 to 15, carbon atoms and optionally contains oxygen or sulfur atom(s) in addition to the nitrogen atom. Specific examples of such a heterocyclyl group include pyrrolidino, piperidino, morpholino, 1-piperazinyl, 1-indolinyl, 1,2,3,4-tetrahydroquinoline-1-yl, 1-imidazolidinyl, 1-pyrazolyl, 1-pyrrolinyl, 1-pyrazolidinyl, 2,3-dihydro-1-indazolyl, 2-isoindolinyl, 1-indolyl, 1-pyrrolyl, 4-thiazine-S,S-dioxo-4-yl and benzoxazine-4-yl.

When a nitrogen-containing heterocyclic group formed by $X^3$ and

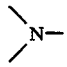

contains substituent group(s), those set forth below can be given as examples of such substituent groups. Specifically, they include halogen atoms (e.g., F, Cl), alkoxycarbonyl groups (containing 2 to 30, preferably 2 to 20, carbon atoms, such as methoxycarbonyl, dodecyloxycarbonyl, hexadecyloxycarbonyl), acylamino groups (containing 2 to 30, preferably 2 to 20 carbon atoms, such as acetamido, tetradecanamido, 2-(2,4-di-t-amylphenoxy)butanamido, benzamido, etc.), sulfonamido groups (containing 1 to 30, preferably 1 to 20, carbon atoms, such as methanesulfonamido, dodecanesulfonamido, hexadecanesulfonamido, benzenesulfonamido, etc.), carbamoyl groups (containing 1 to 30, preferably 1 to 20, carbon atoms, such as N-butylcarbamoyl, N,N-diethylcarbamoyl, etc.), N-sulfonylcarbamoyl groups (containing 1 to 30, preferably 1 to 20, carbon atoms, such as N-mesylsulfamoyl, N-dodecylsulfonylcarbamoyl, etc.), sulfamoyl groups (containing 1 to 30, preferably 1 to 20, carbon atoms, such as N-butylsulfamoyl, N-dodecylsulfamoyl, N-hexadecylsulfamoyl, N-(3-(2,4-di-t-amylphenoxy)butylsulfamoyl, N,N-diethylsulfamoyl, etc.), alkoxy groups (containing 1 to 30, preferably 1 to 20, carbon atoms, such as methoxy, hexadecyloxy, isopropoxy, etc.), aryloxy groups (containing 6 to 20, preferably 6 to 10, carbon atoms, such as phenoxy, 4-methoxyphenoxy, 3-t-butyl-4-hydroxyphenoxy, naphthoxy), aryloxycarbonyl groups (containing 7 to 21, preferably 7 to 11, carbon atoms, such as phenoxycarbonyl), N-acylsulfamoyl groups (containing 2 to 30, preferably 2 to 20, carbon atoms, such as N-propanoylsulfamoyl, N-tetradecanoylsulfamoyl, etc.), sulfonyl groups (containing 1 to 30, preferably 1 to 20, carbon atoms, such as methanesulfonyl, octanesulfonyl, 4-hydroxybenzenesulfonyl, dodecanesulfonyl, etc.), alkoxycarbonylamino groups (containing 1 to 30, preferably 1 to 20, carbon atoms, such as ethoxycarbonylamino), the cyano group, the nitro group, the carboxyl group, the hydroxyl group, the sulfo group, alkylthio groups (containing 1 to 30, preferably 1 to 20, carbon atoms, such as methylthio, dodecylthio, dodecylcarbamoylmethylthio, etc.), ureido groups (containing 1 to 30, preferably 1 to 20, carbon atoms, such as N-phenylureido, N-hexadecylureido, etc.), aryl groups (containing 6 to 20, preferably 6 to 10, carbon atoms, such as phenyl, naphthyl, etc.), heterocyclyl groups (containing 1 to 20, preferably 1 to 10, carbon atoms and at least one hetero atom selected from among nitrogen, oxygen and sulfur atoms, which are monovalent residues of 3- to 12-membered, preferably 5- or 6-membered, monocyclic or condensed polycyclic rings, such as 2-pyridyl, 3-pyrazolyl, 1-pyrrolyl, 2,4-dioxo-1,3-imidazolidine-1-yl, 2-benzoxazolyl, morpholino, indolyl, etc.), alkyl groups (containing 1 to 30, preferably 1 to 20, carbon atoms, which may have a straight-chain, branched or cyclic structure or may be saturated or unsaturated, such as methyl, ethyl, isopropyl, cyclopropyl, t-pentyl, t-octyl, cyclopentyl, t-butyl, s-butyl, dodecyl, 2-hexyldecyl, etc.), acyl groups (containing 1 to 30, preferably 2 to 20, carbon atoms, such as acetyl, benzoyl, etc.), acyloxy groups (containing 2 to 30, preferably 2 to 20, carbon atoms, such as propanoyloxy, tetradecanoyloxy, etc.), arylthio groups (containing 6 to 20, preferably 6 to 10, carbon atoms, such as phenylthio, naphthylthio, etc.), sulfamoylamino groups (containing 0 to 30, preferably 0 to 20, carbon atoms, such as N-butylsulfamoylamino, N-dodecylsulfamoylamino, N-phenylsulfamoylamino, etc.) and N-sulfonylsulfamoyl groups (containing 1 to 30, preferably 1 to 20, carbon atoms, such as N-mesylsulfamoyl, N-ethanesulfonylsulfamoyl, N-dodecanesulfonylsulfamoyl, N-hexadecanesulfonylsulfamoyl, etc.).

The substituent groups cited above may further be substituted by other groups including the above-cited groups.

As examples of particularly preferred substituent groups, mention may be made of alkoxy groups, halogen atoms, alkoxycarbonyl groups, acyloxy groups, acylamino groups, sulfonyl groups, carbamoyl groups, sulfamoyl groups, sulfonamido groups, nitro group, alkyl groups and aryl groups.

An aromatic group represented by Y in the foregoing general formula (1) is a substituted or unsubstituted aryl group containing 6 to 50, preferably 6 to 20, more preferably 6 to 10, carbon atoms. Typical examples of such an aryl group are phenyl and naphthyl groups.

In the general formula (1), when the foregoing represents a heterocyclic group, the heterocyclic group has 1 to 20, preferably 1 to 10 carbon atoms and at least one nitrogen atom, oxygen atom or sulfur atom, and is composed of 3- to 12-membered, preferably of 5- or 6-membered, saturated or unsaturated, and substituted or unsubstituted, single ring or condensed ring. Example of the heterocyclic group includes 3-pyrrolidinyl, 1,2,4-triazol-3-yl, 2-pyridyl, 4-pyrimidinyl, 3-pyrazolyl, 2-pyrrolyl, 2,4-dioxo-1,3-imidazolidin-5-yl or pyranyl.

When the foregoing Y represents a substituted aromatic group or a substituted heterocyclic group, the substituents thereof can include those given as examples of substituents suitable for the substituted groups represented by $X^3$. Herein, it is desirable that one of the substituents of said substituted group should be a halogen atom, an alkoxycarbonyl group, a sulfamoyl group, a carbamoyl group, a sulfonyl group, an N-sulfonylsulfamoyl group, an N-acylsulfamoyl group, an alkoxy group, an acylamino group, an N-sulfonylcarbamoyl group, a sulfonamido group or an alkyl group.

Groups particularly preferred as Y are phenyl groups which have at least one substituent group situated in the o-position.

A group represented by Z in the foregoing general formula (1) may be any of hitherto known coupling eliminatable groups. As examples of a coupling eliminatable group preferred as Z, mention may be made of a nitrogen-containing heterocyclyl group capable of binding to the coupling site via its nitrogen atom, an aryloxy group, an arylthio group, a heterocyclyloxy group, a heterocyclylthio group, an acyloxy group, a carbamoyloxy group, an alkylthio group and a halogen atom.

These coupling eliminatable groups may be any of photographically non-useful groups, or any of photographically useful groups or precursors thereof (e.g., those derived from development inhibitors, development accelerators, desilvering accelerators, fogging agents, dyes, hardeners, couplers, scavengers for oxidized developers, fluorescent dyes, developing agents, or electron transfer agents).

When Z is a photographically useful group, hitherto known groups are applicable thereto. For instance, photographically useful groups or eliminatable groups for releasing them (e.g., timing groups) as disclosed in U.S. Pat. Nos. 4,248,962, 4,409,323, 4,438,193, 4,421,845, 4,618,571, 4,652,516, 4,861,701, 4,782,012, 4,857,440, 4,847,185, 4,477,563, 4,438,193, 4,628,024, 4,618,571 and 4,741,994, EP-A-0193389, EP-A-0348139 and EP-A-0272573 can be used.

A nitrogen-containing heterocyclyl group preferred as Z, which can bind to the coupling site via its nitrogen atom, includes 5- or 6-membered, substituted or unsubstituted, saturated or unsaturated, monocyclic or condensed polycyclic heterocyclyl groups containing 1 to 15 (preferably 1 to 10) carbon atoms. Therein, oxygen and/or sulfur atom(s) may be contained as hetero atoms in addition to nitrogen atom(s). Specific examples of a heterocyclyl group suitable for Z include 1-pyrazolyl, 1-imidazolyl, pyrrolino, 1,2,4-triazole-2-yl, 1,2,3-triazole-1-yl, benzotriazolyl, benzimidazolyl, imidazolidine-2,4-dione-3-yl, oxazolidine-2,4-dione-3-yl, 1,2,4-triazolidine-3,5-dione-4-yl, imidazolidine-2,4,5-trione-3-yl, 2-imidazolinone-1-yl, 3,5-dioxomorpholino, and 1indazolyl. When these heterocyclyl groups have substituents, such substituents can include those given as examples of substituents which the groups represented by $X^3$ may have. Herein, it is desirable that one of said substituents should be an alkyl group, an alkoxy group, a halogen atom, an alkoxycarbonyl group, an aryloxycarbonyl group, an alkylthio group, an acylamino group, a sulfonamido group, an aryl group, a nitro group, a carbamoyl group, a cyano group, or a sulfonyl group.

An aromatic oxy group represented by Z is preferably a substituted or unsubstituted aryloxy group containing 6 to 10 carbon atoms. Aryloxy groups particularly preferred as Z are substituted and unsubstituted phenoxy groups. When an aryloxy group represented by Z has substituents, such substituents can include those given as examples of substituents which the aforementioned groups represented by $X^3$ may have. Herein, it is desirable that one of said substituents should be an electron-attracting group, with specific examples including a sulfonyl group, an alkoxycarbonyl group, a sulfamoyl group, a halogen atom, a carbamoyl group, a nitro group, cyano group or an acyl group.

An aromatic thio group represented by Z is preferably a substituted or unsubstituted arylthio group containing 6 to 10 carbon atoms. Arylthio groups particularly preferred as Z are substituted and unsubstituted phenylthio groups. When these arylthio groups have substituents, such substituents can include those given as examples of substituents which the groups represented by $X^3$ may have. Herein, it is desirable that one of said substituents should be an alkyl group, an alkoxy group, a sulfonyl group, an alkoxycarbonyl group, a sulfamoyl group, a halogen atom, a carbamoyl group or a nitro group.

When Z represents a heterocyclyloxy group, the heterocyclic nucleus thereof is a 3- to 12-membered, preferably a 5- or 6-membered, substituted or unsubstituted, saturated or unsaturated, monocyclic or condensed polycyclic ring which contains 1 to 20, preferably 1 to 10, carbon atoms and at least one hetero atom such as nitrogen, oxygen or sulfur atom. Suitable heterocyclyloxy groups for Z are, e.g., a pyridyloxy group, a pyrazolyloxy group and a furyloxy group. When these heterocyclyloxy groups have substituents, such substituents can include those given as examples of substituents which the groups represented by $X^3$ may have. Herein, it is desirable that one of said substituents should be an alkyl group, an aryl group, a carboxyl group, an alkoxy group, a halogen atom, an alkoxycarbonyl group, an aryloxycarbonyl group, an alkylthio group, an acylamino group, a sulfonamido group, a nitro group, a carbamoyl group or a sulfonyl group.

When Z represents a heterocyclylthio group, the heterocyclic nucleus thereof is a 3- to 12-membered, preferably a 5- or 6-membered, substituted or unsubstituted, saturated or unsaturated, monocyclic or condensed polycyclic ring which contains 1 to 20, preferably 1 to 10, carbon atoms and at least one hetero atom such as nitrogen, oxygen or sulfur atom. Suitable heterocyclylthio groups for Z are, e.g., a tetrazolylthio group, a 1,3,4-thiadiazolylthio group, a 1,3,4-oxadiazolylthio group, 1,3,4-triazolylthio group, a benzimidazolylthio group, a benzothiazolylthio group and a 1-pyridylthio group. When these heterocyclylthio groups have substituents, such substituents can include those given as examples of substituents which the groups represented by $X^3$ may have. Herein, it is desirable that one of said substituents should be an alkyl group, an aryl group, a carboxyl group, an alkoxy group, a halogen atom, an alkoxycarbonyl group, an aryloxycarbonyl group, an alkylthio group, an acylamino group, a sulfonamido group, a nitro group, a carbamoyl group, a heterocyclyl group or a sulfonyl group.

When Z represents an acyloxy group, it is preferably a monocyclic or condensed polycyclic, substituted or unsubstituted aromatic acyloxy group containing 6 to 10 carbon atoms, or a substituted or unsubstituted aliphatic acyloxy group containing 2 to 30, preferably 2 to 20, carbon atoms. When these acyloxy groups have substituents, such substituents can include those given as examples of substituents which the groups represented by $X^3$ may have.

When Z represents a carbamoyloxy group, it is a substituted or unsubstituted, aliphatic, aromatic or heterocyclic carbamoyloxy group containing 1 to 30, preferably 1 to 20, carbon atoms. Specific examples of such a carbamoyloxy group include N,N-diethylcarbamoyloxy, N-phenylcarbamoyloxy, 1-imidazolylcarbonyloxy and 1-pyrrolocarbonyloxy. When these groups have substituents, such substituents can include those given as examples of substituents which the groups represented by $x^3$ may have.

Further, a particularly desirable scope of couplers represented by the general formula (1) is illustrated below.

A group represented by Y in the general formula (1) is preferably an aromatic group, and particularly preferably a phenyl group having at least one substituent situated in the o-position. The definition of such a substituent is the same as that given hereinbefore for the substituents which aromatic groups represented by Y may have. Also, the definition of preferred substituents is the same as that given hereinbefore.

A group represented by Z in the general formula (1) is preferably a 5- or 6-membered nitrogen-containing heterocyclyl group which can bind to the coupling site via its nitrogen atom, an aryloxy group, a 5- or 6-membered heterocyclyloxy group, or a 5- or 6-membered heterocyclylthio group.

Among the couplers represented by the general formula (1), those represented by the following general formula (2) or (3) is preferred in particular.

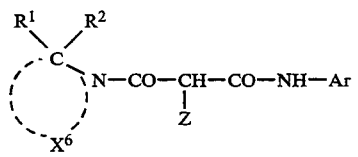

(2)

-continued

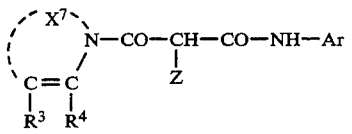

(3)

In the foregoing formulae, Z has the same meaning as described in the general formula (1), Ar represents a phenyl group having at least one substituent situated in the o-position, $X^6$ represents an organic residue forming a nitrogen-containing heterocyclic ring (which may be a single or condensed ring) together with $—C(R^1)(R^2)—N<$, $X^7$ represents an organic residue forming a nitrogen-containing heterocyclic ring (which may be a single or condensed ring) together with $—C(R^3)=C(R^4)—N<$. Therein, $R^1$, $R^2$, $R^3$ and $R^4$ each represent a hydrogen atom, or a substituent group.

Detailed descriptions and preferable scopes of groups represented by $X^6$ or $X^7$, Ar and Z respectively in the general formulae (2) and (3) are the same as those given to their respectively corresponding symbols used in the general formula (1). Examples of substituents represented by $R^1$ to $R^4$ include those given as examples of substituents which the groups represented by $X^3$ may have.

In particular, it is desirable in the general formula (3) that a nitrogen-containing heterocyclic ring completed by $X^7$ should be a 5-membered ring and $R^3$ and $R^4$ should combine with each other to complete an optionally substituted benzene ring.

Among the couplers represented by the above-illustrated general formulae, those represented by the general formula (3) are preferred in particular over others.

Couplers which are most preferred in the present invention are represented by the following general formula (4):

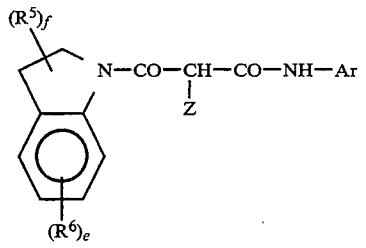

In the foregoing formula, Ar and Z have the same meaning as in the general formula (3), $R^5$ and $R^6$ each represent a substituent, e represents 0 or an integer from 1 to 4 and f represents 0 or an integer from 1 to 2. When e is 2, 3 or 4, $R^6$'s may be different from one another, and when f is 2, 3 or 4, $R^5$'s may be different from one another.

As examples of substituents represented by $R^5$ and $R^6$, mention may be made of the substituents which the aforementioned $X^3$ may have.

Each coupler, which can be represented by one of the foregoing general formulae (1) to (4), may form a dimer or higher polymer (e.g., telomer or polymer) by mutual combination of two or more molecules thereof via a divalent or higher valent group derived from $X^3$ to $X^7$, Y, Ar, $R^1$ to $R^6$, or Z. In this case, the limits imposed on the number of carbon atoms contained in each of the foregoing substituents do not apply.

It is more desirable that the couplers represented by the general formulae (1) to (4) should be nondiffusion couplers. The term "nondiffusion coupler" refers to the type of coupler containing group(s) capable of ensuring that the coupler has a high enough molecular weight to render it immobile in the coupler-added layer. In general, an alkyl group in which the number of carbon atoms is 8 to 30, preferably 10 to 20, in all, or an aryl group containing substituents in which the number of carbon atoms is 4 to 20 in all is used as the group for rendering the coupler nondiffusible. Such a nondiffusible group may be situated in any position of the coupler molecule, or the coupler molecule may contain two or more of such nondiffusible groups.

Specific examples of yellow couplers of the present invention are illustrated below. However, the invention should not be construed as being limited to these examples.

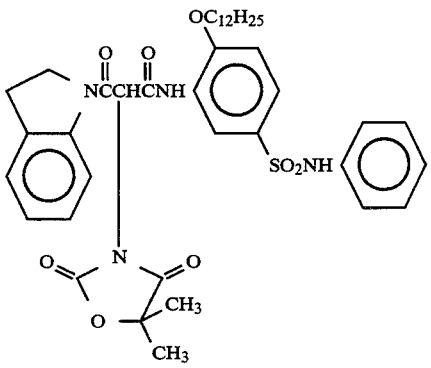

YY-1

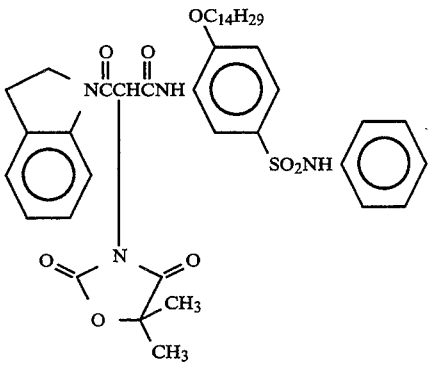

YY-2

-continued
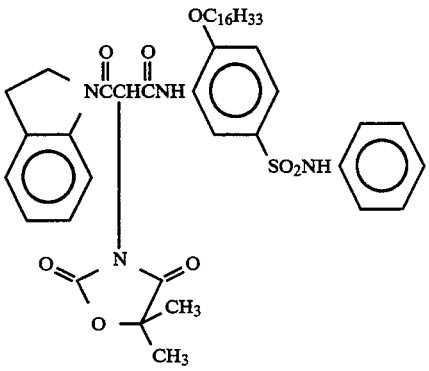
YY-3
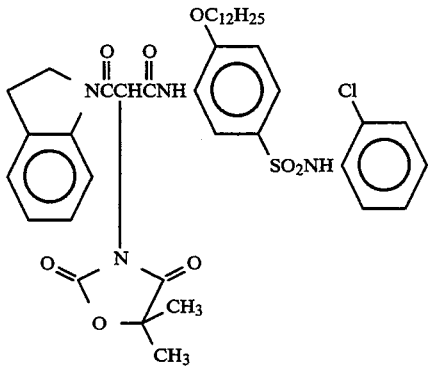
YY-4
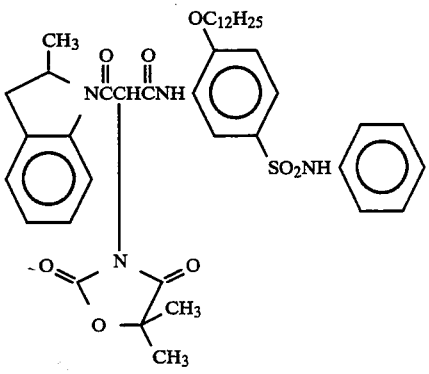
YY-5
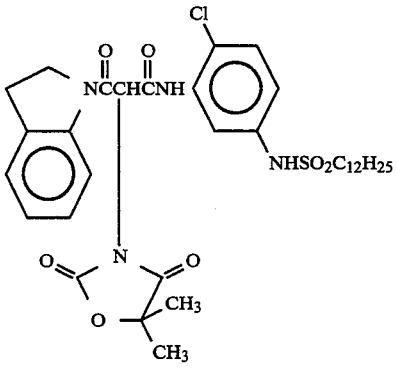
YY-6
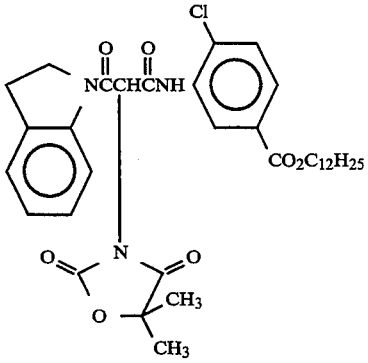
YY-7
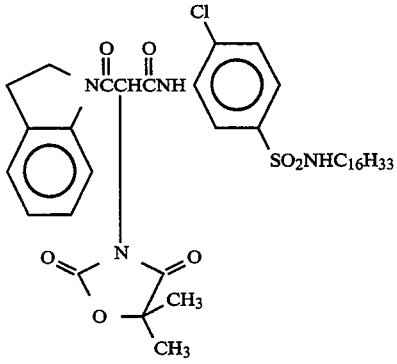
YY-8
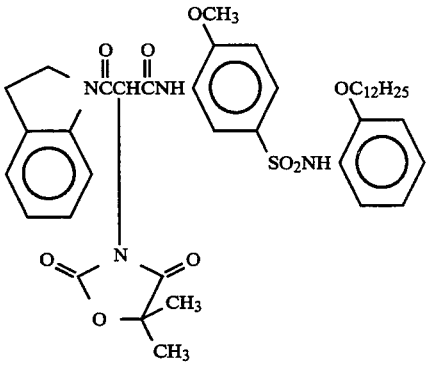
YY-9
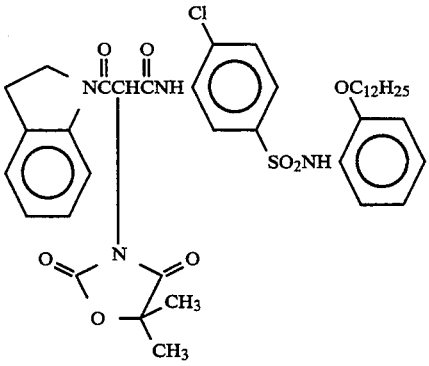
YY-10

-continued
YY-11
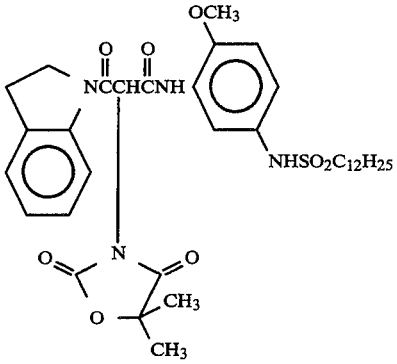
YY-12
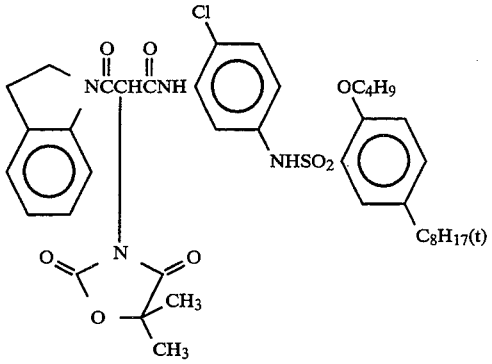
YY-13
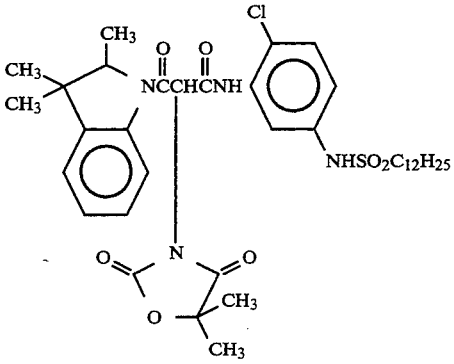
YY-14
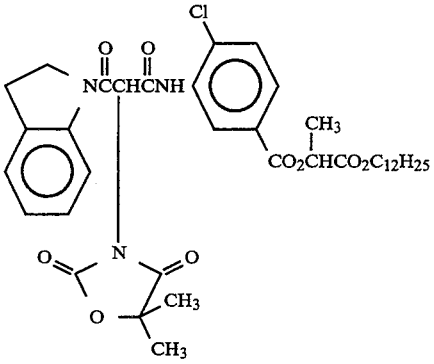
YY-15
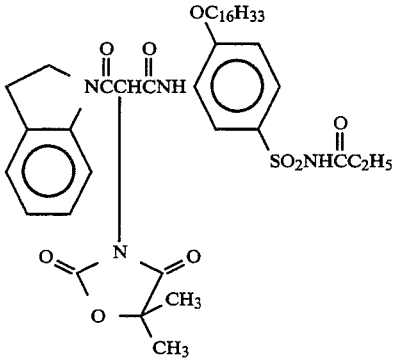
YY-16
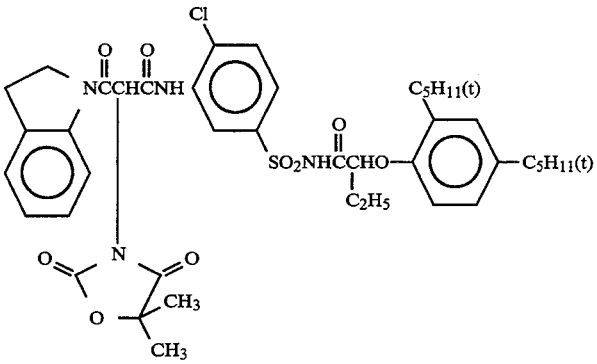

-continued
YY-17
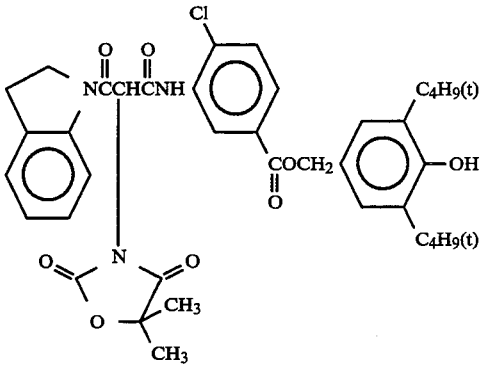
YY-18
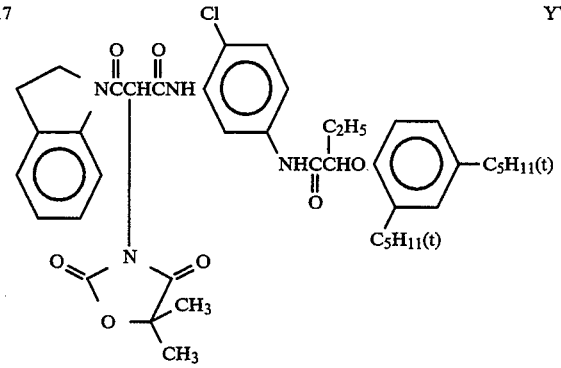
YY-19
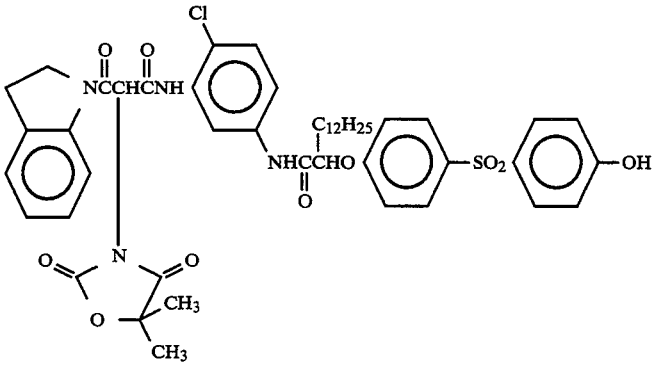
YY-20
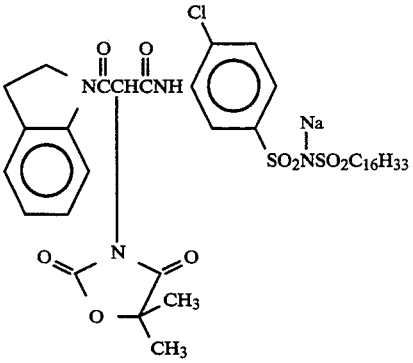
YY-21
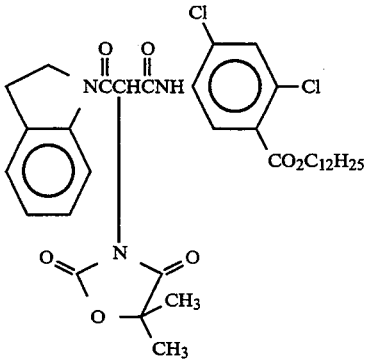
YY-22
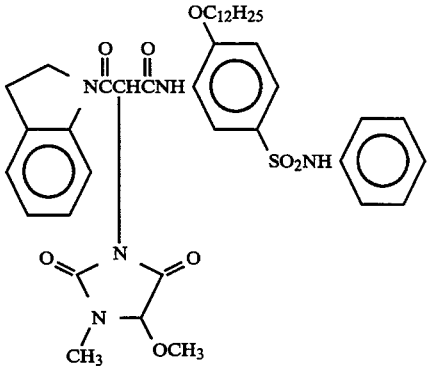
YY-23
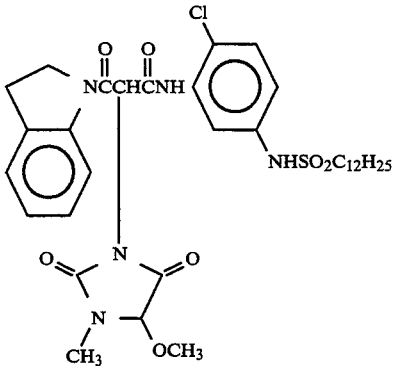

-continued
YY-24
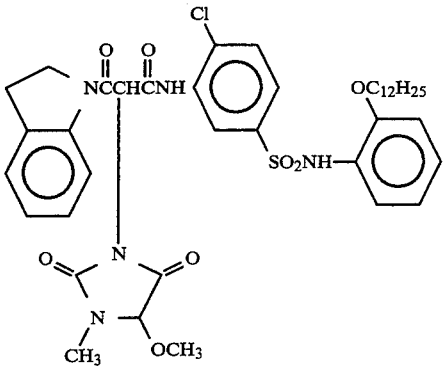
YY-25
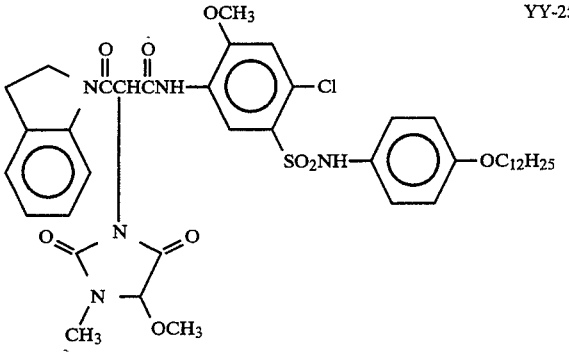
YY-26
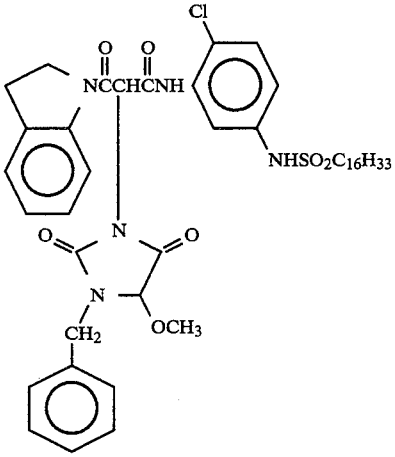
YY-27
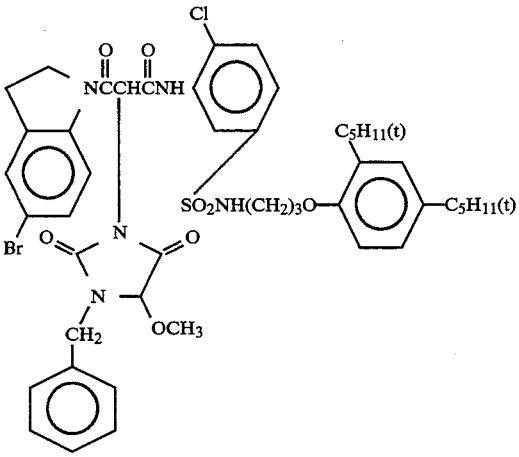
YY-28
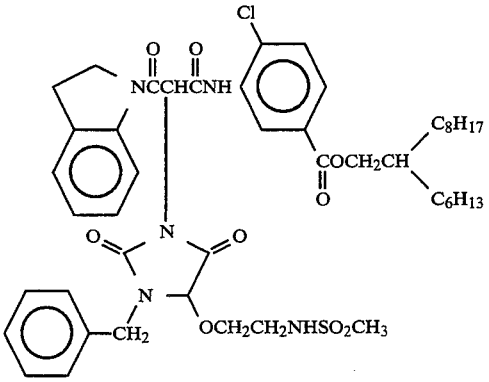
YY-29
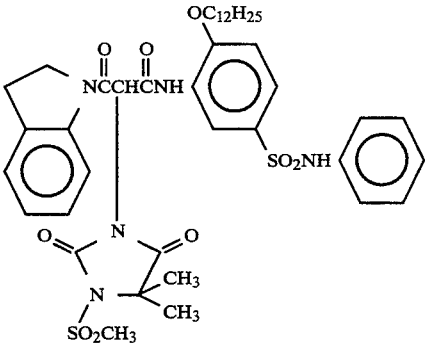
YY-30
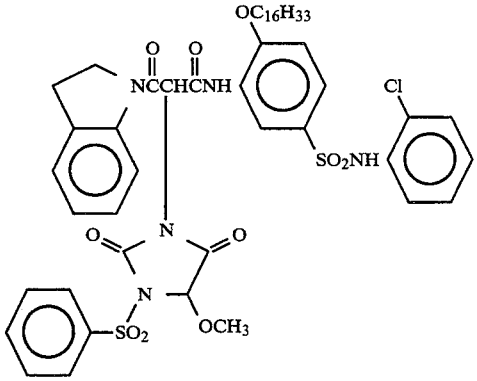

-continued
YY-31
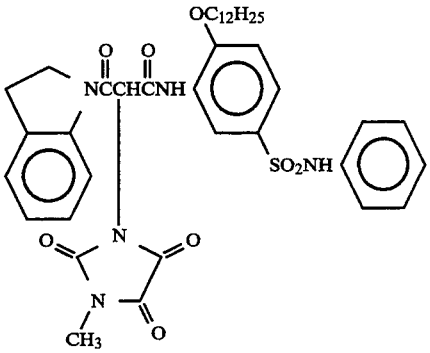
YY-32
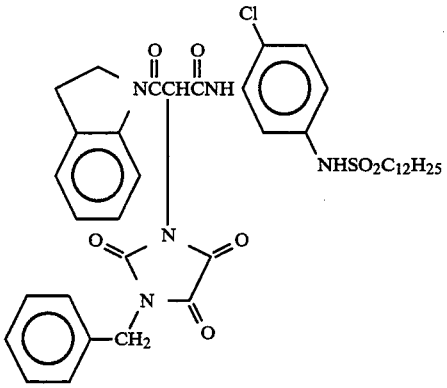
YY-33
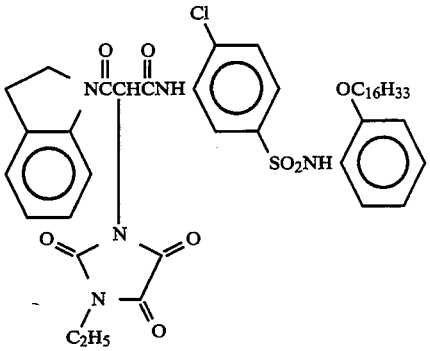
YY-34
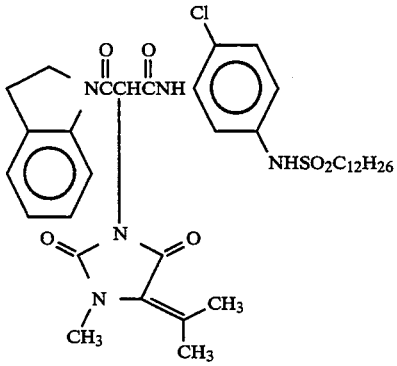
YY-35
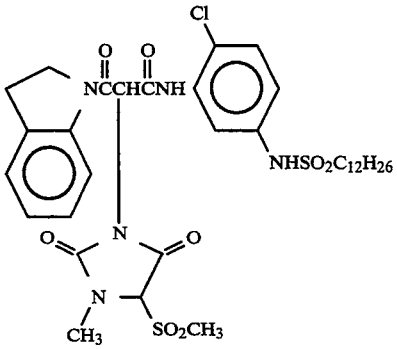
YY-36
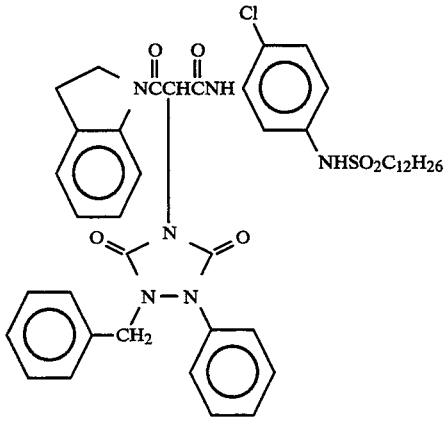
YY-37
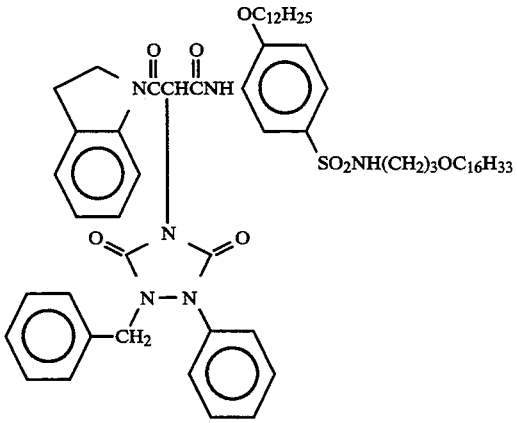
YY-38
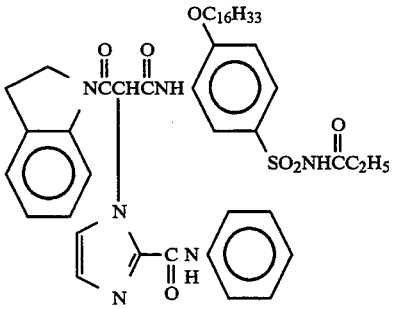

-continued
YY-39
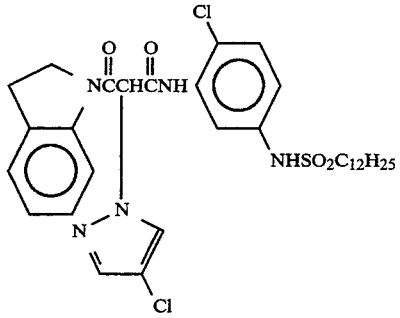
YY-40
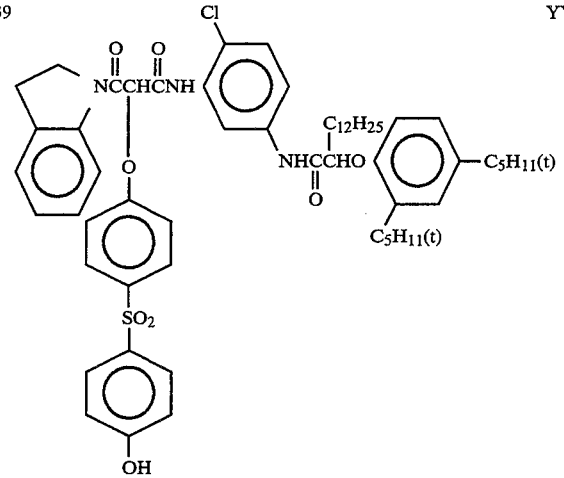
YY-41
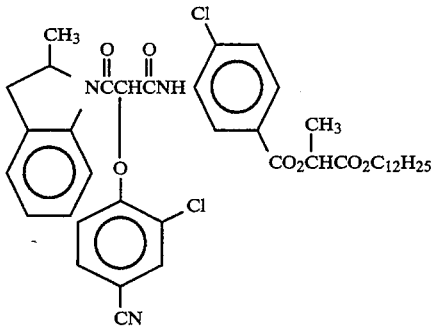
YY-42
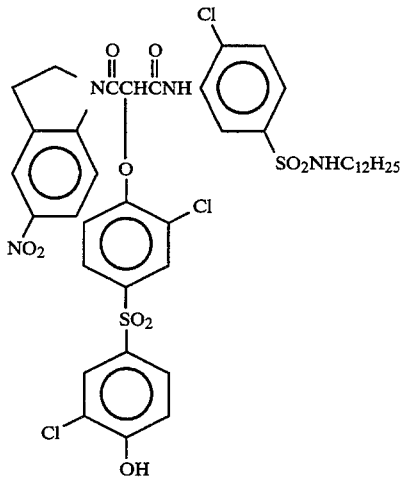
YY-43
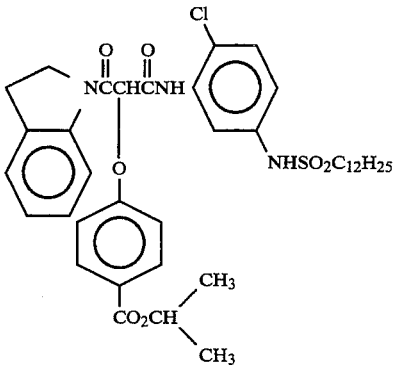
YY-44
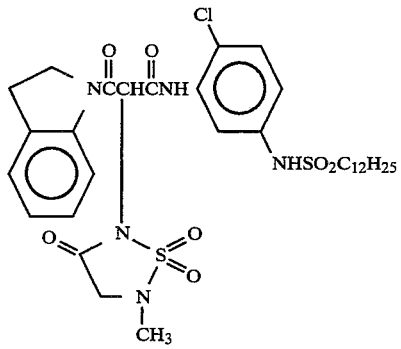
YY-45
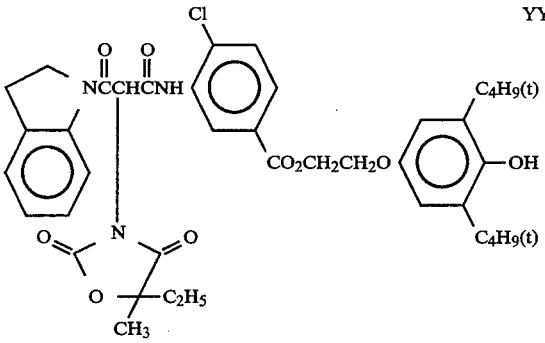
YY-46
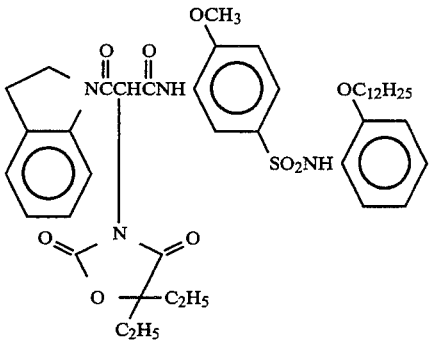

-continued
YY-47
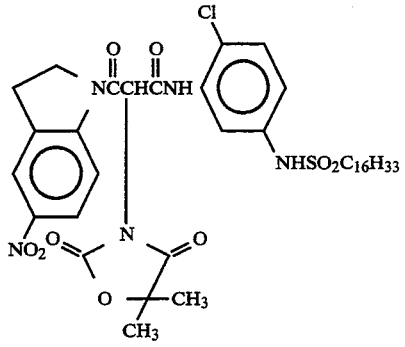
YY-48
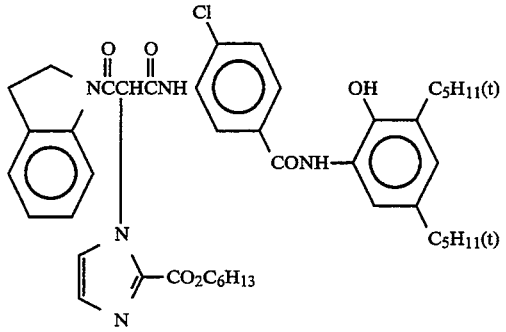
YY-49
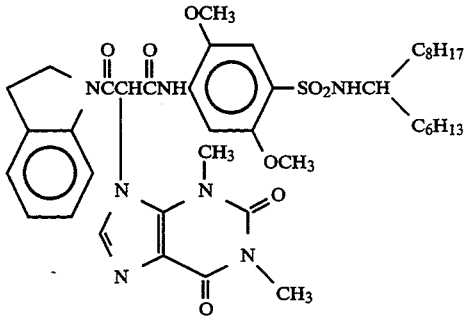
YY-50
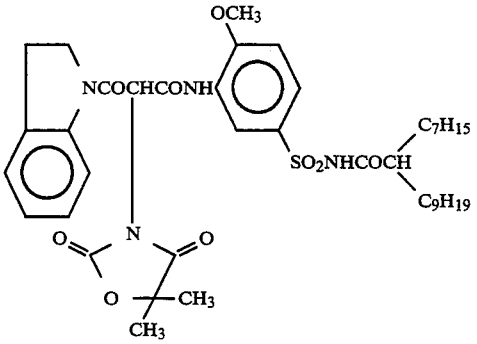
YY-51
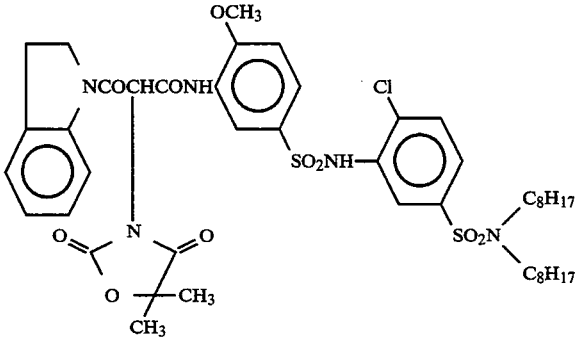
YY-52
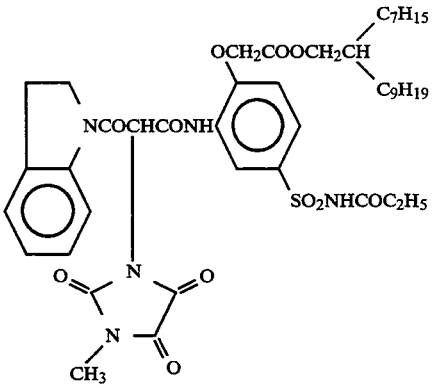
YY-53
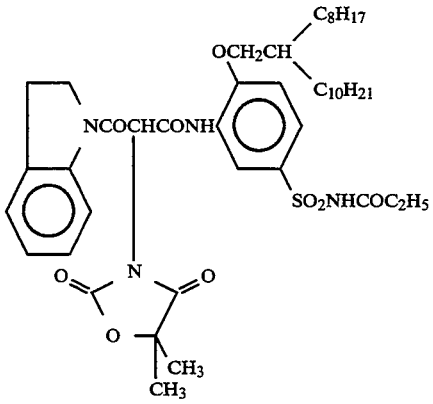

-continued
YY-54
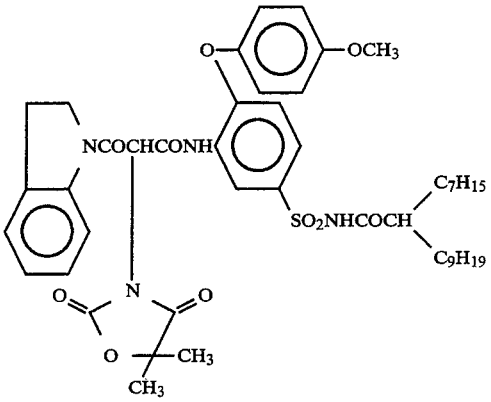
YY-55
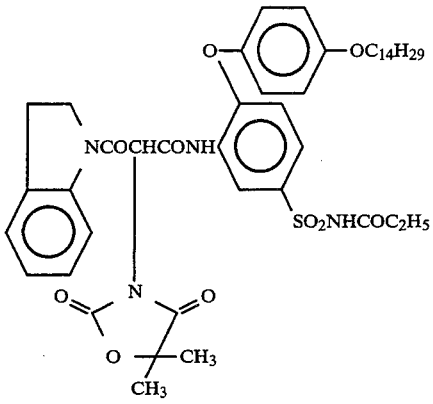
YY-56
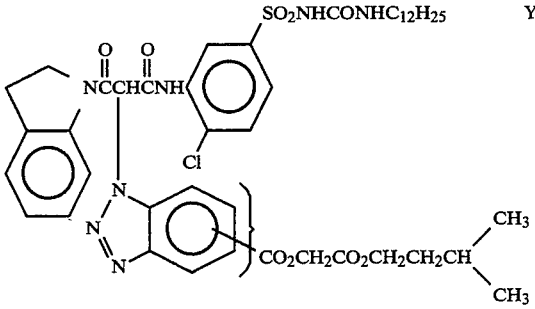
YY-57
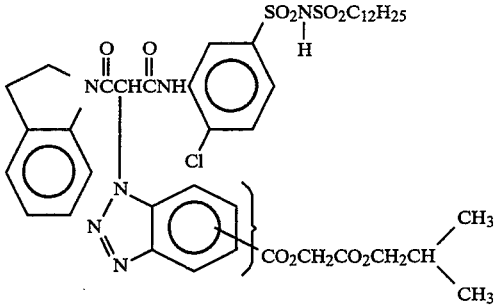
YY-58
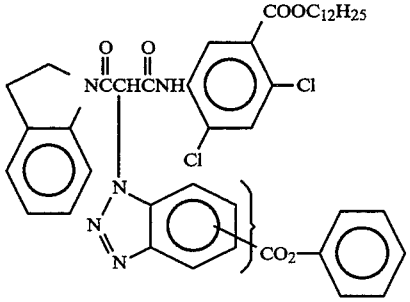
YY-59
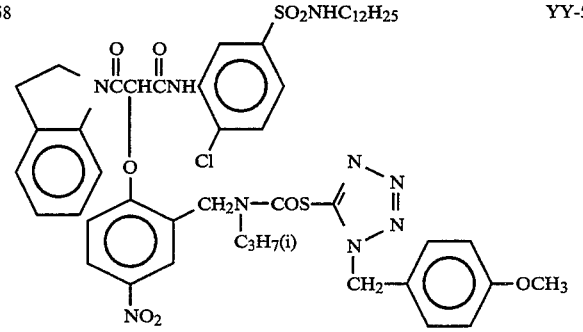
YY-60
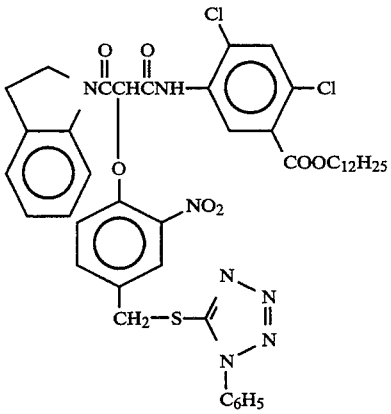
YY-61
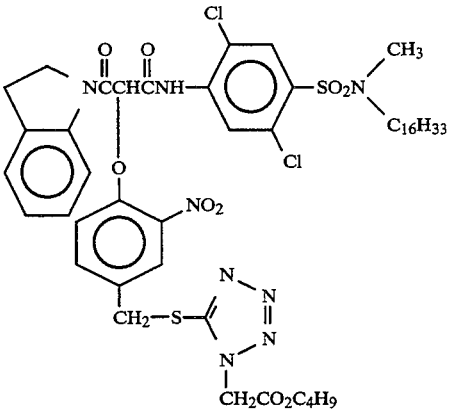

-continued
YY-62
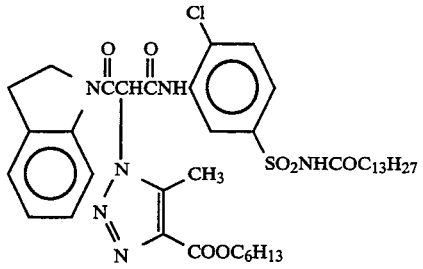
YY-63
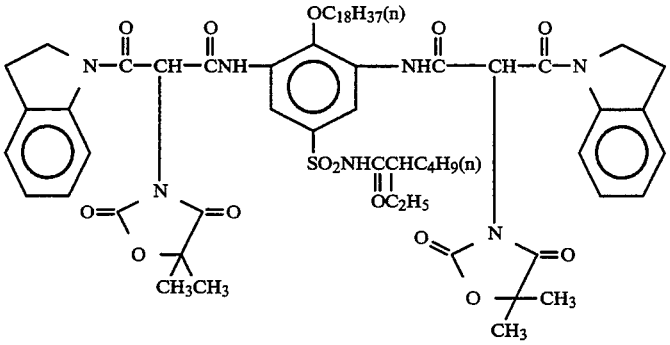
YY-64
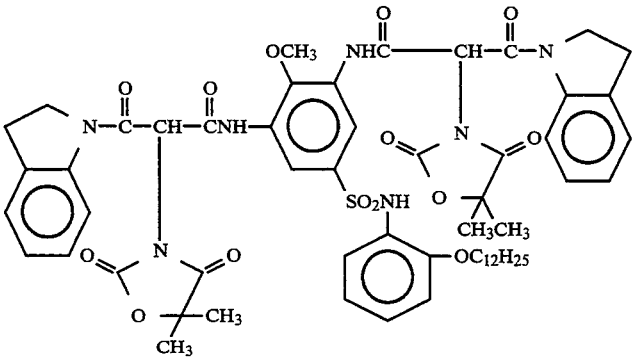
YY-65
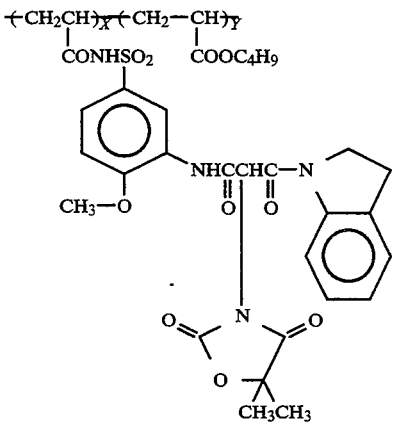
X/Y = 50/50

-continued

YY-66

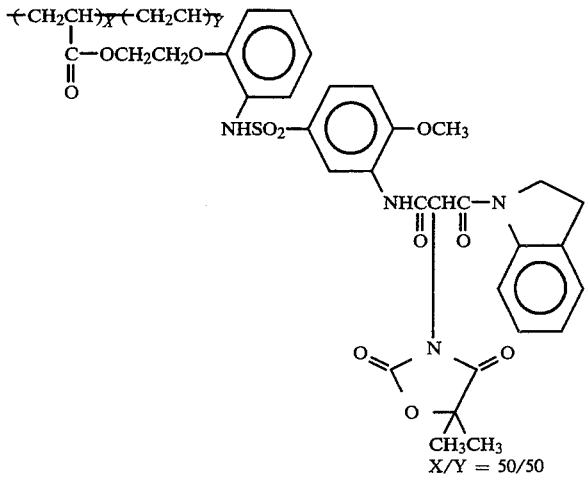

The yellow couplers represented by the general formula (1) can be prepared by the synthetic pathway illustrated below or pathways according thereto.

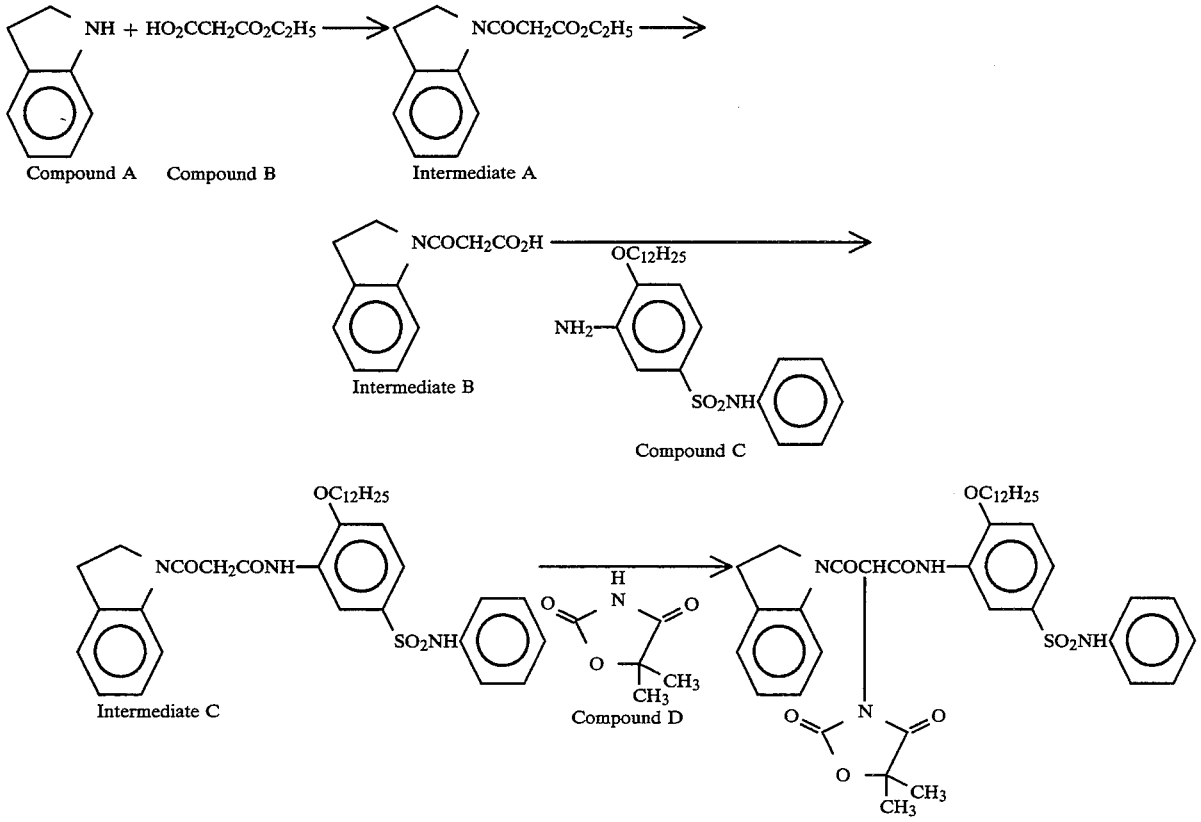

Example Coupler YY-1

Synthesis of said example coupler is described below in more detail. Additionally, other couplers also can be synthesized using the same process as the example coupler, or processes based thereon.

Synthesis of Example Coupler YY-1

(i) Synthesis of Intermediate B

In a mixture of 1.2 l of ethyl acetate and 0.6 l of dimethylformamide were dissolved 375.5 g (3.0 mol) of Compound A and 396.3 g (3.0 mol) of Compound B. Thereto, an acetonitrile solution (400 ml) containing 631 g (3.06 mol) of dicyclohexylcarbodiimide was added dropwise at a temperature of 15° to 35° C. with stirring. After the reaction was run at a temperature of 20° to 30° C. for 2 hours, the deposited dicyclohexyl urea was filtered out. To the filtrate were added 500 ml of ethyl acetate and 1 l of water, and then the aqueous phase was removed. Then, the organic phase was washed with two 1 l portions of water. The resulting organic phase was dried over anhydrous sodium sulfate, and therefrom the ethyl acetate was distilled away under reduced pressure. Thus, 629 g of Intermediate A was obtained as an oily matter (in a 98.9% yield).

To a solution containing 692 g (2.97 mol) of Intermediate A in 3 l of ethyl alcohol, 430 g of a 30% solution of sodium hydroxide was added dropwise at a temperature of 75° to 80° C. with stirring, and allowed to stand for 30 minutes at that temperature to complete the reaction. The thus precipitated crystals were filtered off. (Yield: 658 g)

These crystals were suspended in 5 l of water, and thereto was dropwise added 300 ml of conc. hydrochloric acid at 40° to 50° C. with stirring. The stirring was continued for additional one hour at that temperature to precipitate crystals. These crystals were filtered off to give 579 g of Intermediate B (in a 95% yield). (Decomposition point: 127° C.)

(ii) Synthesis of Intermediate C

In a mixture of 400 ml of ethyl acetate and 200 ml of dimethylacetamide were dissolved 45.1 g (0.22 mol) of Intermediate B and 86.6 g (0.2 mol) of Compound C. Thereto, an acetonitrile solution (100 ml) containing 66 g (0.32 mol) of dicyclohexylcarbodiimide was added dropwise at a temperature of 15° to 30° C. with stirring. After the reaction was run at a temperature of 20° to 30° C. for 2 hours, the deposited dicyclohexyl urea was filtered out.

To the filtrate were added 400 ml of ethyl acetate and 600 ml of water, and then the aqueous phase was removed. Then, the organic phase was washed twice with water. The resulting organic phase was dried over anhydrous sodium sulfate, and therefrom the ethyl acetate was distilled away under reduced pressure. Thus, 162 g of an oily matter was obtained.

The oily matter was crystallized from a mixture of 100 ml of ethyl acetate and 300 ml of n-hexane to give 108 g of Intermediate C (in a 87.1% yield). (Melting point: 132° to 134° C.)

(iii) Synthesis of Example Coupler YY-1

In 300 ml of dichloromethane was dissolved 49.6 g (0.08 mol) of Intermediate C. Thereto, 11.4 g (0.084 mol) of sulfuryl chloride was added dropwise at a temperature of 10° to 15° C. with stirring.

After the reaction was run for 30 minutes at that temperature, 200 g of a 5% aqueous solution of sodium bicarbonate was added dropwise to the reaction mixture. The organic phase was taken out, washed with 200 ml of water, and dried over anhydrous sodium sulfate. Therefrom, dichloromethane was distilled away under reduced pressure. Thus, 47 g of an oily matter was obtained.

In 200 ml of acetonitrile was dissolved 47 g of this oily matter, and thereto were dropwise added 28.4 g (0.22 mol) of Compound D and 22.2 g (0.22 mol) of triethylamine with stirring. After the reaction was run for 4 hours at a temperature of 40° to 50° C., the reaction mixture was poured into 300 ml of water to deposit an oily matter. The oily mater was extracted with 300 ml of ethyl acetate. The organic phase was washed with successive 200 g of a 5% aqueous solution of sodium hydroxide and two 300 ml portions of water. Further, the resulting organic phase was rendered acidic with dilute hydrochloric acid, and then washed twice with water, followed by concentration under reduced pressure. The thus obtained oily residue (70 g) was crystallized from a mixed solvent consisting of 50 ml of ethyl acetate and 100 ml of n-hexane. Thus, 47.8 g of the example coupler YY-1 was obtained (in a 80% yield). (Melting point: 145° to 147° C.)

The yellow dye-forming couplers of the present invention are preferably used in a silver halide emulsion layer coated on a support.

A standard amount of the yellow dye-forming couplers used in the present invention, which are represented by the foregoing general formula (1), ranges from 0.001 to 1 mol, preferably from 0.01 to 0.5 mol, per mole of silver halide present in the same layer.

The yellow dye-forming couplers of the present invention, which are represented by the foregoing general formula (1), may be used together with hitherto known couplers.

Now, compounds represented by the general formula (a-I) are described below.

Divalent linkage groups represented by $Z_{a1}$ and $Z_{a2}$ include, e.g., methylene, ethylene, propylene and carbonyl.

Aliphatic groups represented by $R_{a21}$ to $R_{a27}$ include, e.g., methyl, ethyl, propyl, t-butyl, i-butyl, 2-ethylhexyl, dodecyl, hexadecyl, dodecyloxyethyl, benzyl, cyclohexyl, allyl and cyclohexenyl. Among them, substituted or unsubstituted, straight-chain or branched alkyl groups are preferred over others. Aromatic groups represented by $R_{a21}$ to $R_{a27}$ include, e.g., phenyl, naphthyl and 4-methoxyphenyl. They are preferably phenyl or substituted phenyl groups. Heterocyclic groups represented by $R_{a21}$ to $R_{a27}$ include, e.g., 2-pyridyl and 4-pyridyl. Aliphatic oxy groups represented thereby include, e.g., methoxy, t-butoxy and dodecyloxy. They are preferably substituted or unsubstituted, straight-chain or branched alkoxy groups. Aromatic oxy groups represented thereby include, e.g., phenoxy and p-chlorophenoxy. They are preferably phenoxy and substituted phenoxy groups. Aliphatic acyloxy groups represented thereby include, e.g., acetoxy, myristoyloxy and isobutyroyloxy. They are preferably substituted or unsubstituted, straight-chain or branched alkylacyloxy groups. Aromatic acyloxy groups represented thereby include, e.g., benzoyloxy, p-chlorobenzoyloxy and naphthoyloxy. They are preferably benzoyloxy and substituted benzoyloxy groups. When these groups may be substituted, the substituents thereof can include those given as examples of substituents suitable for the substituted groups represented by $X^3$ in formula (1).

Further, a 5- to 8-membered ring (e.g., piperazine, morpholine, pyrrolidine) may be formed by combining $R_{a22}$ with $R_{a23}$, $R_{a21}$ with $R_{a24}$, or $R_{a26}$ with $R_{a27}$.

A nitrogen-containing heterocyclic ring formed by $Z_{a1}$, $Z_{a2}$, $X_{a1}$ and the nitrogen atom includes, e.g., piperazine, morpholine, thiomorpholine, pyrrolidine and homopiperazine, preferably those containing as ring-constituting atoms another hetero atom in addition to said nitrogen atom.

However, the 2,2,6,6-tetraalkylpiperidine ring is excluded from the nitrogen-containing heterocyclic rings formed by $Z_{a1}$, $Z_{a2}$, $X_{a1}$ and said nitrogen atom.

It is desirable in respect of effects achievable by the present invention that $R_{a1}$ should be $-C(=O)R_{a21}$, $-SO_2R_{a21}$, $-C(=O)N(R_{a21})(R_{a24})$ or $-SO_2N(R_{a21})(R_{a24})$.

Among the present compounds represented by the general formula (a-I), those represented by the following general formula (a-I') are preferred over others:

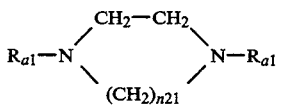

(a-I')

wherein $R_{a1}$ has the same meaning as in the general formula (a-I), and n21 represents an integer from 1 to 3.

In the group of compounds represented by the foregoing formula (a-I'), the cases in which $R_{a1}$ is —C(=O)-$R_{a21}$, —$SO_2R_{a21}$, —C(=O)N($R_{a21}$)($R_{a24}$) and —$SO_2$N-($R_{a21}$)($R_{a24}$), especially —C(=O)$R_{a21}$ and —$SO_2R_{a21}$, are preferred over others in respect of effects achievable by the present invention. Therein, it is desirable that n21 should be 2, $R_{a21}$ should represent a straight-chain or branched, substituted or unsubstituted alkyl group, phenyl group or a substituted phenyl group, and the number of carbon atoms contained in $R_{a21}$ should be as large as possible, especially at least 10.

The compounds represented by the general formula (a-I) in the present invention can be easily synthesized by producing amines in accordance with methods as described in JP-A-61-73152, JP-A-61-72246, JP-A-61-189539, JP-A-62-24255, JP-A-62-278550, JP-A-62-297847, JP-A-62-297848, JP-A-63-43146 and so on, and then by acylating or sulfonylating those amines.

The general formula (a-II) is described below in detail.

A divalent aliphatic group represented by $Z_{a3}$, which contains no more than 7 atoms and contributes to the connecting distance between $X_{a2}$ and $X_{a3}$, includes, e.g., ethylene, pentamethylene, propenylene and propylene, and it is preferably a straight-chain or branched, substituted or unsubstituted alkylene group, and more preferably

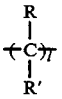

(wherein R and R' may be the same or different, each being a hydrogen atom or a substituent, and l represents an integer of from 1 to 5). When these groups may be substituted, the substituents thereof can include those given as examples of substituents suitable for the substituted groups represented by $X^3$ in formula (1).

As for the groups represented by $R_{a31}$ to $R_{a35}$, aliphatic groups include, for example, methyl, ethyl, i-propyl, t-butyl, cyclohexyl, benzyl, dodecyl, cyclohexenyl, allyl, vinyl, dodecyloxycarbonylethyl and butoxycarbonylethyl, but preferably straight-chain or branched, substituted or unsubstituted alkyl groups; aromatic groups include, for example, phenyl, naphthyl, 4-acetamidophenyl and 4-dodecyloxyphenyl, but preferably phenyl and substituted phenyl groups; aliphatic oxy groups include, for example, methoxy, butoxy, 2-ethylhexyloxy, benzyloxy, hexadecyloxy and cyclohexyl oxy, but preferably straight-chain or branched, substituted or unsubstituted alkoxy groups; aromatic oxy groups include, for example, phenoxy, naphthoxy, 4-methoxyphenoxy and 4-chlorophenoxy, but preferably phenoxy and substituted phenoxy groups; heterocyclic groups include, for example, 2-pyridyl, 2-piperidyl and 4-pyridyl; aliphatic amino groups include, for example, dimethylamino, butylamino, dodecylamino and 2-ethylhexylamino, and preferably amino groups a hydrogen of which is replaced by a straight-chain or branched, substituted or unsubstituted alkyl group; and aromatic amino groups include, e.g., N-phenylamino, N-phenyl-N-methylamino, N-phenyl-N-dodecylamino and N-4-chlorophenylamino, and preferably amino groups a hydrogen of which is replaced by a substituted or unsubstituted phenyl group. When these groups may be substituted, the substituents thereof can include those given as examples of substituents suitable for the substituted groups represented by $X^3$ in formula (1).

A 5- to 8-membered ring (e.g., piperidine, piperazine, pyrimidine) may be formed by combining $R_{a36}$ with $R_{a32}$, or $R_{a31}$ with $R_{a32}$, but 2,2,6,6-tetraalkylpiperidine rings are excluded therefrom.

When both $X_{a2}$ and $X_{a3}$ are —C(=O)N($R_{a31}$)($R_{a32}$) and $Z_{a3}$ is methylene or a monosubstituted methylene, the resulting compounds hinder the color formation of yellow dye-forming couplers present together therewith. Therefore, the cases in which both $X_{a2}$ and $X_{a3}$ are —C(=O)N($R_{a31}$)($R_{a32}$) and $Z_{a3}$ is methylene or a monosubstituted methylene are excluded. $Z_{a3}$ is preferably a single bond.

In the groups of compounds represented by the general formula (a-II) in the present invention, those represented by the following general formulae (a-II') and (a-II'') are preferred over others in respect of effects achievable by the present invention.

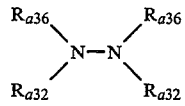

(a-II')

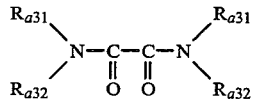

(a-II'')

In the above formulae, $R_{a31}$, $R_{a32}$ and $R_{a36}$ have the same meanings as in the general formula (a-II), respectively.

Among the compounds represented by the general formula (a-II') of the present invention, those containing as $R_{a36}$ —C(=O)$R_{a34}$ or —$SO_2R_{a34}$ and as $R_{a32}$ a hydrogen atom, an aliphatic group, an aromatic group or —C(=O)$R_{a34}$ are particularly preferred over others in respect of effects achievable by the present invention.

Among the compounds represented by the general formula (a-II'') of the present invention, those containing an aliphatic group, an aromatic group, —C(=O)-$R_{a34}$ or —$SO_2R_{a34}$ as $R_{a31}$ and a hydrogen atom, an aliphatic group or an aromatic group as $R_{a32}$ are particularly preferred over others in respect of effects achievable by the present invention.

The compounds represented by the general formula (a-II) in the present invention can be synthesized according to methods as described in *Shin Jikken Kagaku Koza* (which means "new lectures on experimental chemistry"), volume 14-II, pages 1134–1189, Maruzen, Tokyo (1977), JP-A-02-181145, *J. Am. Chem. Soc.*, volume 72, page 2762 (1950), *Org. Synth.*, volume II, page 395 (1943), *Shin Jikken Kagaku Koza*, volume 14-III, page 1573 (1978), JP-A-62-270954, JP-A-63-43145, European Patent 255,722, and so on.

The general formula (a-III) is described below in detail.

In a description of the general formula (a-III), the term aliphatic group includes, for example, methyl, ethyl, i-butyl, t-butyl, dodecyl, benzyl, cyclohexyl, cyclohexenyl, allyl, vinyl, ethoxycarbonylethyl and methanesulfonylethyl, but preferably straight-chain or branched, substituted or unsubstituted alkyl groups. The term aromatic group used therein includes, for example, phenyl, 4-chlorophenyl, 4-methoxyphenyl and naphthyl, but preferably phenyl and substituted phenyl groups. The term aliphatic oxy group used therein includes for example, methoxy, butoxy, 2-ethylhexyloxy, benzyloxy, hexadecyloxy and cyclohexyloxy, but preferably straight-chain or branched, substituted or unsubstituted alkoxy groups. The term aromatic oxy group used therein includes, for example, phenoxy, naphthoxy, 4-methoxyphenoxy and 4-chlorophenoxy, but preferably phenoxy and substituted phenoxy groups. The term aliphatic amino group used therein includes, for example, dimethylamino, butylamino, dodecylamino and 2-ethylhexylamino, and preferably amino groups a hydrogen of which is replaced by a straight-chain or branched, substituted or unsubstituted alkyl group. The term aromatic amino group used therein includes, for example, N-phenylamino, N-phenyl-N-methylamino, N-phenyl-N-dodecylamino and N-4-chlorophenylamino, and preferably amino groups a hydrogen of which is replaced by a substituted or unsubstituted phenyl group. The term heterocyclic group used therein includes, for example, 2-pyridyl, 2-piperidyl and 4-pyridyl. When these groups may be substituted, the substituents thereof can include those given as examples of substituents suitable for the substituted groups represented by $X^3$ in formula (1).

$R_{a2}$ and $R_{a3}$ may form a 5- to 8-membered ring (e.g., piperidine, piperazine, pyrimidine) by combining with each other, but a 2,2,6,6-tetraalkylpiperidine ring is excluded from the ring they form.

Among the compounds represented by the general formula (a-III), those in which $Z_{a4}$ is —O— are preferred over others in respect of effects achievable by the present invention.

Among the compounds represented by the general formula (a-III), those in which $R_{a2}$ is an alkyl group, $—C(=O)R_{a41}$ or $—SO_2R_{a41}$ and $R_{a3}$ is $—C(=O)R_{a41}$ or $—SO_2R_{a41}$ are preferred, and those in which $R_{a2}$ is an alkyl group or $—C(=O)R_{a41}$ are more preferred, in respect of effects achievable by the present invention.

Among the compounds represented by the general formula (a-III), those in which $R_{a4}$ is an alkyl group, $—C(=O)R_{a43}$ or $—SO_2R_{a43}$ are preferred in respect of effects achievable by the present invention.

These compounds represented by the general formula (a-III) in the present invention can be synthesized using the methods described in *Shin Jikken Kagaku Koza*, volume 14, pages 1585 to 1594, Maruzen, Tokyo (1977) or methods based thereon.

The general formula (a-IV) is described below in detail.

In a description of the general formula (a-IV), the term aliphatic group includes, for example, methyl, ethyl, i-butyl, t-butyl, dodecyl, benzyl, cyclohexyl, cyclohexenyl, allyl, vinyl, ethoxycarbonylethyl and methanesulfonylethyl, but preferably straight-chain or branched, substituted or unsubstituted alkyl groups. The term aromatic group used therein includes, for example, phenyl, 4-chlorophenyl, 4-methoxyphenyl and naphthyl, but preferably phenyl and substituted phenyl groups. The term aliphatic oxy group used therein includes, for example, methoxy, butoxy, 2-ethylhexyloxy, benzyloxy, hexadecyloxy and cyclohexyloxy, but preferably straight-chain or branched, substituted or unsubstituted alkoxy groups. The term aromatic oxy group used therein includes, for example, phenoxy, naphthoxy, 4-methoxyphenoxy and 4-chlorophenoxy, but preferably phenoxy and substituted phenoxy groups. The term aliphatic amino group used therein includes, for example, dimethylamino, butylamino, dodecylamino and 2-ethylhexylamino, and preferably amino groups a hydrogen of which is replaced by a straight-chain or branched, substituted or unsubstituted alkyl group. The term aromatic amino group used therein include, for example, N-phenylamino, N-phenyl-N-methylamino, N-phenyl-N-dodecylamino and N-4-chlorophenylamino, and preferably amino groups a hydrogen of which is replaced by a substituted or unsubstituted phenyl group. The term heterocyclic group used therein includes, for example, 2-pyridyl, 2-piperidyl and 4-pyridyl. When these groups may be substituted, the substituents thereof can include those given as examples of substituents suitable for the substituted groups represented by $X^3$ in formula (1).

A 5- to 8-membered ring formed by combining $R_{a2}$ and $R_{a3}$ includes, e.g., pyrrolidine-2-one and piperidine-2-one.

Among the compounds represented by the general formula (a-IV), those in which n1 is 2 or 3 are preferred over others in respect of effects achievable by the present invention.

Among the compounds represented by the general formula (a-IV), those in which $R_{a5}$ is $—C(=O)R_{a51}$ are preferred, those in which $R_{a6}$ is a hydrogen atom, an alkyl group or $—C(=O)R_{a51}$ in addition to $R_{a5}=—C(=O)R_{a51}$ are more preferred, and those in which $R_{a6}$ is an alkyl group or $—C(=O)R_{a51}$ in addition to $R_{a5}=—C(=O)R_{a51}$ are most preferred in respect of effects achievable by the present invention.

The compounds represented by the general formula (a-IV) in the present invention can be synthesized using the methods described in JP-A-63-95444, JP-A-63-115866, *Helv. Chem. Acta.*, volume 35, page 75 (1953), *Shin Jikken Kagaku Koza*, volume 14, page 1220, Maruzen, Tokyo (1977), and so on, or methods based thereon.

The general formula (a-V) is described below in detail.

In a description of the general formula (a-V), the term aliphatic group includes, for example, methyl, ethyl, i-butyl, t-butyl, dodecyl, benzyl, cyclohexyl, cyclohexenyl, allyl, vinyl, ethoxycarbonylethyl and methanesulfonylethyl, but preferably straight-chain or branched, substituted or unsubstituted alkyl groups. The term aromatic group used therein includes, for example, phenyl, 4-chlorophenyl, 4-methoxyphenyl and naphthyl, but preferably phenyl and substituted phenyl groups. The term aliphatic oxy group used therein includes, for example, methoxy, butoxy, 2-ethylhexyloxy, benzyloxy, hexadecyloxy and cyclohexyloxy, but preferably straight-chain or branched, substituted or unsubstituted alkoxy groups. The term aromatic oxy group used therein includes, for example, phenoxy, naphthoxy, 4-methoxyphenoxy and 4-chlorophenoxy, but preferably phenoxy and substituted phenoxy groups. The term aliphatic amino group used therein includes, for example, dimethylamino, butylamino, dodecylamino and 2-ethylhexylamino, and preferably amino groups a hydrogen of which is replaced by a straight-chain or branched, substituted or unsubstituted alkyl group. The term aromatic amino group used therein include, for example, N-phenylamino, N-phenyl-N-methylamino, N-phenyl-N-dodecylamino and N-4-chlorophenylamino, and preferably amino groups a hydrogen of which is replaced by a substituted or unsubstituted phenyl group. The term heterocyclic group used therein includes, for example, 2-pyridyl, 2-piperidyl and 4-pyridyl. When these groups may be substituted, the substituents thereof can include those given as examples of substituents suitable for the substituted groups represented by $X^3$ in formula (1).

A 5- to 8-membered heterocyclic ring formed by $Z_{a5}$ and the two nitrogen atoms includes, for example, pyrazolidine and pyrazoline.

Among the compounds represented by the general formula (a-V) of the present invention, those in which at least either of the two nitrogen atoms binds to —CO— or —$SO_2$— are preferred in respect of effects achievable by the present invention.

More specifically, compounds represented by the general formulae (a-V′) and (a-V″) are preferred over others in a group of the compounds represented by the general formula (a-V):

(a-V′)

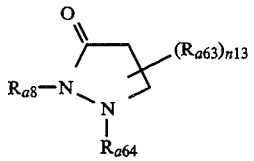

(a-V″)

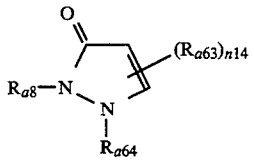

wherein $R_{a8}$ has the same meaning as in the general formula (a-V); $R_{a63}$ represents —C(=O)$R_{a61}$, a straight-chain or branched, substituted or unsubstituted alkyl group, or a substituted or unsubstituted phenyl group; $R_{a64}$ represents a substituted or unsubstituted phenyl group; n13 represents 0 or an integer from 1 to 4; n14 represents 0, 1 or 2; $R_{a61}$ has the same meaning as in the general formula (a-V); and when n13 and n14 each represent 2 or more, $R_{a63}$'s may be the same or different.

Among the compounds represented by the foregoing general formulae (a-V′) and (a-V″), those containing as $R_{a6}$ an alkyl group, —C(=O)$R_{a61}$ or —$SO_2R_{a61}$, preferably an alkyl group or —C(=O)$R_{a61}$, more preferably an alkyl group, are of greater advantage in respect of effects achievable by the present invention.

Additionally, as for the compounds represented by the general formula (a-V′), those in which n13 is 0, 1, 2 and 3 respectively are preferred over others in respect of effects achievable by the present invention.

The compounds represented by the general formula (a-V) in the present invention can be synthesized using methods as described in *Shin Jikken Kagaku Koza*, volume 14-II, pages 1134–1220, Maruzen, Tokyo (1977), *J. Org. Chem.*, volume 21, page 667 (1955) and so on, or methods based thereon.

The general formula (a-VI) is described below in detail.

In a description of the general formula (a-VI), the term aliphatic group includes, for example, methyl, ethyl, i-butyl, t-butyl, dodecyl, benzyl, cyclohexyl, cyclohexenyl, allyl, vinyl, ethoxycarbonylethyl and methanesulfonylethyl, but preferably straight-chain or branched, substituted or unsubstituted alkyl groups. The term aromatic group used therein includes, for example, phenyl, 4-chlorophenyl, 4-methoxyphenyl and naphthyl, but preferably phenyl and substituted phenyl groups. When these groups may be substituted, the substituents thereof can include those given as examples of substituents suitable for the substituted groups represented by $X^3$ in formula (1).

In a group of the compounds represented by the general formula (a-VI), those represented by the following general formula (a-VI-1), (a-VI-2), (a-VI-3) and (a-VI-4) respectively are preferred over others in respect of effects achievable by the present invention.

(a-VI-1)

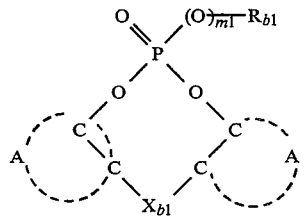

(a-VI-2)

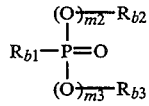

(a-VI-3)

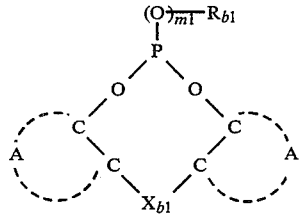

(a-VI-4)

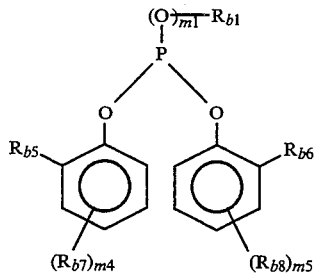

In the foregoing general formula (a-VI-1), $R_{b1}$ and ml have the same meanings as in the general formula (a-VI) respectively, A represents atoms completing a substituted or unsubstituted benzene ring, $X_{b1}$ represents a single bond, a substituted or unsubstituted methylene group, —S—, —O—, —CO—, —N($R_{b9}$)—, —$SO_2$— or —SO—, and $R_{b9}$ represents a hydrogen atom, an aliphatic group or an aromatic group.

Substituents present on the benzene ring completed by A may be any of groups which can be substituted for the hydrogens of benzene, with examples including $C_{1-40}$ aliphatic groups, $C_{6-56}$ aromatic groups, $C_{1-50}$ heterocyclic groups, $C_{2-42}$ acyl groups, $C_{2-42}$ acyloxy groups, $C_{2-42}$ acylamino groups, $C_{1-40}$ aliphatic oxy groups, $C_{6-56}$ aromatic oxy groups, $C_{1-50}$ heterocyclic oxy groups, $C_{2-42}$ aliphatic oxycarbonyl groups, $C_{7-57}$ aromatic oxycarbonyl groups, $C_{2-52}$ heterocyclic oxycarbonyl groups, $C_{2-52}$ aliphatic carbamoyl groups, $C_{7-57}$ aromatic carbonyl groups, $C_{1-40}$ aliphatic sulfonyl groups, $C_{6-56}$ aromatic sulfonyl groups, $C_{1-40}$ aliphatic sulfamoyl groups, $C_{6-56}$ aromatic sulfamoyl groups, $C_{1-40}$ aliphatic sulfonamido groups, $C_{6-56}$ aromatic sulfonamido groups, $C_{1-40}$ aliphatic amino groups, $C_{6-56}$ aromatic amino groups, $C_{1-40}$ aliphatic sulfinyl groups, $C_{6-56}$ aromatic sulfinyl groups, $C_{1-40}$ aliphatic thio groups, $C_{6-56}$ aromatic thio groups, a cyano group, a nitro group, hydroxylamino groups, halogen atoms, and so on.

Among the above-cited groups, aliphatic groups and acylamino groups, especially alkyl groups, are preferred over others as such substituents.

As for the substituted methylene group represented by $X_{b1}$, its substituent is an aliphatic group, preferably an optionally substituted alkyl group.

The linkage groups preferred as $X_{b1}$ are a single bond, a substituted or unsubstituted methylene group, —S— and —O—, especially a single bond and a substituted or unsubstituted methylene group, in respect of effects which the present invention can accomplish.

It is desirable in respect of effects of the present invention that $R_{b1}$ should be an alkyl group, phenyl group or a substituted phenyl group, preferably a substituted or unsubstituted phenyl group. In these cases, m1=0 is the best.

In the general formula (a-VI-2), $R_{b1}$, $R_{b2}$, $R_{b3}$, m2 and m3 have the same meanings as in the general formula (a-VI), respectively.

In respect of effects of the present invention, the case of m2=m3=1 is preferred over others. Therein, $R_{b2}$ and $R_{b3}$ each are preferably an alkyl group or an aromatic group, especially a substituted or unsubstituted phenyl group.

As for the group represented by $R_{b1}$, an alkyl group, phenyl group or a substituted phenyl group, preferably a substituted or unsubstituted phenyl group, is desirable.

In the general formula (a-VI-3), $R_{b1}$, m1 and m2 have the same meanings as in the general formula (a-VI) respectively, while A and $X_{b1}$ have the same meanings as in the general formula (a-VI-1) respectively.

In respect of effects of the present invention, the case in which $R_{b1}$ is an alkyl group, phenyl group or a substituted phenyl group is preferred. In a more preferred case, m1 is 0 and $R_{b1}$ is a substituted or unsubstituted phenyl group. Desirable scopes of A and $X_{b1}$ are the same as in the general formula (a-VI-1).

In the general formula (a-VI-4), $R_{b1}$ and m1 have the same meanings as in the general formula (a-VI). $R_{b5}$, $R_{b6}$, $R_{b7}$ and $R_{b8}$ each represent a hydrogen atom or a substituent, and m4 and m5 each represent 0 or an integer from 1 to 3.

In respect of effects of the present invention, $R_{b1}$ is preferably an alkyl group, phenyl group or a substituted phenyl group, $R_{b5}$ and $R_{b6}$ each are a bulky substituent, such as a tert-alkyl group, a sec-alkyl group or a group containing no less than 6 carbon atoms and preferably not more than 50, and particularly preferably a tert-alkyl group.

Among the compounds represented by the general formula (a-VI), those represented by the general formulae (a-VI-1), (a-VI-2) and (a-VI-4) respectively, especially those represented by the general formulae (a-VI-2) and (a-VI-4), are preferred over others.

The compounds represented by the general formula (a-VI) can be synthesized using methods as described in JP-A-63-113536, JP-A-63-256952, JP-A-61-137150, JP-A-02-12146, JP-B-63-19518, JP-A-03-25437 and so on, or methods based thereon.

The compounds represented by the general formula (a-VII) are explained in detailed below.

The aliphatic groups represented by any of $R_{c1}$ to $R_{c3}$ in formula (a-VII) represent methyl, ethyl, i-propyl, t-butyl, cycloxyl, benzyl, decyl, cyclohexenyl, allyl, vinyl, dodecyl, oxycarbonylethyl, and butoxy carbonylethyl, and preferably straight-chain or branched, substituted or unsubstituted alkyl group having 1 to 50 carbon atoms, $R_{c1}$ and $R_{c2}$, and $R_{c3}$ and $R_{c4}$ may combine to form 5- to 8-membered ring, and may also combine through or without any of an oxygen atom, a sulfur atom, and a nitrogen atom. Said 5- to 8-membered ring includes a piperidine, a marpholine, and a pyrrolidine ring.

The aliphatic groups represented by $R_{c4}$ include, for example, a hexyl, octyl and 2,4-dipentylphenoxyethyl, and preferably straight-chain, or branched, and substituted or unsubstituted alkyl group having 8 to 30 carbon atoms. The substituents of $R_{c1}$ to $R_{c4}$ can include those given as examples of substituents suitable for the substituted groups represented by $X^3$ in formula (1).

Among the above-described compounds to be used in combination with the yellow dye-forming couplers represented by the general formula (1) of the present invention, those represented by the general formulae (a-I), (a-II), (a-IV), (a-V), (a-VI) and (a-VII) respectively are preferred, those represented by the general formulae (a-I′), (a-II′), (a-II″) and (a-V′) respectively are more preferred, and those represented by the general formulae (a-I′), (a-II′) and (a-V′) respectively are most preferred over others in respect of effects which the present invention can accomplish.

The present compounds represented by the general formula (a-I), (a-II), (a-III), (a-IV), (a-V), (a-VI) or (a-VII) may be used together with known discoloration inhibitors. Such a combined use can produce a greater effect on the inhibition of discoloration. Also, two or more of the present compounds represented by the general formula (a-I), (a-II), (a-III), (a-IV), (a-V), (a-VI) or (a-VII) may be used together.

It is appropriate to use the present compounds represented by the general formula (a-I), (a-II), (a-III), (a-IV), (a-V), (a-VI) or (a-VII) in a proportion of 0.5 to 300 mol %, preferably 1 to 200 mol %, to the coupler used in combination therewith, though the proportion depends on the kind of the coupler used.

It is to be desired that the present compounds of the general formulae from (a-I) to (a-VII) should be incorporated in the same layer(s) as the present yellow dye-forming coupler(s) of the general formula (1).

Now, specific examples of the present compounds represented by the general formulae (a-I), (a-II), (a-III), (a-IV), (a-V), (a-VI) and (a-VII) respectively are illustrated below. However, the invention should not be construed as being limited to these compounds.

A-1

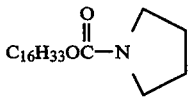

A-2

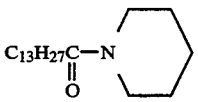

-continued
A-3
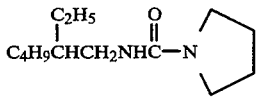
A-4
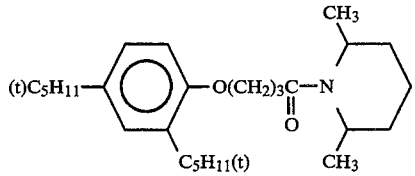
A-5
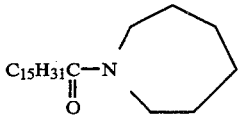
A-6
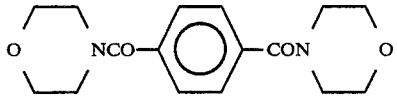
A-7
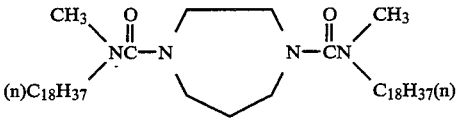
A-8
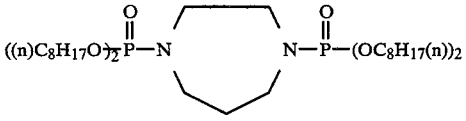
A-9
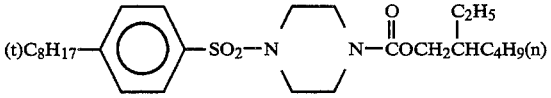
A-10
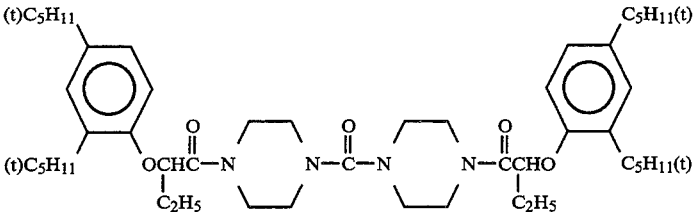
A-11
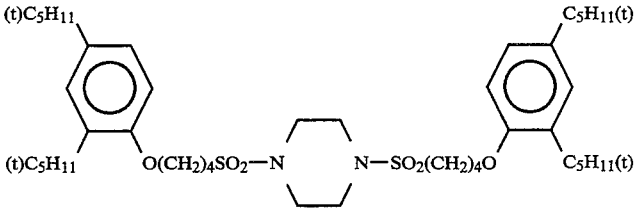
A-12
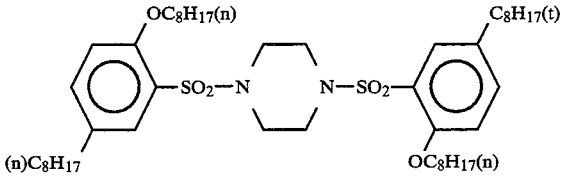
A-13
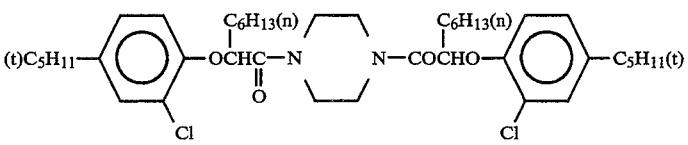
A-14
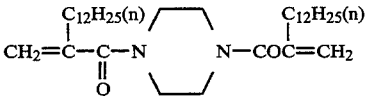
A-15
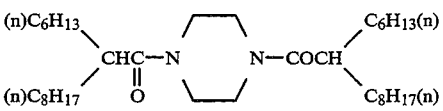
A-16
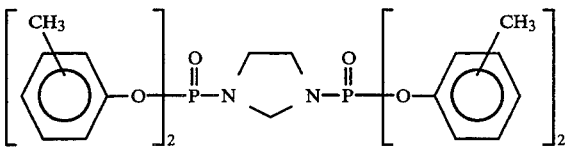

-continued
A-17
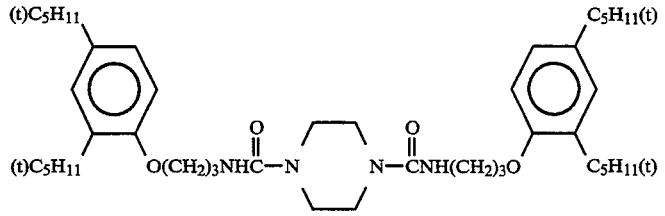
A-18
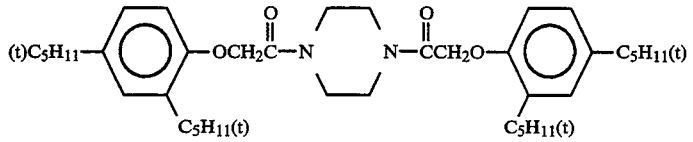
A-19
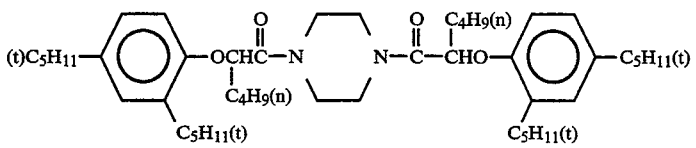
A-20
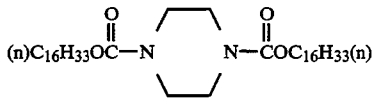
A-21
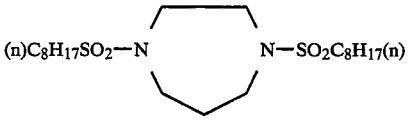
A-22
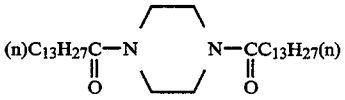
A-23
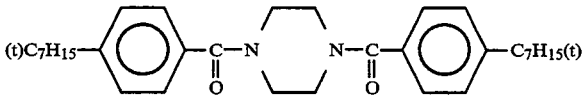
A-24
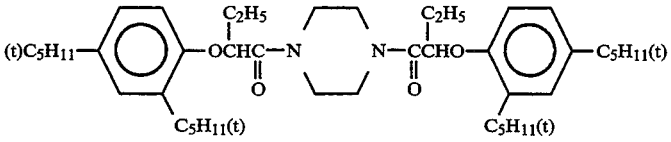
A-25
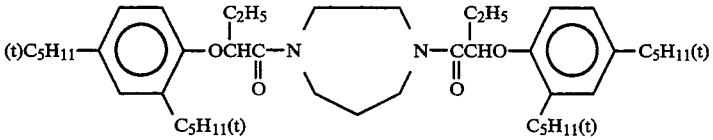
A-26
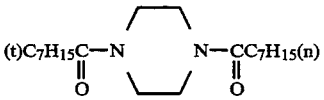
A-27
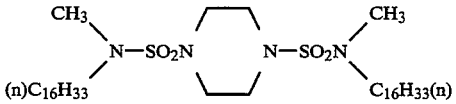
A-28
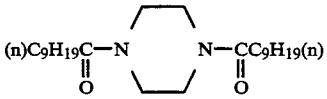
A-29
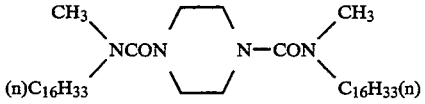
A-30
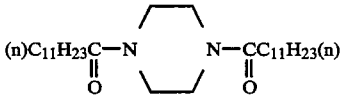
A-31
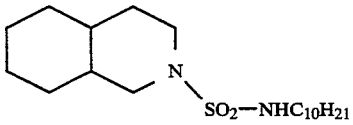

-continued
A-32
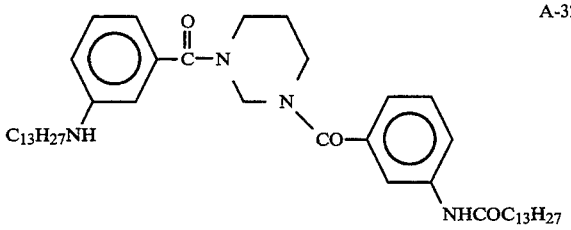
A-33
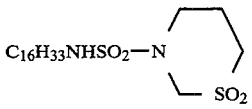
A-34
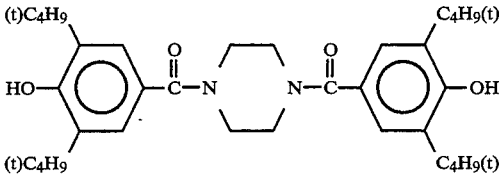
A-35
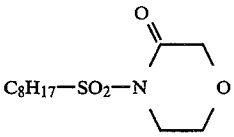
A-36
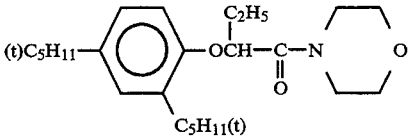
A-37
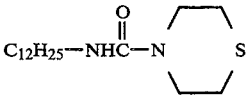
A-38
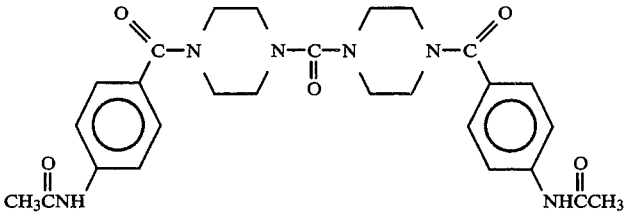
A-39
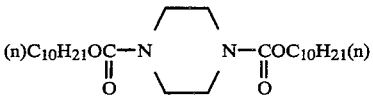
A-40
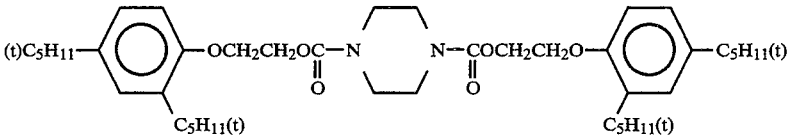
A-41
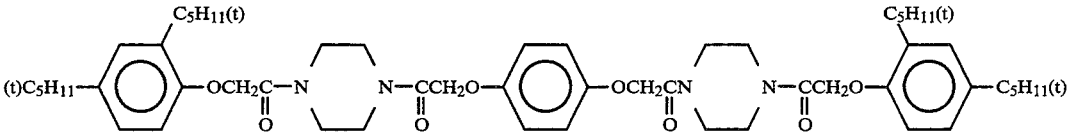
A-42
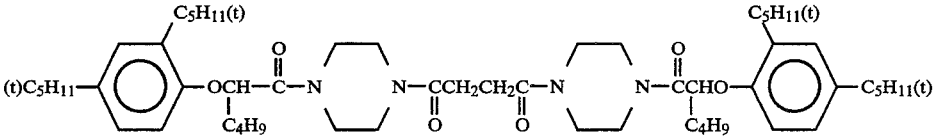

-continued
A-43
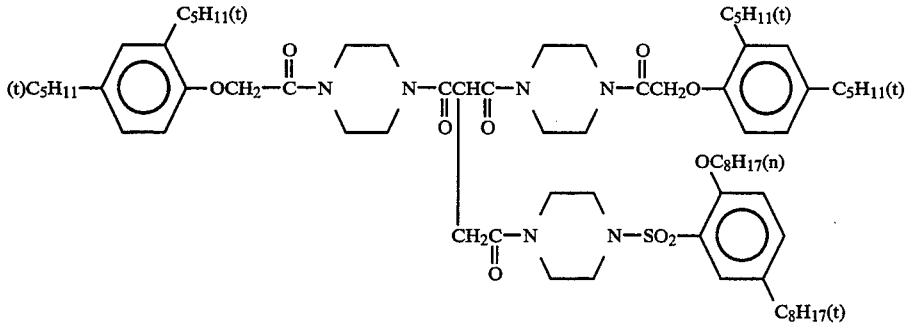
B-1
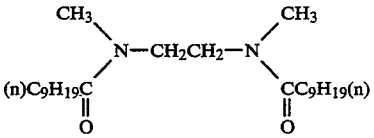
B-2
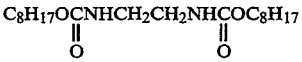
B-3
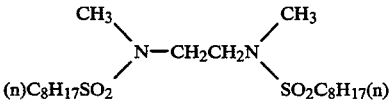
B-4
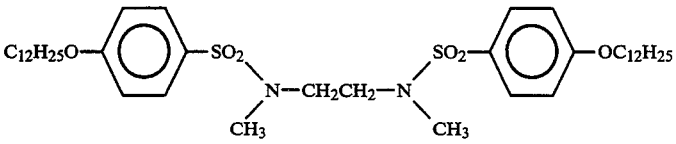
B-5
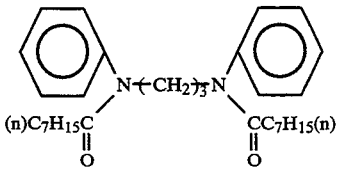
B-6
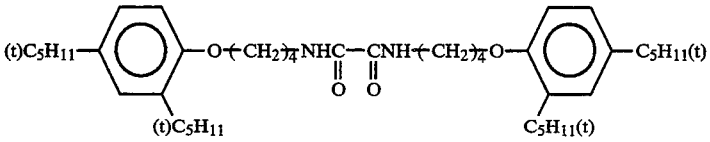
B-7
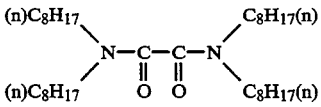
B-8
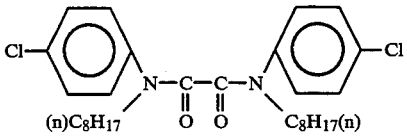
B-9
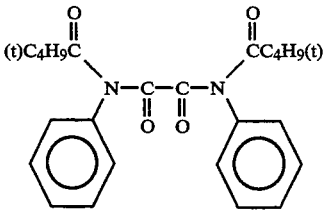
B-10
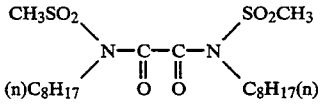
B-11
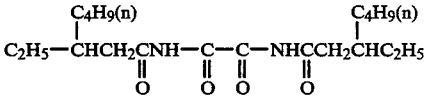
B-12
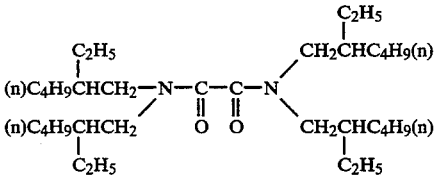

-continued
B-13
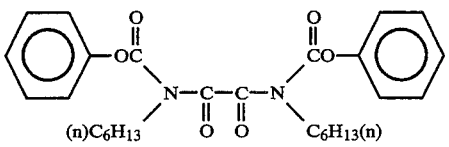
B-14
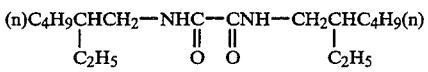
B-15
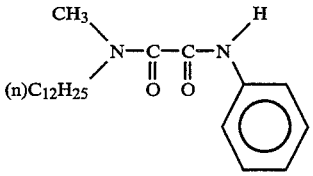
B-16
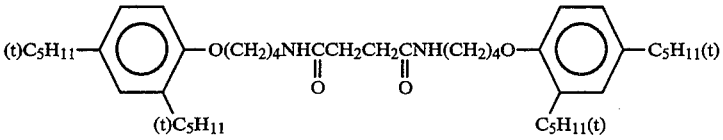
B-17
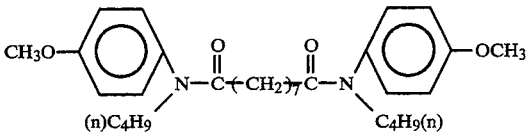
B-18
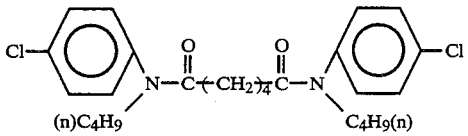
B-19
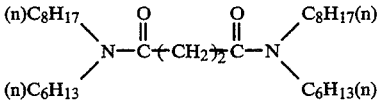
B-20
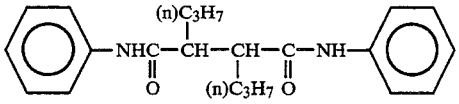
B-21
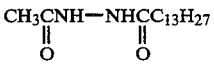
B-22
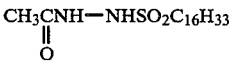
B-23
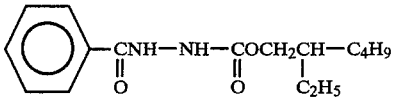
B-24
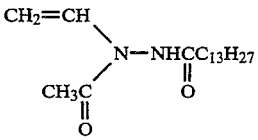
B-25
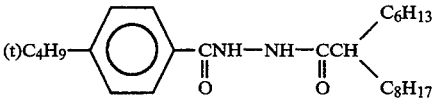
B-26
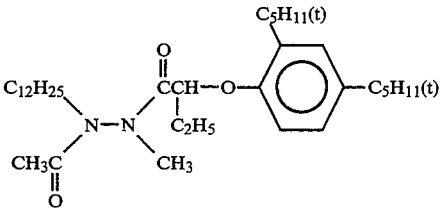
B-27
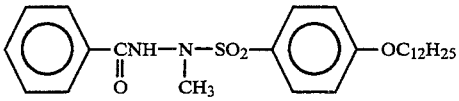
B-28
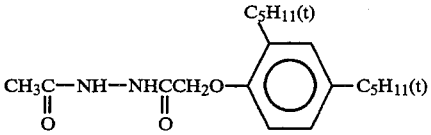
B-29
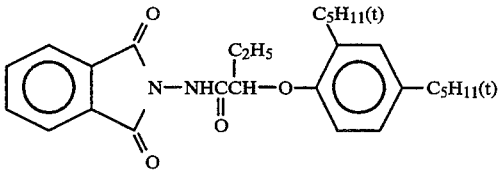

-continued
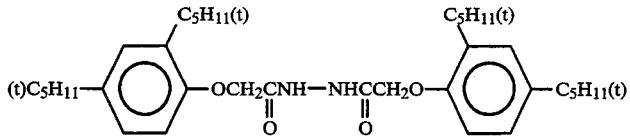
B-30
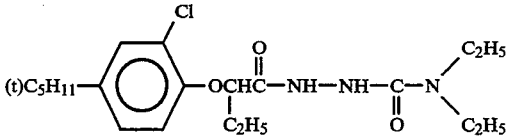
B-31
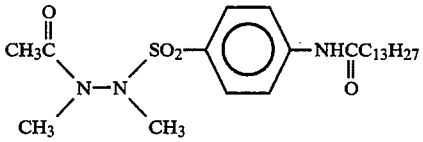
B-32
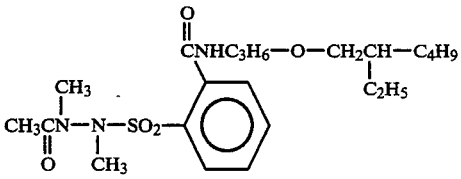
B-33
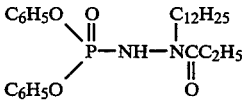
B-34
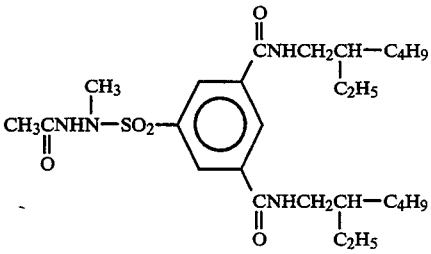
B-35
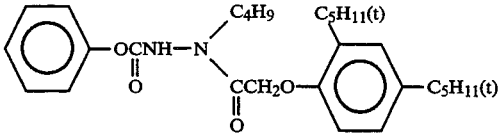
B-36
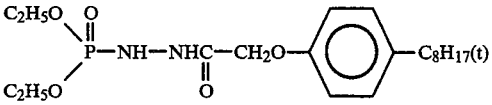
B-37
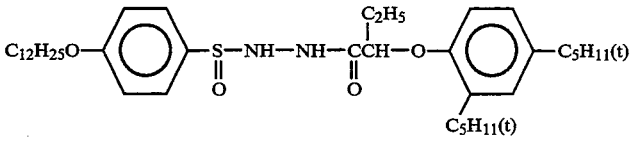
B-38
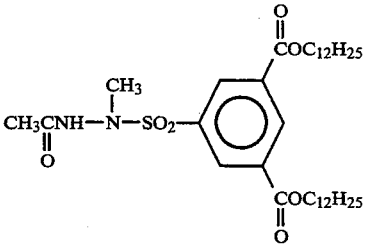
B-39
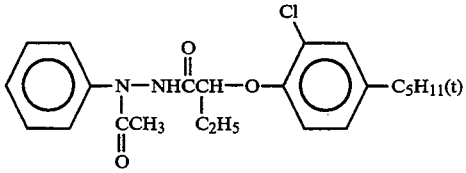
B-40
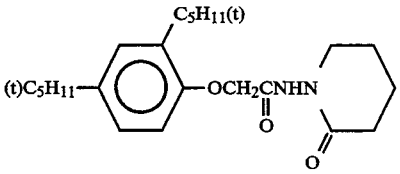
B-41
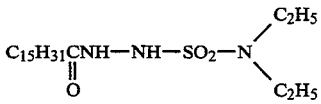
B-42
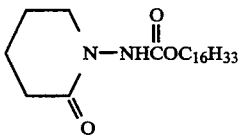
B-43
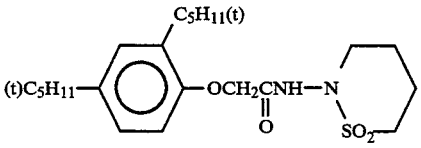
B-44

-continued
B-45
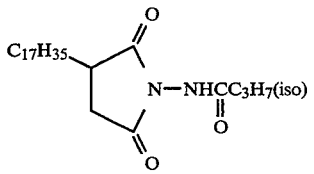
E-1
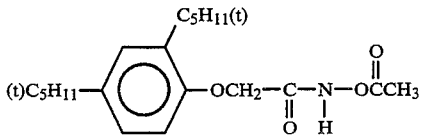
E-2
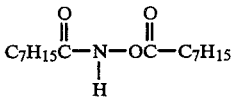
E-3
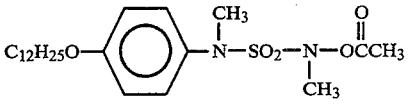
E-4
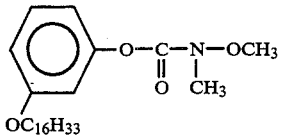
E-5
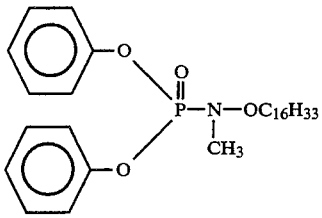
E-6
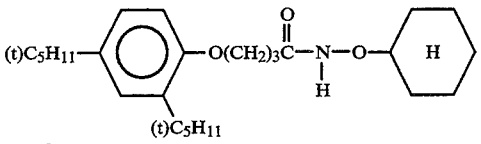
E-7
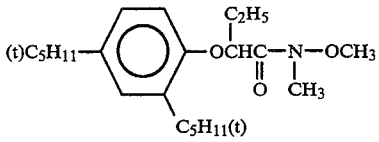
E-8
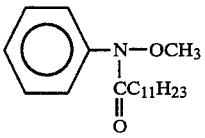
E-9
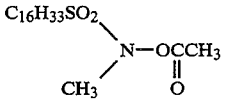
E-10
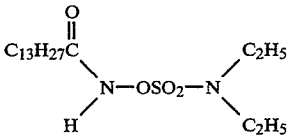
E-11
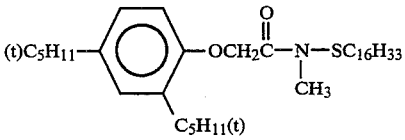
E-12
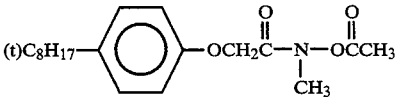
E-13
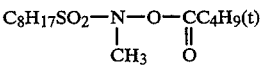
E-14
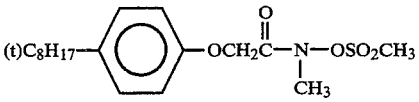
E-15
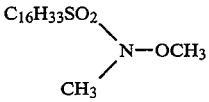
E-16
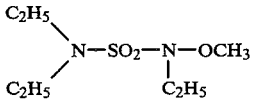
E-17
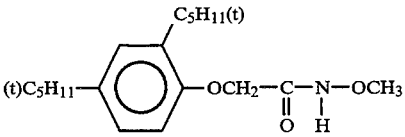
E-18
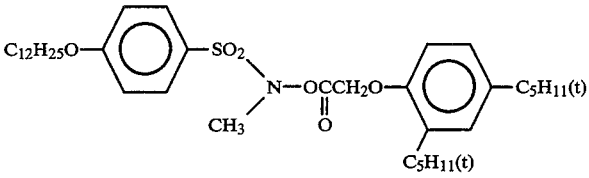

-continued
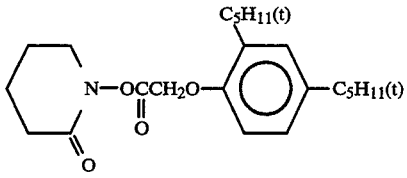
E-19
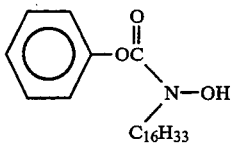
E-20
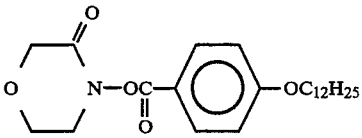
E-21
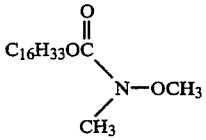
E-22
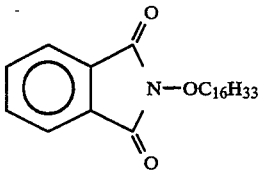
E-23
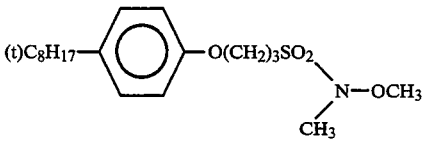
E-24
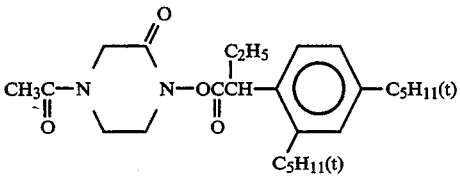
E-25
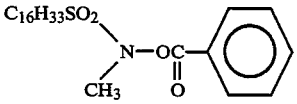
E-26
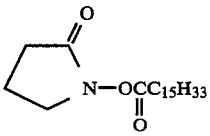
E-27
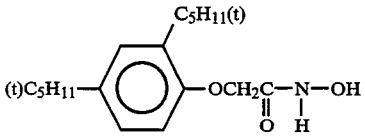
E-28
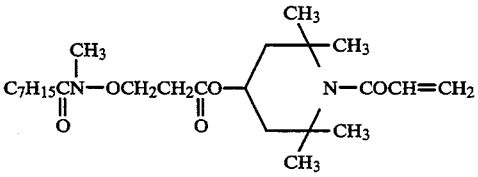
E-29
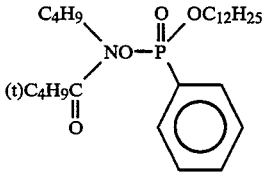
E-30
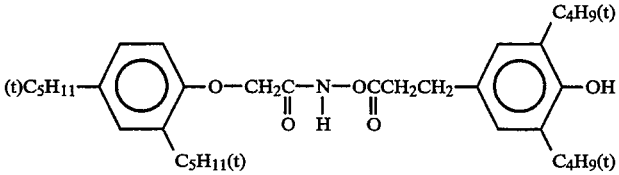
E-31
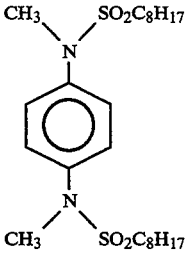
F-1
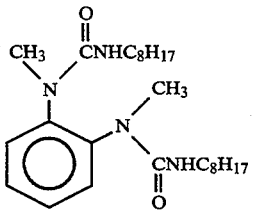
F-2

-continued
F-3
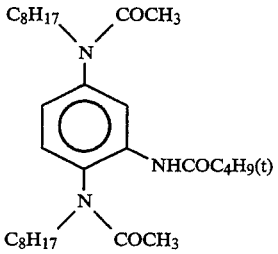
F-4
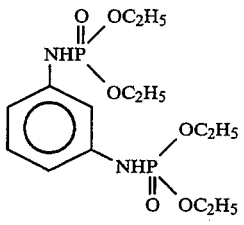
F-5
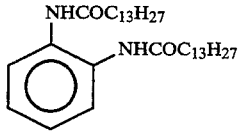
F-6
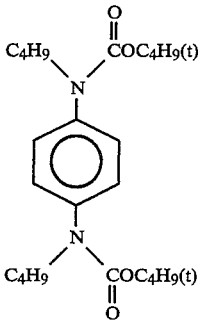
F-7
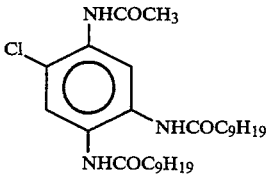
F-8
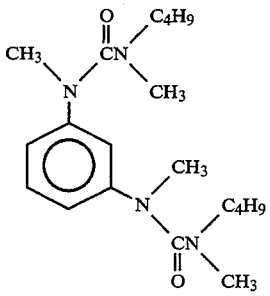
F-9
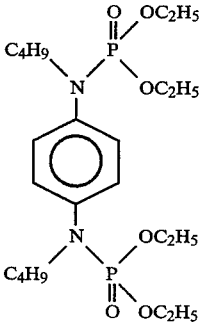
F-10
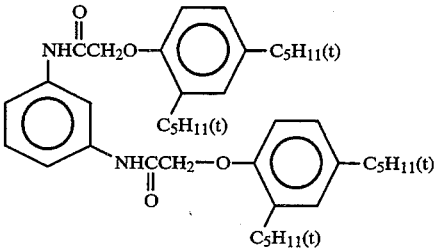
F-11
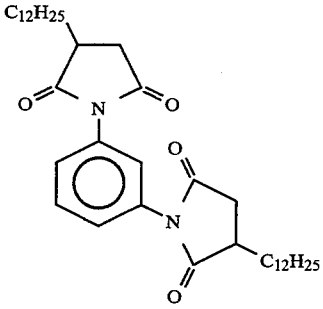
F-12
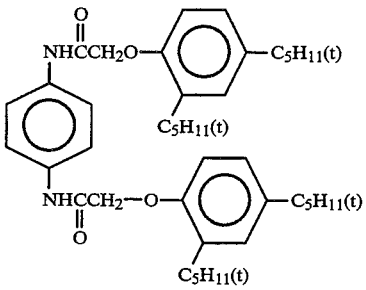

-continued
F-13
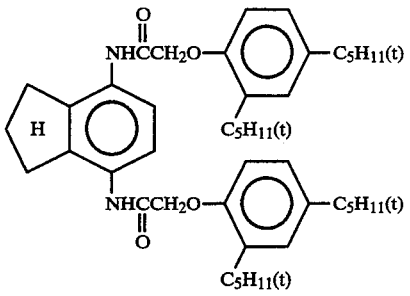
F-14
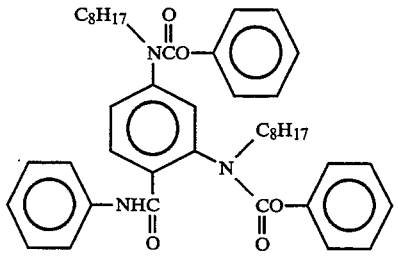
F-15
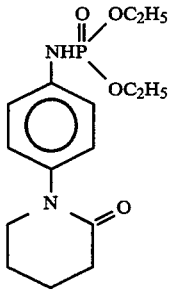
F-16
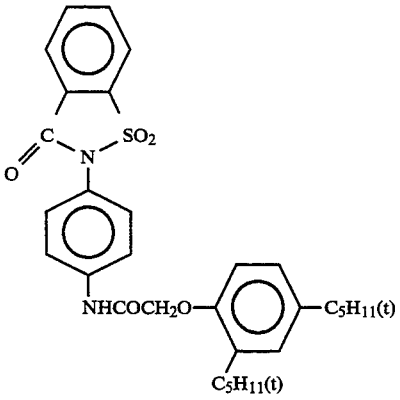
F-17
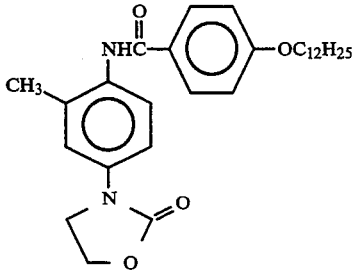
F-18
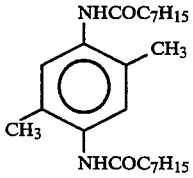
F-19
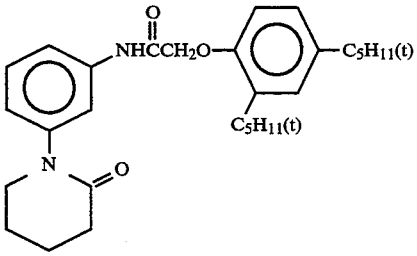
F-20
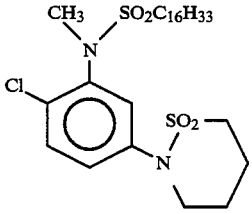
F-21
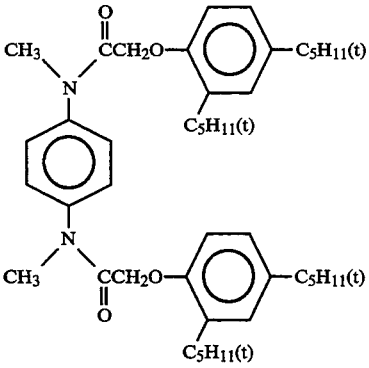
G-1
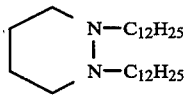

-continued
G-2
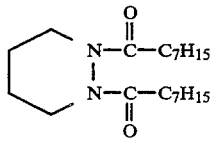
G-3
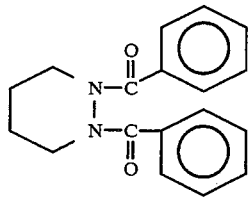
G-4
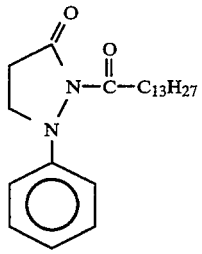
G-5
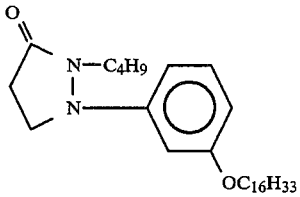
G-6
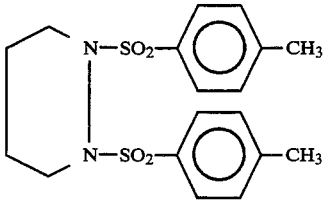
G-7
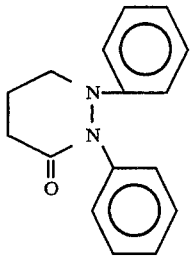
G-8
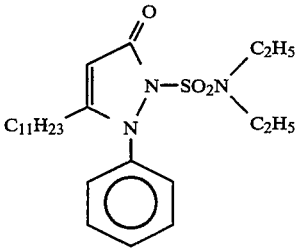
G-9
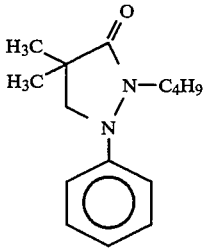
G-10
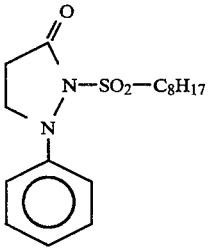
G-11
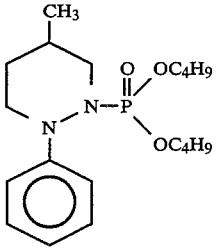
G-12
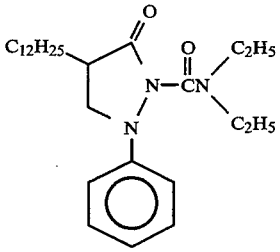
G-13
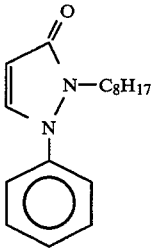

-continued
G-14
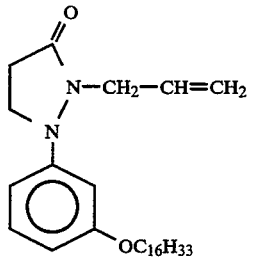
G-15
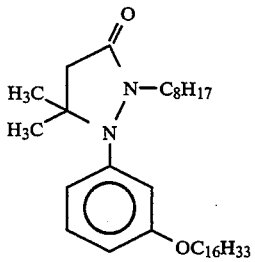
G-16
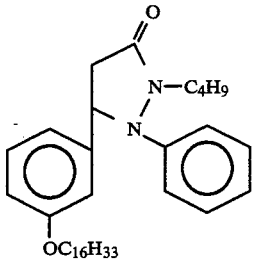
G-17
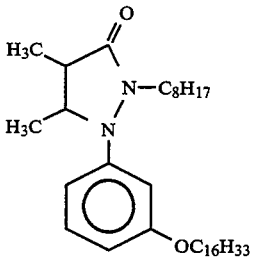
G-18
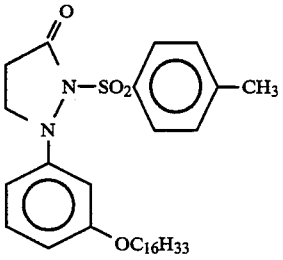
G-19
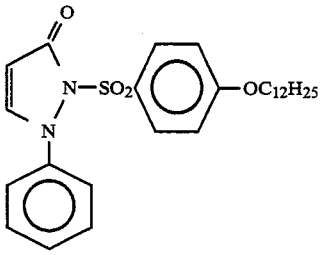
G-20
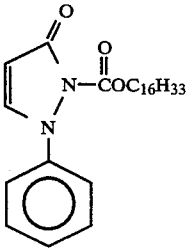
G-21
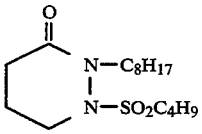
G-22
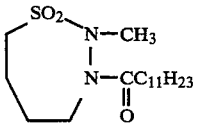
G-23
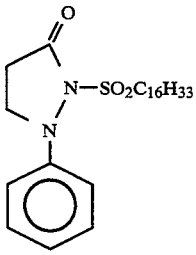
G-24
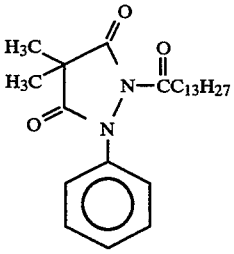
G-25
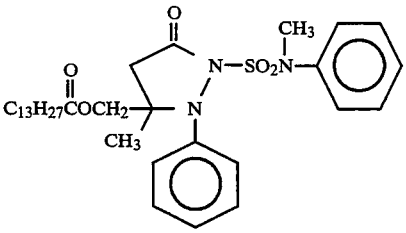

-continued
G-26
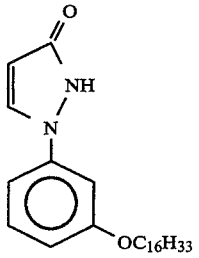
G-27
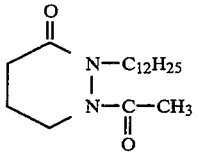
G-28
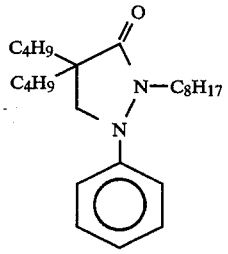
G-29
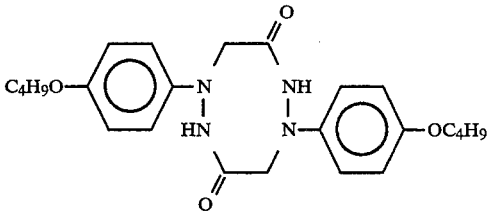
G-30
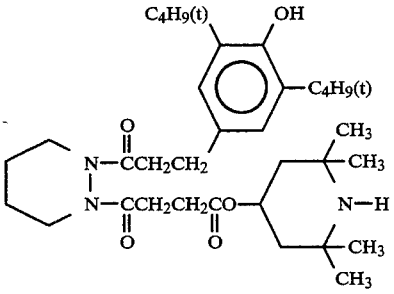
H-1
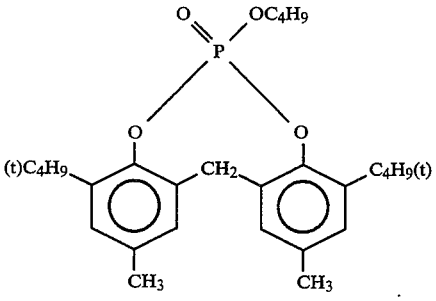
H-2
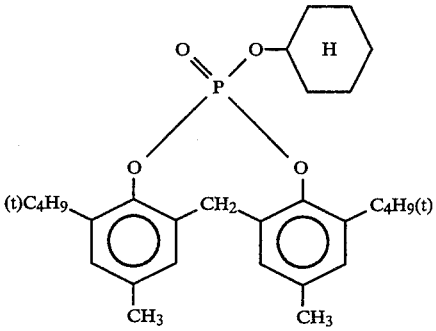
H-3
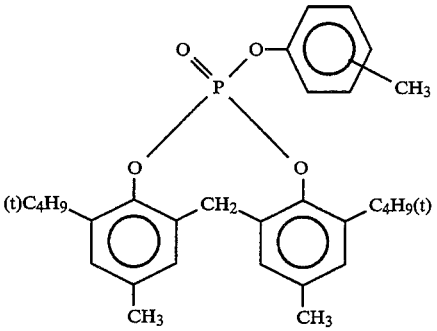
H-4
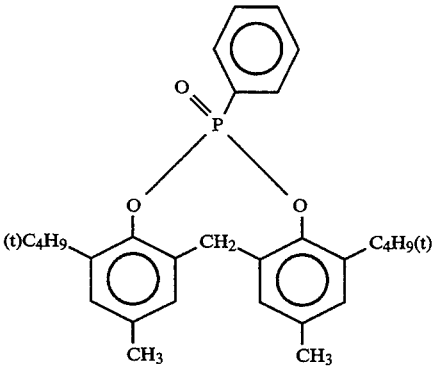
H-5
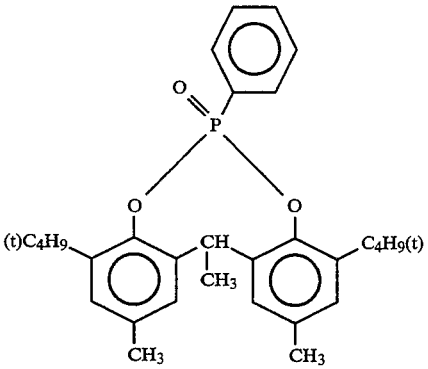

-continued
H-6
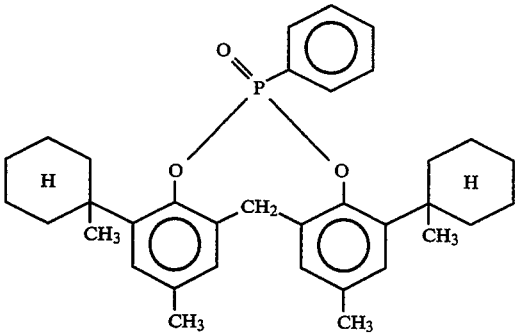
H-7
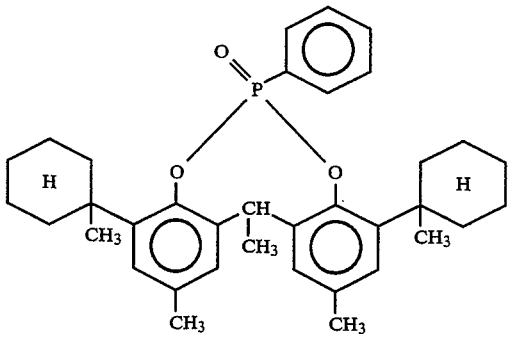
H-8
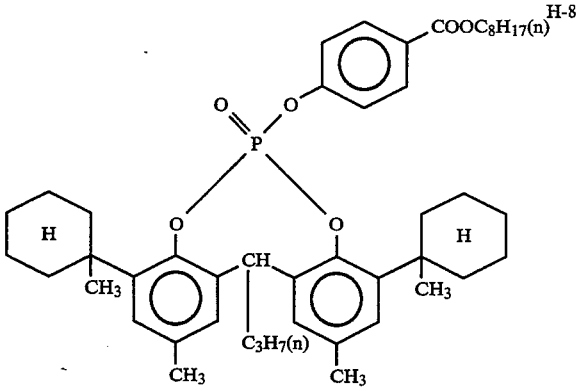
H-9
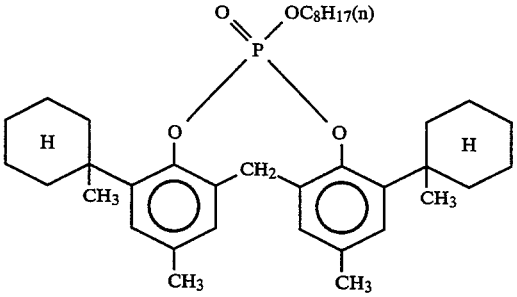
H-10
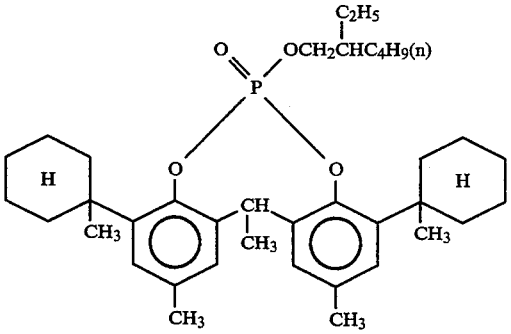
H-11
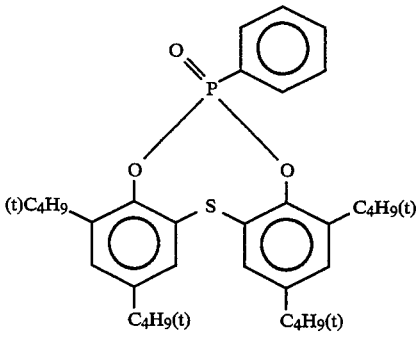
H-12
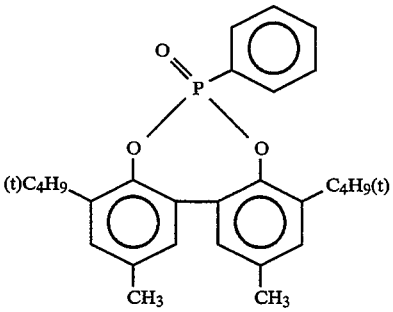

H-13
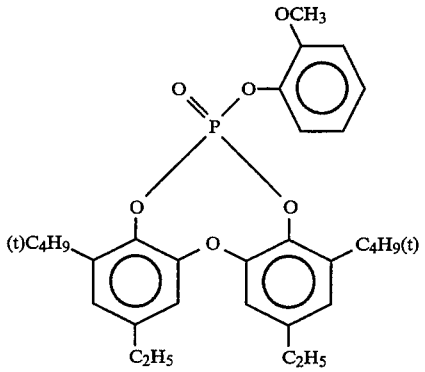
H-14
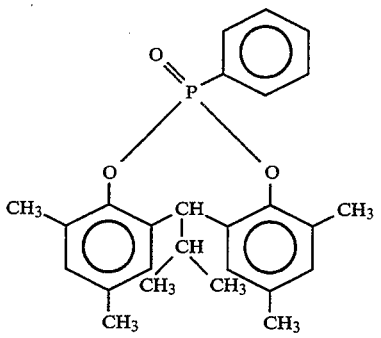
H-15
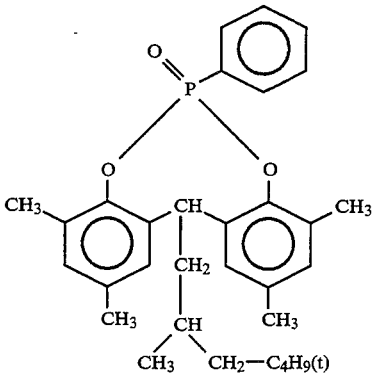
H-16
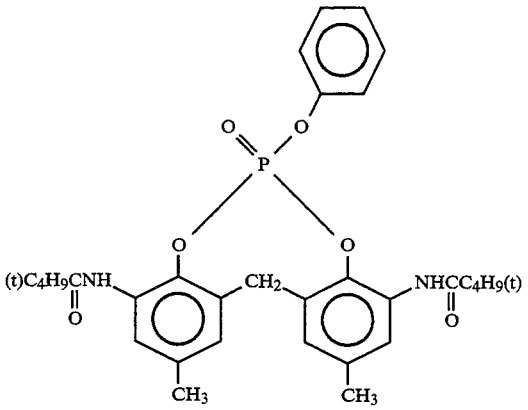
H-17
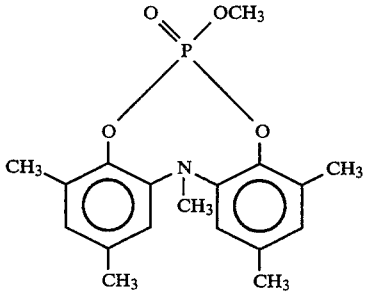
H-18
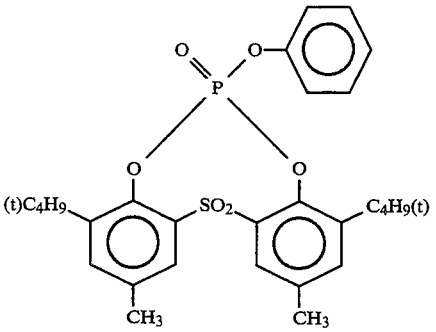
H-19
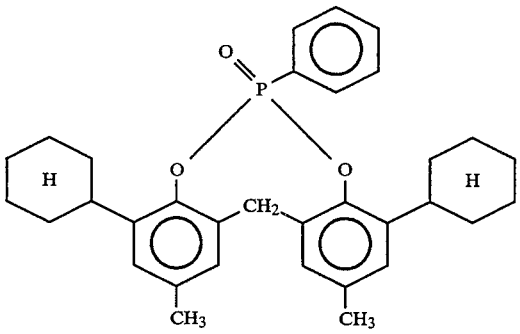
H-20
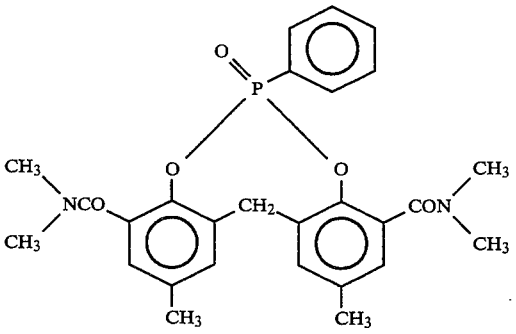
H-21
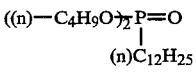
H-22
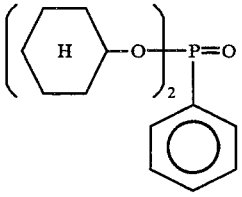

-continued
H-23
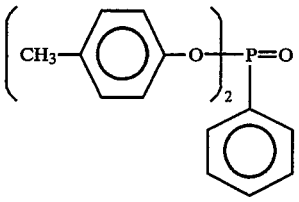
H-24
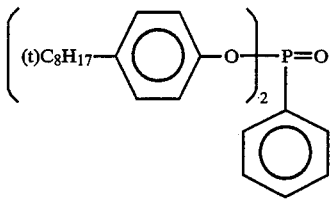
H-25
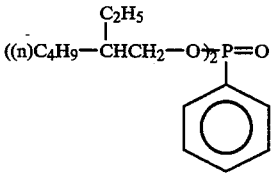
H-26
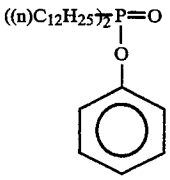
H-27
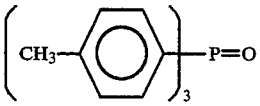
H-28
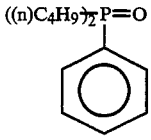
H-29
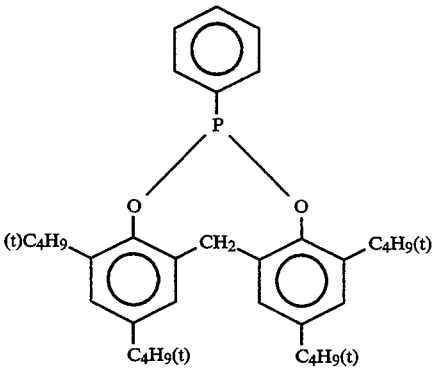
H-30
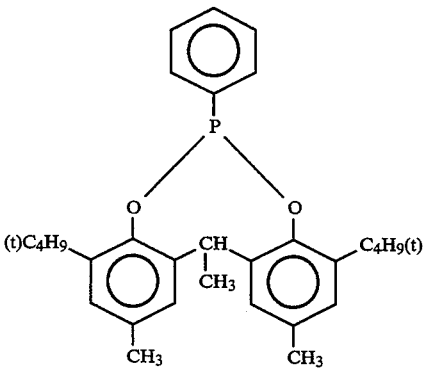
H-31
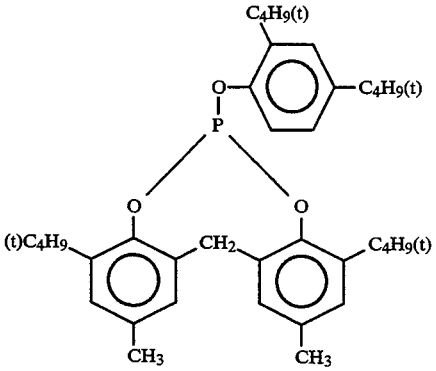
H-32
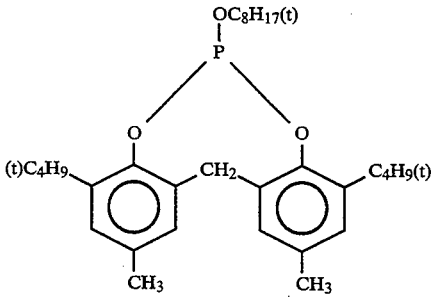

-continued
H-33
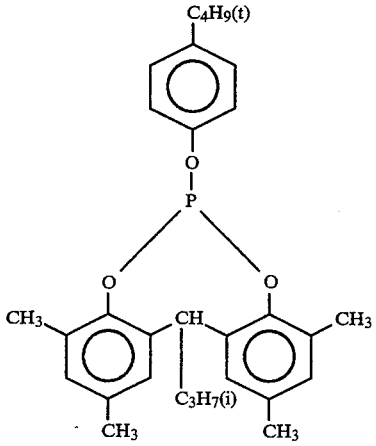
H-34
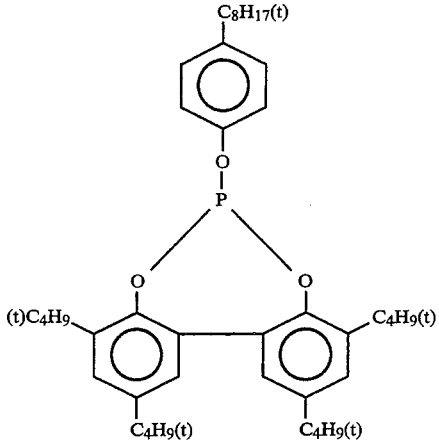
H-35
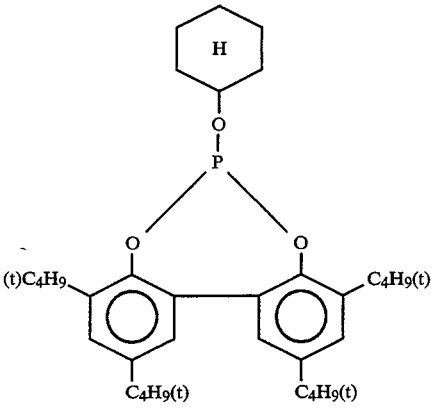
H-36
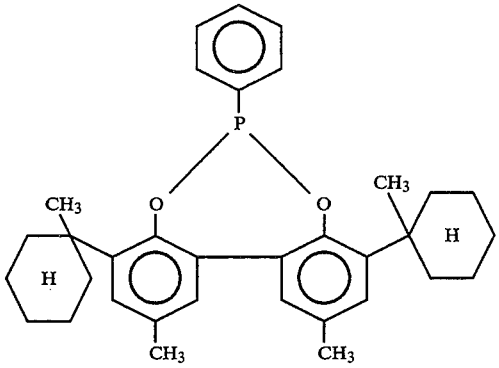
H-37
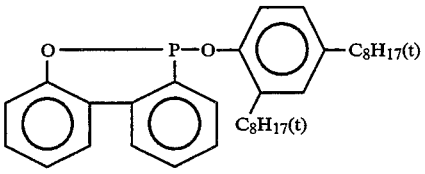
H-38
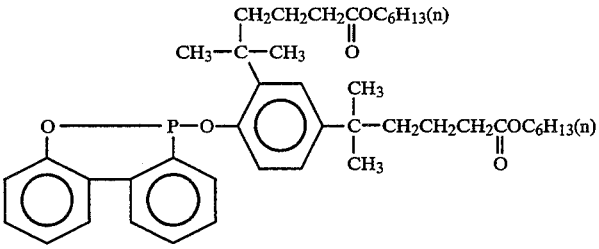
H-39
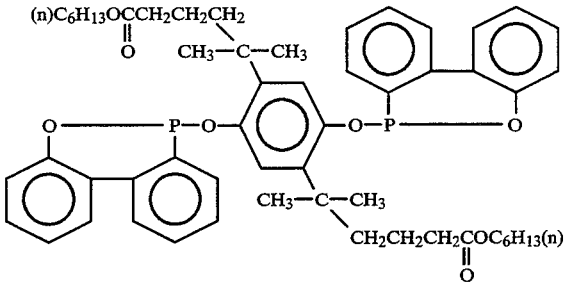
H-40
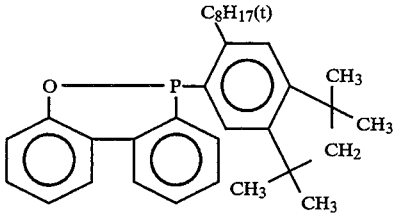

-continued
H-41
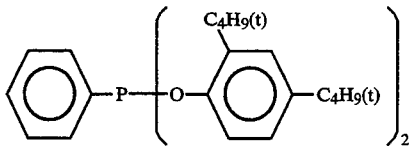
H-42
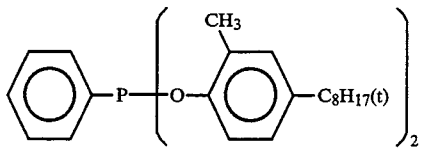
H-43
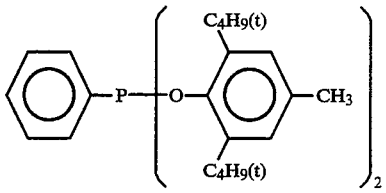
H-44
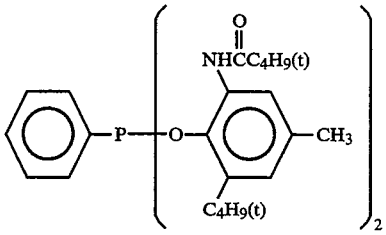
H-45
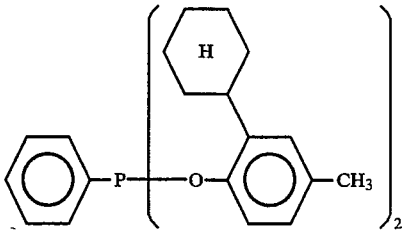
H-46
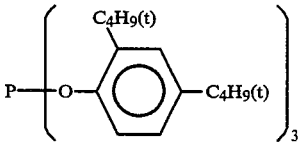
H-47
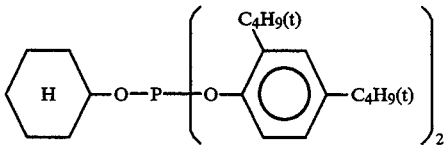
H-48
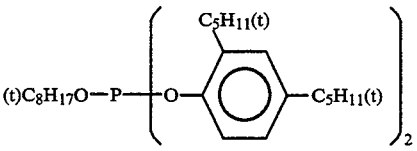
H-49
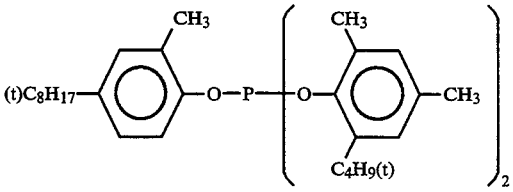
H-50
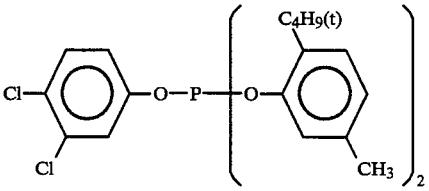
H-51
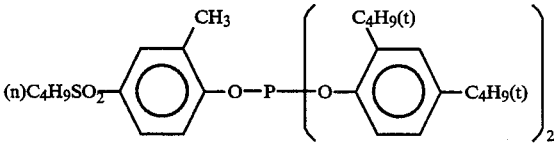
H-52
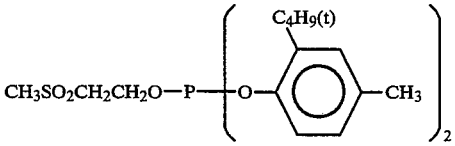
H-53
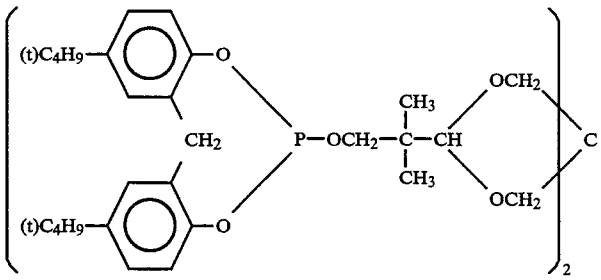

-continued

H-54

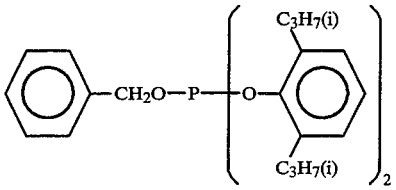

H-55

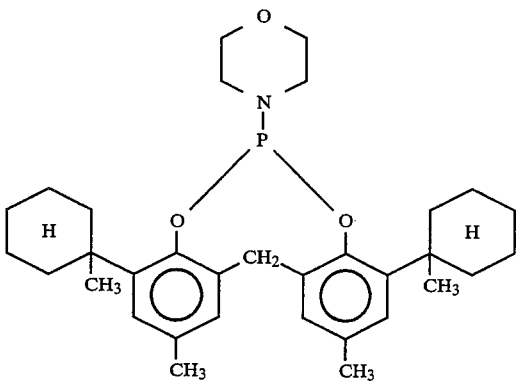

H-56

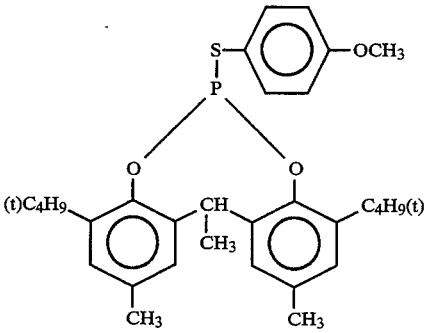

H-57

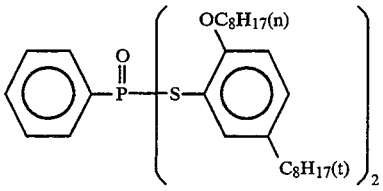

H-58

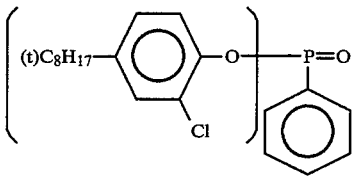

I-1

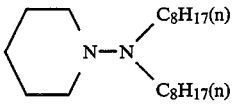

I-2

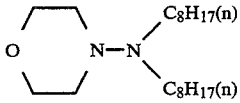

I-3

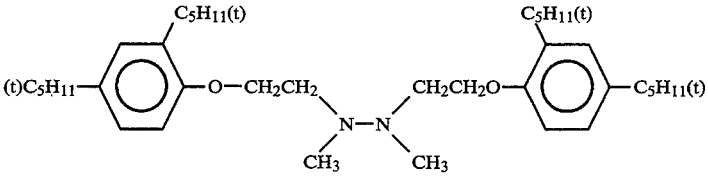

I-4

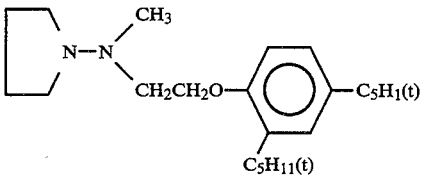

The present compounds and/or color couplers can be incorporated in a photographic material using various known dispersion methods. In general, the incorporation can be carried out using an oil-in-water dispersion method known as an oil-protected method, in which said ingredients are dissolved into a solvent and then dispersed into a surfactant-containing aqueous gelatin solution in the form of emulsion. In another way which can be adopted, water or an aqueous gelatin solution is added to a solution containing the present compounds and/or color couplers together with a surfactant, and the resulting mixture converts into an oil-in-water dispersion through phase inversion. In the case where the present compounds and/or color couplers are soluble in water, on the other hand, the so-called Fischer's dispersion method can be adopted. From the dispersions of the present compounds and/or color couplers, low boiling organic solvents may be removed by distillation, noodle washing, ultrafiltration or so on, and then the resulting dispersion may be mixed with photographic emulsions. As dispersion media for the present compounds and couplers, high boiling organic solvents having a dielectric constant of 2–20 (at 25° C.) and a refractive index of 1.5 to 1.7 (at 25° C.) and/or water-insoluble high molecular compounds can be used to advantage. It is desirable that the compounds of the present invention should be emulsified together with color couplers.

Specific examples of high boiling solvents used for the oil-in-water dispersion method are disclosed, e.g., in U.S. Pat. No. 2,322,027.

Also, a latex dispersion method as one of polymer dispersion methods can be adopted, and its processes, its effects and specific examples of latexes used for impregnation therein are described, e.g., in U.S. Pat. No. 4,199,363, and West German Patent Application (OLS) Nos. 2,541,274 and 2,541,230. As for the dispersion method using polymers soluble in organic solvents, on the other hand, there is a concrete description thereof in PCT WO 88/00723.

Specific examples of high boiling organic solvents which can be used in the aforementioned oil-in-water dispersion method include phthalic acid esters (e.g., dibutyl phthalate, dioctyl phthalate, dicyclohexyl phthalate, di-2-ethylhexyl phthalate, decyl phthalate, bis(2,4-di-t-amylphenyl)isophthalate, bis(1,1-diethylpropyl)phthalate), phosphoric or phosphonic acid esters (e.g., diphenyl phosphate, triphenyl phosphate, tricresyl phosphate, 2-ethylhexyl diphenyl phosphate, dioctyl butyl phosphate, tricyclohexyl phosphate, tri-2-ethylhexyl phosphate, tridecyl phosphate, di-2-ethylhexyl phenyl phosphate), benzoic acid esters (e.g., 2-ethylhexylbenzoate, 2,4-dichlorobenzoate, dodecylbenzoate, 2-ethylhexyl-p-hydroxybenzoate), amides (e.g., N,N-diethyldodecanamide, N,N-diethyllaurylamide), alcohols or phenols (e.g., isostearyl alcohol, 2,4-di-tert-amylphenol), aliphatic esters (e.g., dibutoxyethyl succinate, di-2-ethylhexyl succinate, 2-hexyldecyl tetradecanate, tributyl citrate, diethyl azelate, isostearyl lactate, trioctyl citrate), aniline derivatives (e.g., N,N-dibutyl-2-butoxy-5-tert-octylaniline), chlorinated paraffins (e.g., paraffins having a chlorine content of 10–80%), trimesic acid esters (e.g., tributyl trimesate), dodecylbenzene, diisopropylnaphthalene, and so on. In addition, organic solvents having a boiling point ranging from 30° C. to about 160° C. (e.g., ethyl acetate, butyl acetate, ethyl propionate, methyl ethyl ketone, cyclohexanone, 2-ethoxyethylacetate, dimethylformamide) may be used together as auxiliary solvent.

The color photographic material of the present invention may contain as color-fog inhibitors hydroquinone derivatives, aminophenol derivatives, gallic acid derivatives, ascorbic acid derivatives and the like.

In the color photographic material of the present invention, various kinds of discoloration inhibitors can be used. Typical examples of organic discoloration inhibitors usable for cyan, magenta and/or yellow images include hydroquinones, 6-hydroxychromans, 5-hydroxycoumarans, spirochromans, p-alkoxyphenols, hindered phenols represented by bisphenols, gallic acid derivatives, methylenedioxybenzenes, aminophenols, hindered amines, and ether or ester derivatives obtained by silylating or alkylating the phenolic OH groups contained in the above-cited compounds. In addition, metal complexes represented by (bissalicylaldoximato)nickel complex and (bis—N,N-dialkyldithiocarbamato)nickel complexes can be used for the above-described purpose.

Specific examples of organic discoloration inhibitors are described in the following patent specifications.

That is, hydroquinones are described, e.g., in U.S. Pat. Nos. 2,360,290, 2,418,613, 2,700,453, 2,701,197, 2,728,659, 2,732,300, 2,735,765, 3,982,944 and 4,430,425, British Patent 1,363,921, and U.S. Pat. Nos. 2,710,801 and 2,816,028; 6-hydroxychromans, 5-hydroxycoumarans and spirochromans are described, e.g., in U.S. Pat. Nos. 3,432,300, 3,573,050, 3,574,627, 3,698,909 and 3,764,337, and JP-A-52-152225; spiroindanes are described, e.g., in U.S. Pat. No. 4,360,589; p-alkoxyphenols are described, e.g., in U.S. Pat. No. 2,735,765, British Patent 2,066,975, JP-A-59-10539, and JP-B-57-19765; hindered phenols are described, e.g., in U.S. Pat. Nos. 3,700,455 and 4,228,235, JP-A-52-72224 and JP-B-52-6623; gallic acid derivatives are described, e.g., in U.S. Pat. No. 3,457,079; methylenedioxybenzenes are described in U.S. Pat. No. 4,332,886; aminophenols are described, e.g., in JP-B-56-21144; hindered amines are described, e.g., in U.S. Pat. Nos. 3,336,135 and 4,268,593, British Patents 1,326,889, 1,354,313 and 1,410,846, JP-B-51-1420, JP-A-58-114036, JP-A-59-53846 and JP-A-59-78344; and metal complexes are described, e.g., in U.S. Pat. Nos. 4,050,938 and 4,241,155, and British Pat. No. 2,027,731 A. These compounds can accomplish their purpose when used in a proportion of, in general, from 5 to 100 wt % to color couplers corresponding thereto respectively, and emulsified together with color couplers, followed by incorporation into light-sensitive layers.

In order to prevent cyan dye images from undergoing deterioration due to heat and light in particular, it is more effective to introduce an ultraviolet absorbent into a cyan color-forming layer and both layers adjacent thereto.

As examples of ultraviolet absorbents usable for the above-described purpose, mention may be made of acryl-substituted benzotriazole compounds (as disclosed, e.g., in U.S. Pat. No. 3,533,794), 4-thiazolidone compounds (as disclosed, e.g., in U.S. Pat. Nos. 3,314,794 and 3,352,681), benzophenone compounds (as disclosed, e.g., in JP-A-46-2784), cinnamate compounds (as disclosed, e.g., in U.S. Pat. Nos. 3,705,805 and 3,707,395), butadiene compounds (as disclosed, e.g., in U.S. Pat. No. 4,045,229), and benzoxazole compounds (as disclosed, e.g., in U.S. Pat. Nos. 3,406,070 and 4,271,307). Also, ultraviolet-absorbing couplers (e.g., α-naphthol type cyan dye-forming couplers) and ultraviolet-absorbing polymers may be used. These ultraviolet absorbents may be mordanted to be fixed to a particular layers. Among the above-cited ultraviolet absorbents, acryl-substituted benzotriazole compounds as described above are preferred over others.

In applying the present invention to a multilayer silver halide color photographic material, the color photographic material can take such a constitution that at least one yellow coupler-containing blue-sensitive silver halide emulsion layer, at least one magenta coupler-containing green-sensitive silver halide emulsion layer and at least one cyan coupler-containing red-sensitive silver halide emulsion layer are coated over a support in this order. However, coating orders different from the foregoing one may be adopted. On the other hand, infrared-sensitive silver halide emulsion layers can be provided in place of at least one among the foregoing emulsion layers. Color reproduction according to the subtractive color process can be effected by incorporating the combinations of silver halide emulsions having sensitivities in their individual wavelength regions with color couplers capable of forming dyes, each of which bears a complementary color relationship to light by which its corresponding emulsion is sensitized, in the foregoing light-sensitive emulsion layers, respectively. However, as for the correspondence of the color sensitivities of light-sensitive emulsion layers with the hues of colors formed from color couplers, those different from the above-described one may be adopted.

The compounds of the present invention can be applied, e.g., to color paper, color reversal paper, direct positive color photographic materials, color negative films, color positive films, color reversal films and so on. In particular, their applications to color photographic materials having a reflecting support (e.g., color paper, color reversal paper) and color photographic materials forming positive images (e.g., direct positive color photographic materials, color positive films, color reversal films) are of great advantage.

As suitable examples of silver halide emulsions and other ingredients (such as additives, etc.), and photographic constituent layers ( including their arranging order), which can be applied to the photographic material of the present invention, and as those of processing methods and additives for processing solutions, which can be adopted in processing the photographic material of the present invention, mention may be made of those disclosed in the following patent specifications, especially EP-0355660A2 (corresponding to JP-A-02-139544).

| Photographic Constituents | JP-A-62-215272 | JP-A-2-33144 | EP-0355660A2 |
|---|---|---|---|
| Silver halide emulsions | from 6th line in right lower column at page 10 to 5th line in left lower column at page 12, and from 4th line from the bottom of right lower column at page 12 to 17th line in left upper column at page 13 | from 16th line in right upper column at page 28 to 11th line in right lower column at page 29, and from 2nd line to 5th line at page 30 | from 53th line at page 45 to 3rd line at page 47, and from 20th line to 22nd line at page 47 |
| Silver halide solvents | from 6th line to 14th line in left lower column at page 12, and from 3rd line from the bottom of left upper column at page 13 to the end line in left lower column at page 18 | | |
| Chemical sensitizers | from 3rd line in left lower column to 5th line in right lower column at page 12, and from 1st line in right lower column at page 18 to 9th line from the bottom of right upper column at page 22 | from 12th line to end line in right lower column at page 29 | from 4th line to 9th line at page 47 |
| Spectral sensitizers (Spectral sensitizing methods) | from 8th line from the bottom of right upper column at page 22 to end line at page 38 | from 1st to 13th in left upper column at page 30 | from 10th line to 15th line at page 47 |
| Emulsion stabilizer | from 1st line in left upper column at page 39 to end line in right upper column at page 72 | from 14th line in left upper column to 1st line in right upper column at page 30 | from 16th line to 19th line at page 47 |
| Development accelerator | from 1st line in left lower column at page 72 to 3rd line in right upper column at page 91 | | |
| Color couplers (cyan, magenta and yellow couplers) | from 4th line in right upper column at page 91 to 6th line in left upper column at page 121 | from 14th line in right upper column at page 3 to end line in left upper column at page 18, and from 6th line in right upper column at page 30 to 11th line in right lower column at page 35 | from 15th line to 27th line at page 4, from 30th line at page 5 to end line at page 28, from 29th to 31st line at page 45, and from 23rd line at page 47 to 50th line at page 63 |
| Color formation reinforcing agent | from 7th line in left upper column at page 121 to 1st line in right upper column at page 125 | | |

-continued

| Photographic Constituents | JP-A-62-215272 | JP-A-2-33144 | EP-0355660A2 |
|---|---|---|---|
| Ultraviolet absorbent | from 2nd line in right upper column at page 125 to end line in left lower column at page 127 | from 14th line in right lower column at page 37 to 11th line in left upper column at page 38 | from 22nd line to 31st line at page 65 |
| Discoloration inhibitor (image stabilizer) | from 1st line in right lower column at page 127 to 8th line in left lower column at page 137 | from 12th line in right upper column at page 36 to 19th line in left upper column at page 37 | from 30th line at page 4 to 23rd line at page 5, from 1st line at page 39 to 25th line at page 45, from 33rd line to 40th line at page 45, and from 2nd line to 21st line at page 65 |
| High boiling and/or low boiling organic solvents | from 9th line in left lower column at page 137 to end line in right upper column at page 144 | from 14th line in right lower column at page 35 to 4th line from the bottom of left upper column at page 36 | from 1st line to 51st line at page 64 |
| Dispersion methods for photographic additives | from 1st line in left lower column at page 144 to 7th line in right upper column at page 146 | from 10th line in right lower column at page 27 to end line in left upper column at page 28, and from 12th line in right lower column at page 35 to 7th line in right upper column at page 37 | from 51st line at page 63 to 56th line at page 64 |
| Hardeners | from 8th line in right upper column at page 146 to 4th line in left lower column at page 155 | | |
| Precursors of developing agents | from 5th line in left lower column at page 155 to 2nd line in right lower column at page 155 | | |
| Development inhibitor releasing compounds | from 3rd line to 9th line in right lower column at page 155 | | |
| Supports | from 19th line in right lower column at page 155 to 14th line in left upper column at page 156 | from 18th line in right upper column at page 38 to 3rd line in left upper column at page 39 | from 29th line at page 66 to 13th line at page 67 |
| Light-sensitive layer constitution | from 15th line in left upper column at page 156 to 14th line in right lower column at page 156 | from 1st line to 15th line in right upper column at page 28 | from 41st line to 52nd line at page 45 |
| Dyes | from 15th line in right lower column at page 156 to end line in right lower column at page 184 | from 12th line in left upper column to 7th line in right upper column at page 38 | from 18th line to 22nd line at page 66 |
| Color stain inhibitors | from 1st line in left upper column at page 185 to 3rd line in right lower column at page 188 | from 8th line to 11th line in right upper column at page 36 | from 57th line at page 64 to 1st line at page 65 |
| Gradation modifiers | from 4th line to 8th line in right lower column at page 188 | | |
| Stain inhibitors | from 9th line in right lower column at page 188 to 10th line in right lower column at page 193 | from end line in left upper column to 13th line in right lower column at page 37 | from 32nd line at page 65 to 17th line at page 66 |
| Surfactants | from 1st line in left lower column at page 201 to end line in right upper column at page 210 | from 1st line in right upper column at page 18 to end line in right lower column at page 24, and from 10th line from the bottom of | |

-continued

| Photographic Constituents | JP-A-62-215272 | JP-A-2-33144 | EP-0355660A2 |
|---|---|---|---|
| | | left lower column to 9th line in right lower column at page 27 | |
| Fluorine containing compounds (antistatic agents, coating aids, lubricants, adhesion inhibitors, etc.) | from 1st line in left lower column at page 210 to 5th line in left lower column at page 222 | from 1st line in left upper column at page 25 to 9th line in right lower column at page 27 | |
| Binders (hydrophilic colloids) | from 6th line in left lower column at page 222 to end line in left upper column at page 225 | from 8th line to 18th line in right upper column at page 38 | from 23rd line to 28th line at page 66 |
| Thickening agents | from 1st line in left lower column at page 225 to 2nd line in right upper column at page 227 | | |
| Antistatic agents | from 3rd line in right upper column at page 227 to 1st line in left upper column at page 230 | | |
| Polymer latexes | from 2nd line in left upper column at page 230 to end line at page 239 | | |
| Matting agents | from 1st line in left upper column to end line in right upper column at page 240 | | |
| Photographic processing method (including photographic steps, additives, and so on) | from 7th line in right upper column at page 3 to 5th line in right upper column at page 10 | from 4th line in left upper column at page 39 to end line in left upper column at page 42 | from 14th line at page 67 to 28th line at page 69 |

Note)
The quoted paragraphs of JP-A-62-21527 include the contents of amendments dated March 16 in 1987 which were given in the end of said bulletin.
As for the yellow couplers, so-called blue-shift-type couplers disclosed in JP-A-63-231451, JP-A-63-123047, JP-A-63-241547, JP-A-01-173499, JP-A-01-213648 and JP-A-01-250944 are preferably used as well as those cited in the above references.

As for the cyan couplers, not only diphenylimidazole-type cyan couplers disclosed in JP-A-02-33144 but also 3-hydroxypyridine-type cyan couplers disclosed in EP-033185A2 (especially one which is prepared by introducing a chlorine atom as a splitting-off group into Coupler (42) cited as a specific example to render the coupler two-equivalent, and Couplers (6) and (9) cited as specific examples) and cyclic active methylene-type cyan couplers disclosed in JP-A-64-32260 (especially Couplers 3, 8 and 34 cited as specific examples) are preferably used in addition to those cited in the above references.

Silver halides which can be used in the present invention include silver chloride, silver bromide, silver chlorobromide, silver iodochlorobromide, silver iodobromide and the like. For the purpose of achievement of rapid processing, however, it is preferable that they should be substantially iodide-free silver chlorobromide having a chloride content of at least 90 mol %, preferably at least 95 mol %, and particularly preferably at least 98 mol %, or substantially iodide-free silver chloride.

For the purpose of enhancement of image sharpness and the like, it is desirable that dyes capable of undergoing decolorization by photographic processing (especially oxonol dyes), which are disclosed at pages 27 to 76 in EP-0337490A2, should be added to a hydrophilic colloid layer of the present photographic material in such an amount as to impart an optical reflection density of at least 0.70 at 680 nm to the resulting photographic material, or titanium oxide grains which have undergone the surface treatment with a di- to tetrahydric alcohol (e.g., trimethylolethane) should be incorporated in an amount of at least 12 wt % (more preferably at least 14 wt %) in a waterproof resin coating provided on a support of the present photographic material.

Further, it is advantageous to the photographic material relating to the present invention that compounds capable of improving the keeping quality of color images as disclosed in EP-0277589A2 are used together with color couplers, especially pyrazoloazole type couplers.

More specifically, compounds of the kind which can produce chemically inert, substantially colorless compounds by combining chemically with an aromatic amine developing agent remaining after the color development-processing (Compound F) and/or compounds of the kind which can produce chemically inert, substantially colorless compounds by combining chemically with an oxidized product of aromatic amine developing agent remaining after the color development-processing (Compound G) are used simultaneously or separately, resulting in the effective prevention of stain generation upon storage after photographic processing, which is due to formation of dyes through the reaction between couplers and a color developing agent or oxidized product thereof remaining in the photographic film after the photographic processing, and in the inhibition of other side reactions.

Furthermore, it is desirable that the photographic material relating the present invention should contain antimolds as disclosed in JP-A-63-271247 for preventing various kinds of molds and bacteria from propagating themselves in hydrophilic colloid layers to result in deterioration of image quality.

As for the support applicable to the photographic material of the present invention, a white polyester type support or a support having a white pigment-containing layer on the side of the silver halide emulsion layers may be adopted for display use. In order to further improve the sharpness, an antihalation layer is preferably provided on the silver halide emulsion side of a support or on the back side of a support. In particular, it is desirable for appreciation of a display with both reflected light and transmitted light that the support should be designed so as to have transmittance of from 0.35 to 0.8.

The photographic materials relating to the present invention may be exposed to visible light or infrared light. As for the method of exposure, both low intensity exposure and high intensity short-time exposure may be adopted. In the latter case, a laser scanning exposure system in which an exposure time per picture element is shorter than $10^{-4}$ second is preferably used.

Moreover, it is desirable that a band stop filter disclosed in U.S. Pat. No. 4,880,726 should be used at the time of exposure. Owing to this filter, color stains of light origin can be removed to bring about a marked improvement in color reproducibility.

The photographic materials relating to the present invention can be subjected to photographic processing in accordance with usual methods described in *Research Disclosure*, No. 17643, pages 28–29, and ibid., No. 18716, from left to right columns of 615. The photographic processing comprises, e.g., a color developing step, a desilvering step and a washing step. In the desilvering step, bleach-fix processing can be performed using a bleach-fix bath instead of carrying out successively bleach processing with a bleaching agent and fix processing with a fixing agent, or bleach processing, fix processing and bleach-fix processing may be combined in any order. The washing step may be replaced by a stabilization step, or may be followed by a stabilization step. Also, a monobath photographic processing, or combined color developing, bleaching and fixing with a monobath, can be carried out. In combination with the above-described steps, a prehardening step, a neutralizing step, a stop-fix step, a post-hardening step, a compensating step, an intensifying step and so on may be carried out. In addition, an intermediate washing step may be provided between any two of the above-cited steps. In various kinds of photographic processing as described above, activator processing may be carried out in place of color development processing.

Now, the present invention will be illustrated in greater detail by reference to the following examples. However, the invention should not be construed as being limited to these examples.

EXAMPLE 1

16.1 g of a yellow coupler Y-1 was weighed out, and thereto were added 16.1 g of dibutyl phthalate as a high boiling organic solvent and further 24 ml of ethyl acetate. The thus prepared solution was emulsified and dispersed in 200 g of a 10 wt % aqueous gelatin solution containing 1.5 g of sodium dodecylbenzenesulfonate.

Total amount of the emulsified dispersion obtained was added to 247 g of a high chloride-content silver halide emulsion (containing 70.0 g silver per Kg of emulsion and having a bromide content of 0.5 mol %), and coated on a triacetate film base provided with a subbing layer at a silver coverage of 1.73 g/m$^2$. Thereon, a gelatin layer was further coated as protective layer in a dry thickness of 1.0 μm to prepare Sample 101. Therein, sodium salt of 1-oxy-3,5-dichloro-s-triazine was used as gelatin hardener.

Samples 102 to 202 were prepared in the same manner as Sample 101, except that in preparing emulsified dispersions of couplers, the couplers set forth in Table A were emulsified together with color image stabilizers set forth also in Table A (added in a proportion of 100 mol % to corresponding couplers).

Each of the thus obtained samples was exposed wedgewise, and then subjected to the photographic processing described below.

| Processing Step | Temperature | Time |
|---|---|---|
| Color Development | 35° C. | 45 sec. |
| Bleach-Fix | 30–35° C. | 45 sec. |
| Rinsing (1) | 30–35° C. | 20 sec. |
| Rinsing (2) | 30–35° C. | 20 sec. |
| Rinsing (3) | 30–35° C. | 20 sec. |
| Drying | 70–80° C. | 60 sec. |

The composition of each processing solution used was described below.

| Color Developer | |
|---|---|
| Water | 800 ml |
| Ethylenediamine-N,N,N',N'-tetra-methylenephosphonic acid | 1.5 g |
| Potassium bromide | 0.015 g |
| Triethanolamine | 8.0 g |
| Sodium chloride | 1.4 g |
| Potassium carbonate | 25 g |
| N-Ethyl-N-(β-methanesulfonamidoethyl)-3-methyl-4-aminoaniline sulfate | 5.0 g |
| N,N-Bis(carboxymethyl)hydrazine | 5.5 g |
| Brightening agent (WHITEX 4B, produced by Sumitomo Chemical Co., Ltd.) | 1.0 g |
| Water to make | 1,000 ml |
| pH (25° C.) adjusted to | 10.05 |
| **Bleach-Fix Bath** | |
| Water | 400 ml |
| Ammonium thiosulfate (700 g/l) | 100 ml |
| Sodium sulfite | 17 g |
| Ammonium ethylenediaminetetra-acetato ferrate(III) | 55 g |
| Disodium ethylenediaminetetraacetate | 5 g |
| Ammonium bromide | 40 g |
| Water to make | 1,000 ml |

-continued

| | |
|---|---|
| pH (25° C.) | 6.0 |

Rinsing Solution

Ion exchanged water (in which calcium and magnesium ion concentrations were each below 3 ppm).

Each of Samples 101 to 202, in which a color image had been formed in the above-described manner, was exposed for 15 days to a Xenon tester (illuminance: 200,000 lux) to which was attached an ultraviolet absorption filter capable of cutting rays of light shorter than 400 nm (produced by Fuji Photo Film Co., Ltd.). Each sample was examined for yellow color density (stain) in the unexposed area and a density remaining rate in the area having an initial density of 2.0.

The density measurement was performed using a Fuji automatic recording densitometer.

The results obtained are shown in Table A.

TABLE A

| Sample | Coupler | Color Image Stabilizer (100 mol % addn.) | Dye Remaining Rate (initial density: 2.0, Xe lamp, 15 days) | Note |
|---|---|---|---|---|
| 101 | Y-1 | — | 38 | Comparison |
| 102 | " | A-11 | 51 | " |
| 103 | " | A-19 | 55 | " |
| 104 | " | A-27 | 50 | " |
| 105 | " | A-29 | 53 | " |
| 106 | " | A-40 | 55 | " |
| 107 | " | Comparative Compound (a) | 47 | " |
| 108 | YY-1 | — | 39 | " |
| 109 | " | A-11 | 82 | Invention |
| 110 | " | A-19 | 80 | " |
| 111 | " | A-27 | 82 | " |
| 112 | " | A-29 | 81 | " |
| 113 | " | A-40 | 74 | " |
| 114 | " | Comparative Compound (a) | 56 | Comparison |
| 115 | Y-1 | B-19 | 55 | Comparison |
| 116 | " | B-7 | 57 | " |
| 117 | " | B-27 | 54 | " |
| 118 | " | B-21 | 57 | " |
| 119 | YY-12 | — | 38 | " |
| 120 | " | B-19 | 74 | Invention |
| 121 | " | B-7 | 84 | " |
| 122 | " | B-27 | 85 | " |
| 123 | " | B-21 | 83 | " |
| 124 | Comparative Coupler a | — | 40 | Comparison |
| 125 | Comparative Coupler a | E-1 | 58 | " |
| 126 | Comparative Coupler a | E-7 | 59 | " |
| 127 | Comparative Coupler a | E-12 | 60 | " |
| 128 | Comparative Coupler a | E-30 | 58 | " |
| 129 | YY-22 | — | 38 | " |
| 130 | YY-22 | E-1 | 76 | Invention |
| 131 | " | E-7 | 80 | " |
| 132 | " | E-12 | 80 | " |
| 133 | " | E-30 | 75 | " |
| 134 | Comparative Coupler b | — | 38 | Comparison |
| 135 | Comparative Coupler b | F-1 | 58 | " |
| 136 | Comparative Coupler b | F-2 | 57 | " |
| 137 | Comparative Coupler b | F-10 | 49 | " |
| 138 | Comparative Coupler b | F-18 | 59 | " |
| 139 | YY-18 | — | 39 | " |
| 140 | " | F-1 | 76 | Invention |
| 141 | " | F-2 | 80 | " |
| 142 | " | F-10 | 82 | " |
| 143 | " | F-18 | 83 | " |
| 144 | Comparative Coupler c | — | 40 | Comparison |
| 145 | Comparative Coupler c | G-4 | 55 | " |
| 146 | Comparative Coupler c | G-7 | 54 | " |
| 147 | Comparative Coupler c | G-13 | 56 | " |
| 148 | Comparative Coupler c | G-16 | 53 | " |
| 149 | Comparative Coupler c | G-21 | 55 | " |
| 150 | YY-43 | — | 38 | " |
| 151 | " | G-4 | 79 | Invention |
| 152 | " | G-7 | 73 | " |
| 153 | " | G-13 | 80 | " |
| 154 | " | G-16 | 81 | " |
| 155 | " | G-21 | 74 | " |
| 156 | Y-1 | — | 39 | Comparison |
| 157 | " | H-5 | 45 | " |
| 158 | " | H-8 | 43 | " |
| 159 | Y-1 | H-9 | 43 | Comparison |
| 160 | " | H-12 | 45 | " |
| 161 | " | H-22 | 40 | " |
| 162 | " | H-24 | 42 | " |
| 163 | " | H-30 | 45 | " |
| 164 | " | H-31 | 40 | " |
| 165 | " | H-36 | 42 | " |
| 166 | " | H-49 | 40 | " |
| 167 | " | H-50 | 43 | " |
| 168 | " | H-54 | 42 | " |
| 169 | YY-1 | — | 45 | " |
| 170 | " | H-5 | 80 | Invention |
| 171 | " | H-8 | 75 | " |
| 172 | " | H-9 | 72 | " |
| 173 | " | H-22 | 82 | " |
| 174 | YY-1 | H-24 | 83 | Invention |
| 175 | " | H-30 | 83 | " |
| 176 | " | H-31 | 77 | " |
| 177 | " | H-49 | 85 | " |
| 178 | " | H-50 | 83 | " |
| 179 | YY-43 | — | 40 | Comparison |
| 180 | " | H-5 | 82 | Invention |
| 181 | " | H-12 | 84 | " |
| 182 | " | H-22 | 79 | " |
| 183 | " | H-24 | 83 | " |
| 184 | " | H-30 | 84 | " |
| 185 | " | H-36 | 83 | " |
| 186 | " | H-49 | 82 | " |
| 187 | " | H-54 | 84 | " |
| 188 | Comparative Coupler d | — | 36 | Comparison |
| 189 | Compara- | H-5 | 42 | Comparison |

TABLE A-continued

| Sample | Coupler | Color Image Stabilizer (100 mol % addn.) | Dye Remaining Rate (initial density: 2.0, Xe lamp, 15 days) | Note |
|---|---|---|---|---|
| | tive | | | |
| 190 | Coupler d Comparative | H-22 | 44 | " |
| 191 | Coupler d Comparative | H-30 | 43 | " |
| 192 | Coupler d Comparative | H-49 | 46 | " |
| 193 | Coupler d Comparative | — | 40 | " |
| 194 | Coupler e Comparative | H-8 | 47 | " |
| 195 | Coupler e Comparative | H-24 | 46 | " |
| 196 | Coupler e Comparative | H-31 | 44 | " |
| 197 | Coupler e Comparative | H-50 | 45 | " |
| 198 | Coupler e Comparative | — | 31 | " |
| 199 | Coupler f Comparative | H-12 | 39 | " |
| 200 | Coupler f Comparative | H-24 | 42 | " |
| 201 | Coupler f Comparative | H-36 | 42 | " |
| 202 | Coupler f Comparative | H-54 | 44 | " |
| 203 | Coupler f YY-12 | I-2 | 82 | Invention |
| 204 | " | I-3 | 83 | " |

(Y-1)

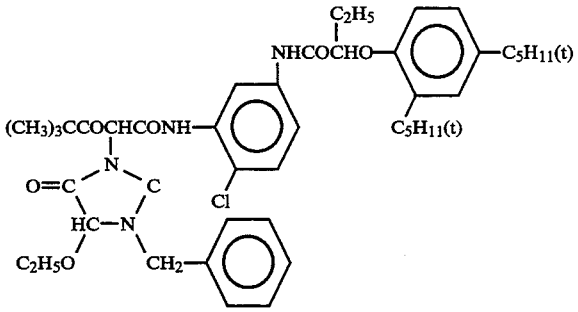

(Comparative Coupler a)

-continued

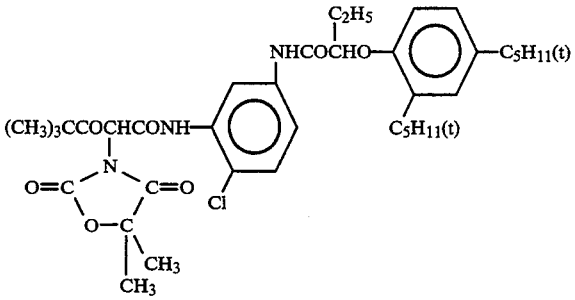

(Comparative coupler b)

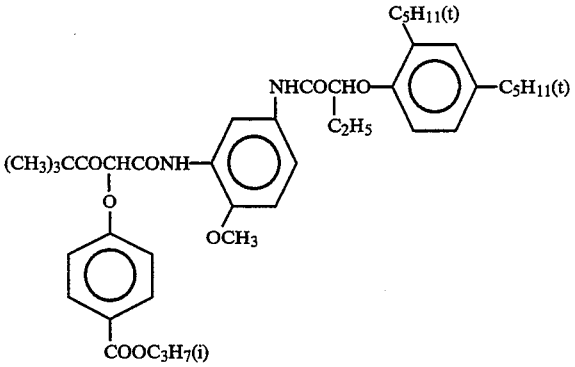

(Comparative Coupler c)

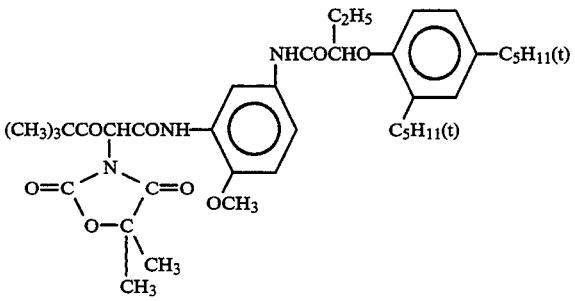

(Comparative Coupler d)

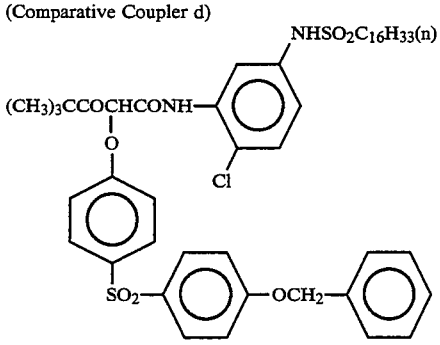

(Comparative Coupler e)

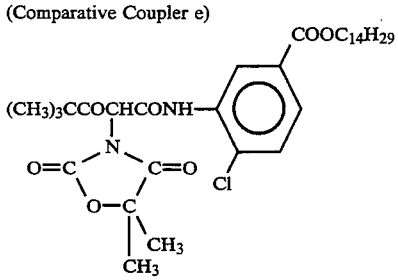

(Comparative Coupler f)

-continued

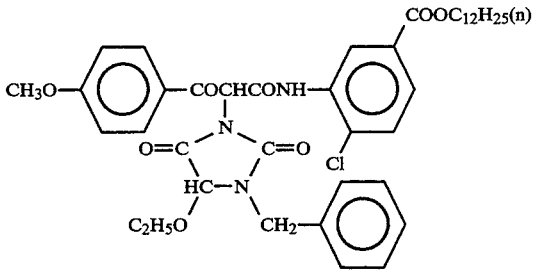

(Comparative Compound a)
1:1 (by mole) mixture of (disclosed in JP-A-62-239149)

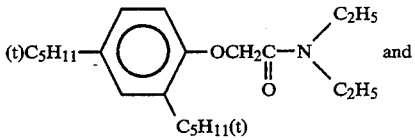

and

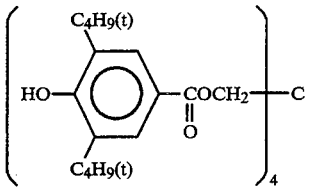

It can be seen from the data set forth above that the present compounds represented by the general formulae (a-I), (a-II), (a-III), (a-IV), (a-V) and (a-VI) markedly improved upon fastness of color image only when used in combination with the present yellow dye-forming couplers represented by the general formula (1). Markedness of the improvement achieved by the present invention cannot be foreseen from conventional arts.

EXAMPLE 2

After the surfaces of a paper support laminated with polyethylene on both sides was subjected to corona discharge, a gelatin subbing layer containing sodium dodecylbenzenesulfonate was provided on the support. In addition, various kinds of photographic constituent layers were provided on the foregoing subbing layer to prepare a multilayer color photographic paper having the layer structure described below. Coating compositions therefor were prepared in the following manners.

Preparation of Coating Solution for Fifth Layer

A mixture of 32.0 g of a cyan coupler (ExC), 3.0 g of a color image stabilizer (Cpd-2), 2.0 g of a color image stabilizer (Cpd-4), 18.0 g of a color image stabilizer (Cpd-6), 40.0 g of a color image stabilizer (Cpd-7) and 5.0 g of a color stabilizer (Cpd-8) was dissolved in a mixed solvent consisting of 50.0 ml of ethyl acetate and 14.0 g of a solvent (Solv-6), admixed with 500 ml of a 20% aqueous gelatin solution containing 8 ml of sodium dodecylbenzenesulfonate, and then emulsified by means of an ultrasonic homogenizer to prepare a dispersion. On the other hand, a 1:4 by mole (based on Ag) mixture of large grain and small grain silver chlorobromide emulsions (both of which had the crystal form of a cube; the former of which had an average grain size of 0.58 μm and a variation coefficient of 0.09 with respect to the grain size distribution, and the latter of which had an average grain size of 0.45 μm and a variation coefficient of 0.11 with respect to the grain size distribution; and both of which contain 0.6 mol % of AgBr in such a condition as to be localized at the grain surface) were prepared. In preparing these emulsions, a red-sensitive sensitizing dye E illustrated below was added in amounts of $0.9\times10^{-4}$ mol/mol Ag and $1.1\times10^{-4}$ mol/mol Ag to the large grain emulsion and to the small grain emulsion respectively. The silver chlorobromide emulsion mixture was chemically ripened with a sulfur sensitizer and a gold sensitizer, and then mixed with the above-described emulsified dispersion. Thereto, other ingredients described below were further added so as to obtain a coating solution for the fifth layer having the composition described below.

In addition, coating solutions for from the first to the fourth layers and for the sixth and the seventh layers were prepared respectively in the same manner as that for the fifth layer. In each layer, sodium salt of 1-oxy-3,5-dichloro-s-triazine was used as gelatin hardener.

Furthermore, Cpd-10 and Cpd-11 were added to every constituent layer so as to have total coverages of 25.0 mg/m$^2$ and 50.0 mg/m$^2$, respectively.

Spectral sensitizing dyes used for the silver chlorobromide emulsions of each light-sensitive emulsion layer are illustrated below.

Blue-sensitive Emulsion Layer

The following spectral sensitizing dye A and spectral sensitizing dye B were added to the large grain emulsion in the same amount of $2.0\times10^{-4}$ mol/mol Ag, and to the small grain emulsion in the same amount of $2.5\times10^{-4}$ mol/mol Ag.

Sensitizing Dye A:

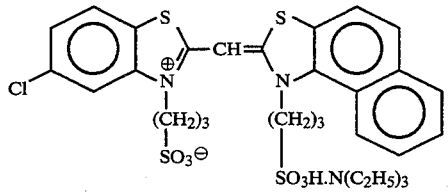

Sensitizing Dye B:

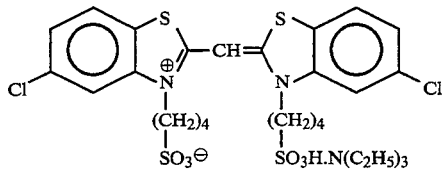

Green-sensitive Emulsion Layer

The following spectral sensitizing dye C was added to the large grain emulsion in an amount of $4.0\times10^{-4}$ mol/mol Ag and to the small grain emulsion in an amount of $5.6\times10^{-4}$ mol/mol Ag. Moreover, the following spectral sensitizing dye D was added to the large grain emulsion in an amount of $7.0\times10^{-5}$ mol/mol Ag and to the small grain emulsion in an amount of $1.0\times10^{-5}$ mol/mol Ag.

Sensitizing Dye C:

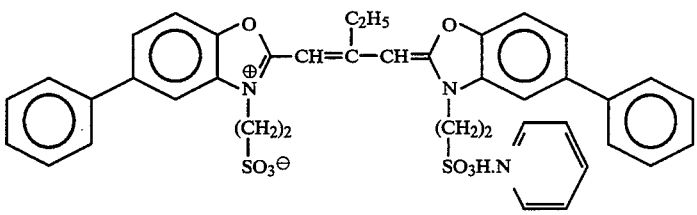

Sensitizing Dye D:

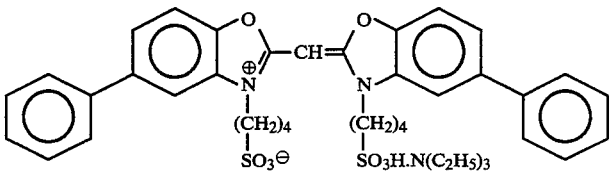

Red-sensitive Emulsion Layer

The following spectral sensitizing dye E was added to the large grain emulsion in an amount of $0.9\times10^{-4}$ mol/mol Ag and to the small grain emulsion in an amount of $1.1\times10^{-4}$ mol/mol Ag.

Sensitizing Dye E:

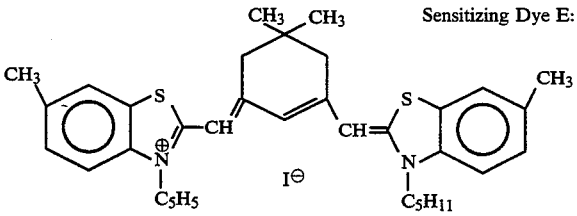

The following compound was further added in an amount of $2.6\times10^{-3}$ mole per mole of silver halide.

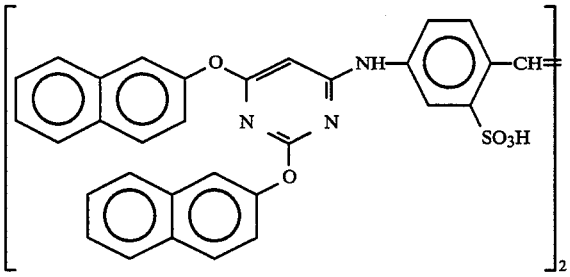

To the blue-sensitive, the green-sensitive and the red-sensitive emulsion layers was further added 1-(5-methylureidophenyl)-5-mercaptotetrazole in amounts of $8.5\times10^{-5}$ mole, $7.7\times10^{-4}$ mole and $2.5\times10^{-4}$ mole, respectively, per mole of silver halide.

To the blue-sensitive and the green-sensitive emulsion layers was furthermore added 4-hydroxy-6-methyl-1,3,3a,7-tetrazaindene in amounts of $1\times10^{-4}$ mole and $2\times10^{-4}$ mole, respectively, per mole of silver halide.

Also, the dyes illustrated below (each figure in parentheses represents the coverage of the corresponding dye) were added to each emulsion layer in order to prevent the irradiation phenomenon.

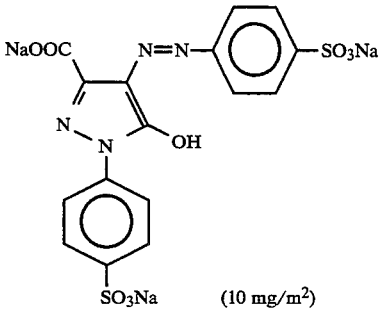

(10 mg/m²)

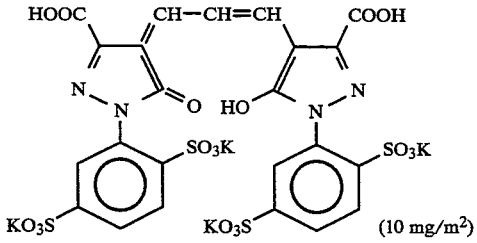

(10 mg/m²)

-continued

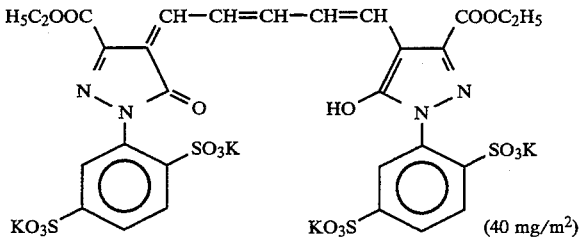

and

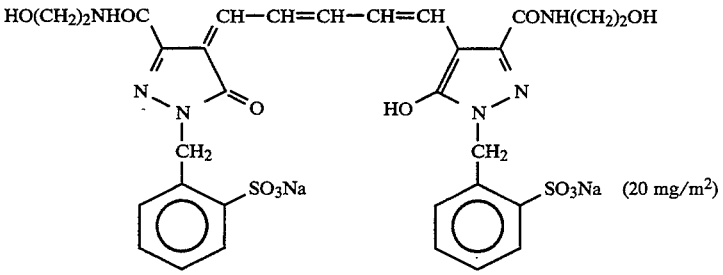

Layer Constitution

The composition of each constituent layer is described below. Each figure on the right side represents a coverage (g/m$^2$) of the ingredient corresponding thereto. As for the silver halide emulsions, the figure on the right side represents a coverage based on silver.

| | |
|---|---|
| Support: | |
| Polyethylene-laminated paper (which contained white pigment ($TiO_2$) and a bluish dye (ultramarine) in the polyethylene on the side of the first layer) | |
| First layer (blue-sensitive layer): | |
| Silver chlorobromide emulsion (having a cubic crystal form, and being a 3:7 (by mole base on silver) mixture of a large grain emulsion having an average grain size of 0.88 μm and a variation coefficient of 0.08 with respect to grain size distribution and a small grain emulsion having an average grain size of 0.70 μm and a variation coefficient of 0.10 with respect to grain size distribution, which each contained 0.3 mol % of AgBr in such a condition as to be located at the grain surface) | 0.30 |
| Gelatin | 1.86 |
| Yellow coupler (ExY) | 0.82 |
| Color image stabilizer (Cpd-1) | 0.19 |
| Solvent (Solv-3) | 0.18 |
| Solvent (Solv-7) | 0.18 |
| Color image stabilizer (Cpd-7) | 0.06 |
| Second layer (color stain inhibiting layer): | |
| Gelatin | 0.99 |
| Color stain inhibitor (Cpd-5) | 0.08 |
| Solvent (Solv-1) | 0.16 |
| Solvent (Solv-4) | 0.08 |
| Third layer (green-sensitive emulsion layer): | |
| Silver chlorobromide emulsion (having a cubic crystal form, and being a 1:3 (by mole base on silver) mixture of a large grain emulsion having an average grain size of 0.55 μm and a variation coefficient of 0.10 with respect to grain size distribution and a small grain emulsion having an average grain size of 0.39 μm and a variation coefficient of 0.08 with respect to grain size distribution, which each contained 0.8 mol % of AgBr in such a condition as to be located at the grain surface) | 0.12 |
| Gelatin | 1.24 |
| Magenta coupler (ExM) | 0.23 |
| Color image stabilizer (Cpd-2) | 0.03 |
| Color image stabilizer (Cpd-3) | 0.16 |
| Color image stabilizer (Cpd-4) | 0.02 |
| Color image stabilizer (Cpd-9) | 0.02 |
| Solvent (Solv-2) | 0.40 |
| Fourth layer (ultraviolet absorbing layer): | |
| Gelatin | 1.58 |
| Ultraviolet absorbent (UV-1) | 0.47 |
| Color stain inhibitor (Cpd-5) | 0.05 |
| Solvent (Solv-5) | 0.24 |
| Fifth layer (red-sensitive emulsion layer): | |
| Silver chlorobromide emulsion (having a cubic crystal form, and being a 1:4 (by mole base on silver) mixture of a large grain emulsion having an | 0.23 |

-continued

| | |
|---|---|
| average grain size of 0.58 μm and a variation coefficient of 0.09 with respect to grain size distribution and a small grain emulsion having an average grain size of 0.45 μm and a variation coefficient of 0.11 with respect to grain size distribution, which each contained 0.6 mol % of AgBr in such a condition as to be located at the grain surface) | |
| Gelatin | 1.34 |
| Cyan coupler (ExC) | 0.32 |
| Color image stabilizer (Cpd-2) | 0.03 |
| Color image stabilizer (Cpd-4) | 0.02 |
| Color image stabilizer (Cpd-6) | 0.18 |
| Color image stabilizer (Cpd-7) | 0.40 |
| Color image stabilizer (Cpd-8) | 0.05 |
| Solvent (Solv-6) | 0.14 |
| Sixth layer (ultraviolet absorbing layer): | |
| Gelatin | 0.53 |
| Ultraviolet absorbent (UV-1) | 0.16 |
| Color stain inhibitor (Cpd-5) | 0.02 |
| Solvent (Solv-5) | 0.18 |
| Seventh layer (protective layer): | |
| Gelatin | 1.33 |
| Acryl-modified polyvinyl alcohol (modification degree: 17%) | 0.17 |
| Liquid paraffin | 0.03 |

Yellow coupler (ExY)

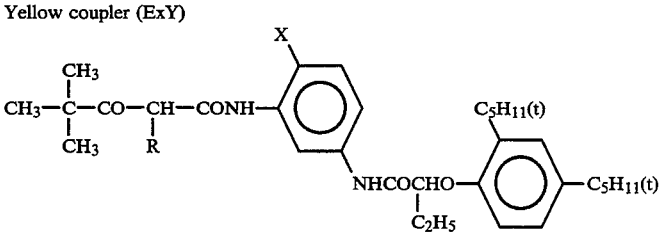

1:1 (by mole) mixture of that having

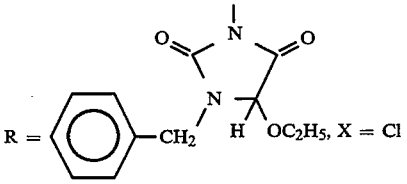

and with that having R = 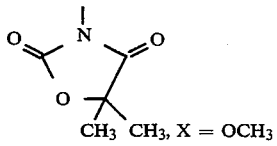

Magenta coupler (ExM)

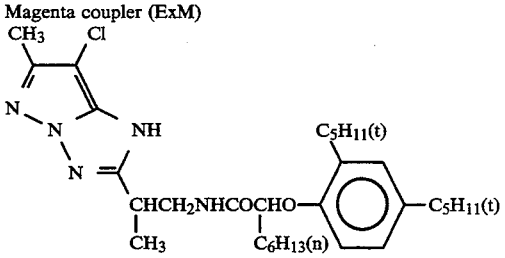

Cyan coupler (ExC)
1:1 (by mole) mixture of

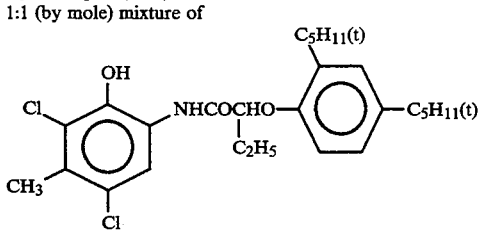

-continued
with
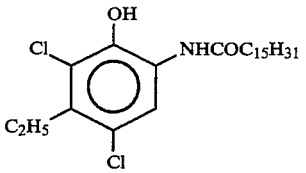
Color image stabilizer (Cpd-1)
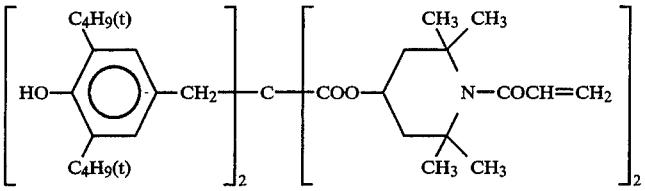
Color image stabilizer (Cpd-2)
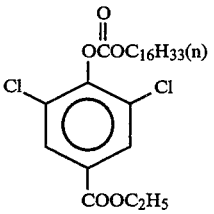
Color image stabilizer (Cpd-3)
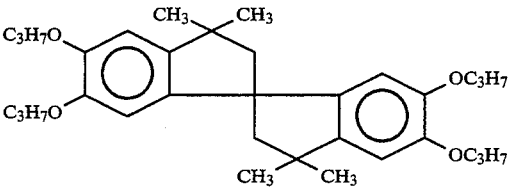
Color image stabilizer (Cpd-4)
1:1 mixture of that having X = H with that having X = Na
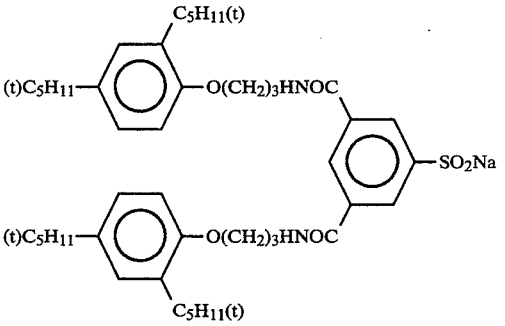
Color stain inhibitor (Cpd-5)
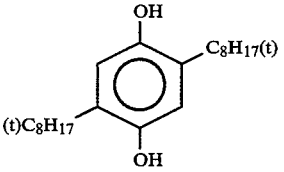
Color image stabilizer (Cpd-6)
2:4:4 (by weight) mixture of -continued
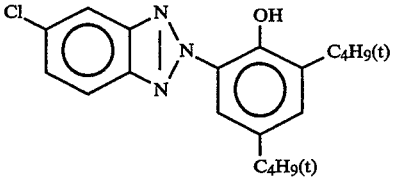
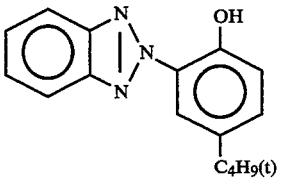
and
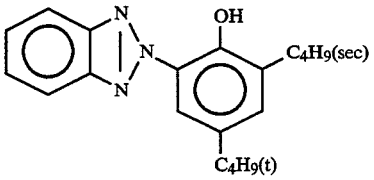
Color image stabilizer (Cpd-7)
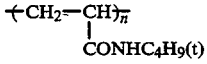
(Mean molecular weight: 60,000)
Color image stabilizer (Cpd-8)
1:1 (by weight) mixture of
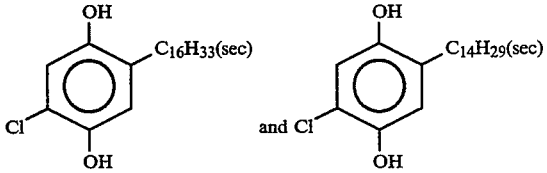
Color image stabilizer (Cpd-9)
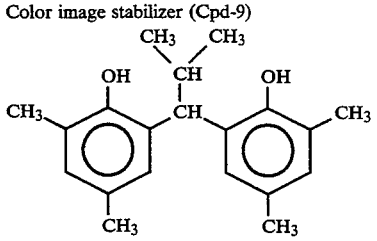
Antiseptics (Cpd-10)
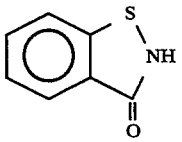
Antiseptics (Cpd-11)
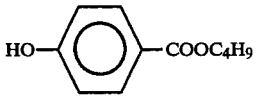
Ultraviolet absorbent (UV-1)
4:2:4 (by weight) mixture of -continued
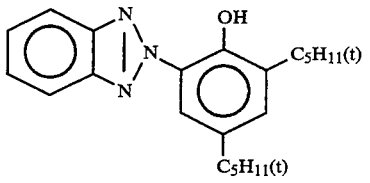
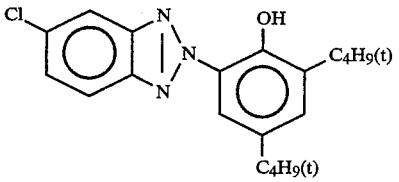
and
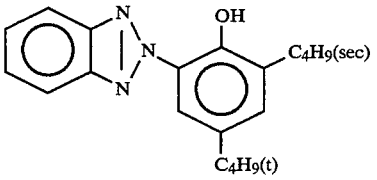
Solvent (Solv-1)
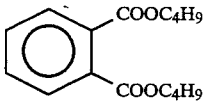
Solvent (Solv-2)
1:1 (by volume) mixture of
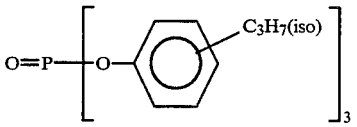
and
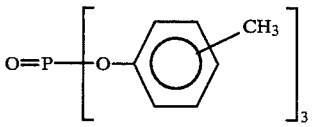
Solvent (Solv-3)
$O{=}P{+}O{-}C_9H_{19}(iso)]_3$
Solvent (Solv-4)
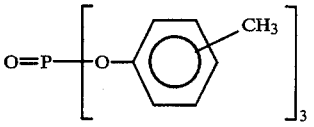
Solvent (Solv-5)
$COOC_8H_{17}$
|
$(CH_2)_8$
|
$COOC_8H_{17}$
Solvent (Solv-6)
80:20 (by volume) mixture of -continued

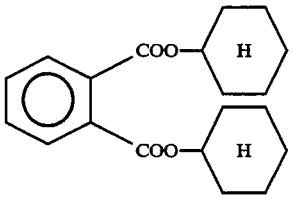

and $C_8H_{17}CH\underset{\diagdown O \diagup}{CH}(CH_2)_7COOC_8H_{17}$

Solvent (Solv-7)

$C_8H_{17}CH\underset{\diagdown O \diagup}{CH}(CH_2)_7COOC_8H_{17}$

The thus obtained sample was named Sample 1A. Other samples named Samples 2A to 40A respectively were prepared in the same manner as Sample 1A, except that yellow couplers and color image stabilizers (in addition to the color image stabilizers Cpd-1 and Cpd-7) were emulsified together in their respective combinations set forth in Table B, and incorporated in their respective first layers. Therein, the color image stabilizers of the present invention were added in a proportion of 50 mol % to the yellow coupler used. Additionally, the comparative color images stabilizers were used in the same amounts as in Sample 1A.

Each of the thus prepared samples was subjected to wedgewise exposure for sensitometry through three color separation filter, by means of a sensitometer (Model FWH, produced by Fuji Photo Film Co., Ltd., equipped with a light source having a color temperature of 3,200° K.). Therein, the exposure time was set to 0.1 sec., so that the exposure was controlled to 250 CMS.

After the exposure, each sample was subjected to a photographic processing operation by means of a paper processor using the processing solutions described below and according to the following processing process. As for the processing operation, continuous processing (running test) was performed till an amount of the replenisher used for color development became twice the volume of the developing tank used.

| Processing Step | Temperature | Time | Amount* replenished | Tank Volume |
|---|---|---|---|---|
| Color development | 35° C. | 45 sec. | 161 ml | 17 l |
| Bleach-fix | 30–35° C. | 45 sec. | 215 ml | 17 l |
| Rinsing (1) | 30–35° C. | 20 sec. | — | 10 l |
| Rinsing (2) | 30–35° C. | 20 sec. | — | 10 l |
| Rinsing (3) | 30–35° C. | 20 sec. | 350 ml | 10 l |
| Drying | 70–80° C. | 60 sec. | | |

*per $m^2$ of photographic material

The rinsing processing was carried out according to 3-stage counter current process in the direction of from the rinsing tank 3 to the rinsing tank 1. The composition of each processing solution used was described below.

| | Tank Solution | Replenisher |
|---|---|---|
| Color Developer: | | |
| Water | 800 ml | 800 ml |
| Ethylenediamine-N,N,N',N'-tetramethylenephosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-Ethyl-N-(β-methanesulfonamidoethyl)-3-methyl-4-aminoaniline sulfate | 5.0 g | 7.0 g |
| N,N-Bis(carboxymethyl hydrazine | 4.0 g | 5.0 g |
| Monosodium N,N-di(sulfoethyl)-hydroxylamine | 4.0 g | 5.0 g |
| Brightening agent (WHITEX 4B, produced by Sumitomo Chemical Co., Ltd.) | 1.0 g | 2.0 g |
| Water to make | 1,000 ml | 1,000 ml |
| pH (25° C.) | 10.05 | 10.45 |

| Bleach-Fix Bath (Tank solution = Replenisher): | |
|---|---|
| Water | 400 ml |
| Ammonium thiosulfate (700 g/l) | 100 ml |
| Sodium sulfite | 17 g |
| Ammonium ethylenediaminetetra-acetato ferrate(III) | 55 g |
| Disodium ethylenediaminetetraacetate | 5 g |
| Ammonium bromide | 40 g |
| Water to make | 1,000 ml |
| pH (25° C.) | 6.0 |

Rinsing Bath (Tank solution=Replenisher)

Ion exchanged water (in which calcium and magnesium ion concentrations were each below 3 ppm).

All the samples in which dye images had been formed underwent a discoloration test. Evaluation of the discoloration inhibiting effects produced by the present combinations was made by exposing for 16 days to a Xenon tester (illuminance: 200,000 lux) and then determining a yellow density remaining rate in the area having an initial density of 2.0.

The results obtained are shown in Table B, too.

TABLE B

| Sample | Coupler | Color Image Stabilizer (50 mol % addn.) | Dye Remaining Rate (initial density: 2.0, Xe lamp, 16 days) | Note |
|---|---|---|---|---|
| 1A | ExY | — | 42 | Comparison |
| 2A | " | A-11 | 57 | " |
| 3A | " | A-18 | 62 | " |
| 4A | " | B-7 | 60 | " |
| 5A | " | B-31 | 63 | " |
| 6A | " | E-2 | 61 | " |

TABLE B-continued

| Sample | Coupler | Color Image Stabilizer (50 mol % addn.) | Dye Remaining Rate (initial density: 2.0, Xe lamp, 16 days) | Note |
|---|---|---|---|---|
| 7A | " | E-12 | 63 | " |
| 8A | " | F-8 | 55 | " |
| 9A | " | F-21 | 61 | " |
| 10A | " | G-2 | 60 | " |
| 11A | " | G-16 | 64 | " |
| 12A | YY-1 | — | 40 | " |
| 13A | " | A-11 | 85 | Invention |
| 14A | " | A-18 | 85 | " |
| 15A | " | B-7 | 82 | " |
| 16A | YY-1 | B-31 | 82 | Invention |
| 17A | " | E-2 | 77 | " |
| 18A | " | E-12 | 82 | " |
| 19A | " | F-8 | 80 | " |
| 20A | " | F-21 | 85 | " |
| 21A | " | G-2 | 78 | " |
| 22A | " | G-16 | 84 | " |
| 23A | ExY | — | 43 | Comparison |
| 24A | " | H-6 | 52 | " |
| 25A | " | H-14 | 50 | " |
| 26A | " | H-23 | 48 | " |
| 27A | " | H-24 | 48 | " |
| 28A | " | H-33 | 47 | " |
| 29A | " | H-35 | 46 | " |
| 30A | " | H-46 | 49 | " |
| 31A | ExY | H-48 | 50 | Comparison |
| 32A | YY-1 | — | 44 | " |
| 33A | " | H-6 | 80 | Invention |
| 34A | " | H-14 | 82 | " |
| 35A | " | H-23 | 85 | " |
| 36A | " | H-24 | 84 | " |
| 37A | " | H-33 | 79 | " |
| 38A | " | H-35 | 77 | " |
| 39A | " | H-46 | 84 | " |
| 40A | " | H-48 | 83 | " |

As can be clearly seen from Table B, the samples prepared in accordance with the present invention had an excellent discoloration inhibiting effect even when they took a multilayer constitution. The effects achieved thereby were much superior to those brought about by conventional arts, and beyond all expectations.

EXAMPLE 3

Samples were prepared in the same manner as Sample 201 prepared in Example 2 of JP-A-02-90151, except that the coupler Cp-L incorporated in the 10th and the 11th layers was replaced by equimolar amounts of the present couplers YY-1, YY-43 and YY-12 respectively and, what is more, the present compound A-11, B-7, E-7, F-76, G-13, H-5, H-22, H-30 or H-49 was incorporated in each of said layers in a condition that it was used in a proportion of 50 mol % to each of the above-cited couplers and emulsified together with said coupler.

These samples were subjected to exposure and photographic processing under the same condition as in Example 2 of JP-A-02-90151, and underwent the same discoloration test as therein. As a result of this test, the samples prepared in accordance with the present invention have turned out to be effectively prevented from discoloring and to have satisfactory photographic characteristics.

EXAMPLE 4

Samples were prepared in the same manner as the sensitive material (1) prepared in Example 1 of JP-A-02-93641, except that the coupler Ex-9 incorporated in the 11th, the 12th and the 13th layers was replaced by equimolar amounts of the present couplers YY-1, YY-43 and YY-50 respectively and, what is more, the present compound A-19, B-27, E-12, F-10, G-16, H-5, H-22, H-30 or H-49 was incorporated in each of said layers in a condition that it was used in a proportion of 50 mol % to each of the above-cited couplers and emulsified together with said coupler.

These samples were subjected to exposure and photographic processing under the same condition as in Example 1 of JP-A-02-93641, and underwent the same discoloration test as therein. As a result of this test, the samples prepared in accordance with the present invention have turned out to be effectively prevented from discoloring and to have satisfactory photographic characteristics.

EXAMPLE 5

Samples were prepared in the same manner as Sample 101 prepared in Example 1 of JP-A-02-854, except that the coupler C-5 or C-7 incorporated in the 12th and the 13th layers was replaced by equimolar amounts of the present couplers YY-1, YY-43 and YY-12 respectively and, what is more, the present compound A-29, B-27, E-30, F-18, G-16, H-12, H-24, H-30 or H-54 was incorporated in each of said layers in a condition that it was used in a proportion of 25 mol % to each of the above-cited couplers and emulsified together with said coupler.

These samples were subjected to exposure and photographic processing under the same condition as in Example 1 of JP-A-02-854, and underwent the same discoloration test as therein. As a result of this test, the samples prepared in accordance with the present invention have turned out to be effectively prevented from discoloring and to have satisfactory photographic characteristics.

Additionally, the compounds of the present invention have found out to have excellent effects even on the above-cited photosensitive material.

EXAMPLE 6

Samples were prepared in the same manner as the color photographic material prepared in Example 2 of JP-A-01-158431, except that the coupler ExY-1 incorporated in the 11th and the 12th layers was replaced by equimolar amounts of the present couplers YY-1, YY-43 and YY-12 respectively and, what is more, Cpd-6 was replaced by equimolar amounts of the present compound A-29, B-27, E-12, F-18, G-13, H-5, H-22, H-30 and H-49 respectively.

These samples were subjected to exposure and photographic processing under the same condition as in Example 2 of JP-A-01-158431, and underwent the same discoloration test as therein and were examined for photographic characteristics. As a result of these examinations, the samples prepared in accordance with the present invention have turned out to be effectively prevented from discoloring and to have satisfactory photographic characteristics.

Additionally, the compounds of the present invention have found out to have excellent effects on the photographic material of the above-cited system.

EFFECTS OF THE INVENTION

The silver halide photographic material in which the yellow dye-forming coupler represented by the general formula (1) of the present invention and the compound represented by the general formula (a-I), (a-II), (a-III), (a-IV), (a-V), (a-VI) or (a-VII) are used in combination is incomparably superior in fastness to silver halide color photographic materials using conventional combinations.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising at least one photosensitive silver halide emulsion layer, at least one yellow dye-forming coupler represented by formula (1) and at least one compound represented by the formula (a-I), (a-II), (a-III), (a-IV), (a-V), or (a-VI):

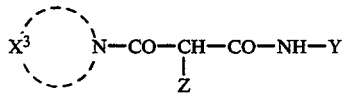

(1)

wherein $X^3$ represents an organic residue completing a nitrogen-containing heterocyclyl group together with

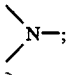

Y represents an aromatic or heterocyclic group;

and Z represents a group capable of splitting off when the coupler represented by the foregoing formula reacts with the oxidation product of an aromatic primary amine color developing agent;

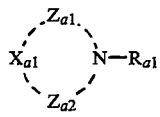

(a-I)

wherein $R_{a1}$ represents $—C(=O)—R_{a21}$, $—S(=O)_{n3}—R_{a21}$, $—C(=O)O—R_{a21}$, $—P(=O)(R_{a22})(R_{a23})$, $—C(=O)N(R_{a21})(R_{a24})$ or $—S(=O)_{n4}N(R_{a21})(R_{a24})$, or a linkage group via which the compound can form a dimer or higher polymer; $Z_{a1}$ and $Z_{a2}$ are the same or different, each being a divalent connecting group attached to the nitrogen atom via its carbon atom, and the nitrogen-containing hetero ring formed by $Z_{a1}$, $Z_{a2}$, $X_{a1}$ and the nitrogen atom is a 5- to 8-membered ring; $X_{a1}$ represents —O—, $—S(O)_{n5}—$, $—N(R_{a25})—$, or $—C(R_{a26})(R_{a27})—$; $R_{a21}$ represents an aliphatic, aromatic or heterocyclic group; $R_{a22}$ and $R_{a23}$ are the same or different, each being an aliphatic, aromatic, aliphatic oxy or aromatic oxy group; $R_{a24}$ represents a hydrogen atom, or an aliphatic or aromatic group; $R_{a25}$ represents an aliphatic group, or is the same as $R_{a1}$; $R_{a26}$ and $R_{a27}$ are the same or different, each being a hydrogen atom, or an aliphatic, aliphatic oxy, aromatic oxy, aliphatic acyloxy or aromatic acyloxy group; n3 and n4 each represent 1 or 2; n5 represents 0, 1 or 2; and $R_{a22}$ and $R_{a23}$, $R_{a21}$ and $R_{a24}$, or $R_{a26}$ and $R_{a27}$ may combine to form a 5- to 8-membered ring; but with the proviso that the nitrogen-containing hetero ring constituted of $Z_{a1}$, $Z_{a2}$, $X_{a1}$ and N which is a 2,2,6,6-tetraalkylpiperidine ring is excluded;

$$X_{a2}—Z_{a3}—X_{a3} \quad \text{(a-II)}$$

wherein $X_{a2}$ and $X_{a3}$ are the same or different, each being $—N(R_{a35})(R_{a36})$, $—C(=O)N(R_{a31})(R_{a32})$, $—S(=O)_{n6}N(R_{a31})(R_{a32})$, $—P(=O)(R_{a33})N(R_{a31})(R_{a32})$, provided that the total number of carbon atoms contained in $X_{a2}$ and $X_{a3}$ is at least 6; $Z_{a3}$ represents a direct bond or a divalent aliphatic group in which the number of atoms in the chain between $X_{a2}$ and $X_{a3}$ is 7 or less; $R_{a36}$ represents $—C(=O)R_{a34}$, $—S(=O)_{n7}R_{a34}$ or $—P(=O)—(R_{a34})(R_{a35})$; $R_{a31}$ represents $—C(=O)R_{a34}$, $—S(=O)_{n7}R_{a34}$, $—P(=O)(R_{a34})(R_{a35})$, or an aliphatic or aromatic group; $R_{a34}$ represents an aliphatic, aromatic, aliphatic oxy, aromatic oxy, aliphatic amino or aromatic amino group; $R_{a35}$ represents an aliphatic, aromatic, aliphatic oxy or aromatic oxy group; n6 represents 1 or 2; n7 represents 1 or 2; $R_{a32}$ represents a hydrogen atom, a heterocyclic group, or a group defined as $R_{a31}$; $R_{a33}$ represents an aliphatic, aromatic, aliphatic oxy or aromatic oxy group; when $Z_{a3}$ represents a bonding hand, the compound may form a dimer or higher polymer via $R_{a31}$ or $R_{a32}$; and 5- to 8-membered ring(s), excluding a 2,2,6,6-tetraalkylpiperidine ring, may be formed by combining $R_{a36}$ with $R_{a32}$, or $R_{a31}$ with $R_{a32}$; and with the further proviso that when both $X_{a2}$ and $X_{a3}$ are $—C(=O)N(R_{a31})(R_{a32})$, the compounds where $Z_{a3}$ represents methylene or a monosubstituted methylene are excluded;

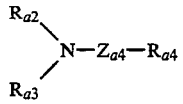

(a-III)

wherein $R_{a2}$ represents a hydrogen atom, an aliphatic group, an aromatic group, a heterocyclic group, $—C(=O)R_{a41}$, $—S(=O)_{n8}R_{a41}$ or $—P(=O)(R_{a41})(R_{a42})$, $R_{a3}$ represents $—C(=O)R_{a41}$, $—S(=O)_{n9}R_{a41}$ or $—P(=O)(R_{a41})(R_{a42})$ and $R_{a4}$ represents a hydrogen atom, an aliphatic group, an aromatic group, $—C(=O)R_{a43}$ or $—S(=O)_{n9}R_{a43}$, provided that the total number of carbon atoms contained in $R_{a21}$, $R_{a3}$ and $R_{a4}$ is at least 8; $Z_{a4}$ represents —O— or —S—; $R_{a41}$ represents an aliphatic group, an aromatic group, an aliphatic oxy group, an aromatic oxy group, an aliphatic amino group or an aromatic amino group; $R_{a42}$ represents an aliphatic group, an aromatic group, an aliphatic oxy group or an aromatic oxy group; $R_{a43}$ represents an aliphatic group, an aromatic group, an aliphatic amino group or an aromatic amino group; n8 represents 1 or 2; and n9 represents 1 or 2; and a 5- to 8-membered ring, excluding a 2,2,6,6-tetraalkylpiperidine ring, may be formed by combining $R_{a2}$ with $R_{a3}$; and which may form a dimer or higher polymer via $R_{a21}$, $R_{a3}$ or $R_{a4}$;

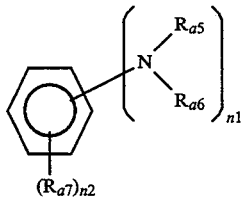

(a-IV)

wherein $R_{a5}$ represents $—C(=O)R_{a51}$, $—S(=O)_{n10}R_{a51}$, or $—P(=O)(R_{a51})(R_{a52})$; $R_{a6}$ represents a hydrogen atom, an aliphatic group, an aromatic group, a heterocyclic group, or one of the groups defined as $R_{a5}$; $R_{a7}$ represents a halogen atom, an aliphatic group, an aromatic group, a heterocyclic group, a nitro group, a cyano group, —C(=O)$R_{a53}$, or —S(=O)$_{n11}R_{a53}$; n1 represents an integer from 1 to 3 and n2 represents 0 or an integer from 1 to 4, provided that the sum of n1 and n2 is 6 or less; when n1 and n2 are 2 or more, $R_{a5}$'s, $R_{a6}$'s and $R_{a7}$'s each are the same or different; $R_{a51}$ and $R_{a53}$ are the same or different, each being an aliphatic group, an aromatic group, an aliphatic oxy group, an aromatic oxy group, an aliphatic amino group, or an aromatic amino group; $R_{a52}$ represents an aliphatic group, an aromatic group, an aliphatic oxy group, or an aromatic oxy group; n10 and n11 each represent 1 or 2; a 5- to 8-membered ring may be formed by combining $R_{a5}$ with $R_{a6}$; and when n2 is 2 or more, two adjacent $R_{a7}$'s may combine with each other to form a 5- to 8-membered ring, and which may form a dimer or higher polymer via $R_{a5}$ or $R_{a7}$;

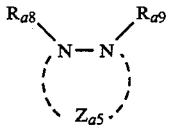

(a-V)

wherein $R_{a8}$ and $R_{a9}$ are the same or different, each being a hydrogen atom, an aliphatic group, an aromatic group, a heterocyclic group, —C(=O)$R_{a61}$, —S(=O)$_{n12}R_{a61}$ or —P(=O)($R_{a61}$)($R_{a62}$), provided that the total number of carbon atoms contained in $R_{a8}$ and $R_{a9}$ is at least 6; $Z_{a5}$ represents nonmetal atoms completing a 5- to 8-membered hetero ring together with the two nitrogen atoms; $R_{a61}$ represents an aliphatic group, an aromatic group, an aliphatic oxy group, an aromatic oxy group, an aliphatic amino group, or an aromatic amino group; and $R_{a62}$ represents an aliphatic group, an aromatic group, an aliphatic oxy group, or an aromatic oxy group, and which may form a dimer or higher polymer via $R_{a8}$ or $R_{a9}$;

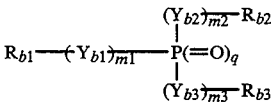

(a-VI)

wherein $R_{b1}$, $R_{b2}$ and $R_{b3}$ are the same or different, each being an aliphatic group or an aromatic group; $Y_{b1}$, $Y_{b2}$ and $Y_{b3}$ each represent —O—, —S—, or —N($R_{b4}$)—; m1, m2, m3 and q each represent 0 or 1, excluding compounds where m1=m2=m3=1 when q=1, and compounds where m1=m2=m3=0 when q=0; $R_{b4}$ represents a hydrogen atom, an aliphatic group, or an aromatic group; any two among $R_{b1}$, $R_{b2}$ and $R_{b3}$ may combine with each other to complete a 5- to 9-membered ring together with the phosphorus atom, wherein the case of m1=m2=m3=1 is allowed; and further, $R_{b4}$ may combine with $R_{b1}$, $R_{b2}$ or $R_{b3}$ to form a 5- or 6-membered ring.

2. The silver halide color photographic material of claim 1, wherein said $X^3$, together with

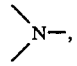

forms a saturated or unsaturated, substituted or unsubstituted, 3- to 12-membered monocyclic or condensed polycyclic ring optionally containing oxygen or sulfur atoms in the ring.

3. The silver halide color photographic material of claim 1, wherein said Y is a substituted or unsubstituted aryl group or a heterocyclic group which is a saturated or unsaturated, substituted or unsubstituted, 3- to 12-membered monocyclic or condensed polycyclic ring containing at least one nitrogen, oxygen, or sulfur atom as a hetero atom.

4. The silver halide color photographic material of claim 1, wherein said Z is selected from the group consisting of a nitrogen-containing heterocyclyl group capable of binding to a coupling site via its nitrogen atom, an aryloxy group, an arylthio group, a heterocyclyloxy group, a heterocyclylthio group, an acyloxy group, a carbamoyl group, an alkylthio group, and a halogen atom.

5. The silver halide color photographic material of claim 1, wherein said yellow dye-forming coupler is selected from the group consisting of compounds having formulae (2) and (3):

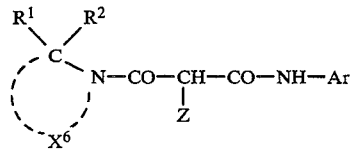

(2)

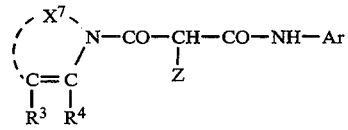

(3)

wherein Z has the meaning set forth in claim 1, Ar represents a phenyl group having at least one substituent situated in the ortho-position, $X^6$ represents an organic residue forming a nitrogen-containing heterocyclic ring, which may be a single or condensed ring, together with —C($R^1$)($R^2$)—N<, $X^7$ represents an organic residue forming a nitrogen-containing heterocyclic ring, which may be a single or condensed ring, together with —C($R^3$)=C($R^4$)—N<, and wherein $R^1$, $R^2$, $R^3$ and $R^4$ each represent a hydrogen atom, or a substituent group.

6. The silver halide color photographic material of claim 1, wherein said yellow dye-forming coupler is selected from the group consisting of compounds having the formula:

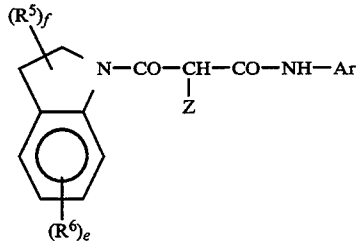

wherein Ar represents a phenyl group having at least one substituent situated in the ortho-position, $R^5$ and $R^6$ each represent a substituent, e represents 0 or an integer from 1 to 4 and f represents 0 or an integer from 1 to 4, wherein when e is 2, 3 or 4, the $R^6$'s may be different from one another, and when f is 2, 3 or 4, the $R^5$'s may be different from one another.

7. The silver halide color photographic material of claim 1, wherein $R_{a1}$ in said compound of formula (a-I), is selected from the group consisting of $—C(=O)R_{a21}$, $—SO_2R_{a21}$, $—C(=O)N(R_{a21})(R_{a24})$, and $—SO_2N(R_{a21})(R_{a24})$.

8. The silver halide color photographic material of claim 1, wherein said compound of formula (a-I) is selected from the group consisting of compounds having formula (a-I'):

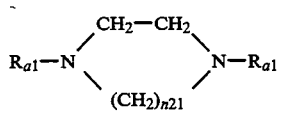

(a-I')

wherein $R_{a1}$ has the same meaning as in the general formula (a-I), and n21 represents an integer from 1 to 3.

9. The silver halide color photographic material of claim 1, wherein said compound of formula (a-II) is selected from the group consisting of compounds having formulae (a-II') and (a-II''):

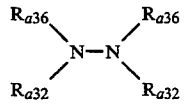

(a-II')

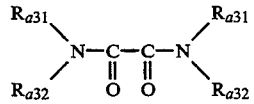

(a-II'')

wherein $R_{a31}$, $R_{a32}$ and $R_{a36}$ have the same meanings as in formula (a-II), respectively.

10. The silver halide color photographic material of claim 1, wherein in said compound of formula (a-III), $R_{a2}$ is selected from the group consisting of alkyl, $—C(=O)R_{a41}$, and $—SO_2R_{a41}$; $R_{a3}$ is selected from the group consisting of $—C(=O)R_{a41}$ and $—SO_2R_{a41}$; $R_{a4}$ is selected from the group consisting of $—C(=O)R_{a43}$ and $—SO_2R_{a43}$, and $Z_{a4}$ is —O—.

11. The silver halide color photographic material of claim 1, wherein in said compound of formula (a-IV), n1 is 2 or 3, $R_{a5}$ is $—C(=O)R_{a51}$, and $R_{a6}$ is selected from the group consisting of hydrogen, alkyl, and $—C(=O)R_{a51}$.

12. The silver halide color photographic material of claim 1, wherein said compound of formula (a-V) is selected from the group consisting of compounds having formulae $(a\text{-}V')_1$, $(a\text{-}V')_2$, $(a\text{-}V')_3$ and (a-V''):

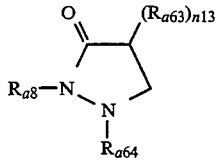

$(a\text{-}V')_1$

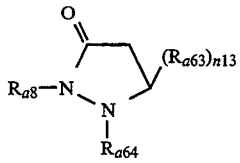

$(a\text{-}V')_2$

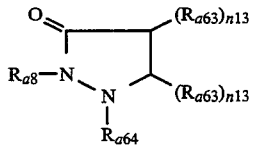

$(a\text{-}V')_3$

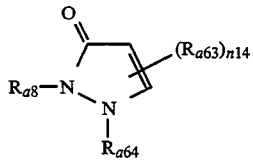

(a-V'')

wherein $R_{a8}$ has the same meaning as in formula (a-V); $R_{a63}$ represents $—C(=O)R_{a61}$, or a straight-chain or branched, substituted or unsubstituted alkyl group, or a substituted or unsubstituted phenyl group: $R_{a64}$ represents a substituted or unsubstituted phenyl group: n13 represents 0 or an integer from 1 to 2; n14 represents 0, 1 or 2; $R_{a61}$ has the same meaning as in formula (a-V); and when n13 is 2, and n14 is 2, the $R_{a63}$'s are the same or different.

13. The silver halide color photographic material of claim 1, wherein said compound of formula (a-VI) is selected from the group consisting of compounds having formulae (a-VI-1), (a-VI-2), (a-VI-3), and (a-VI-4):

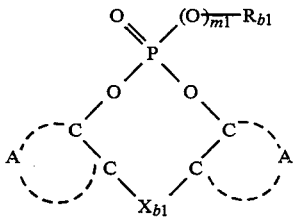

(a-VI-1)

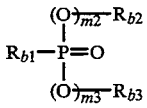

(a-VI-2)

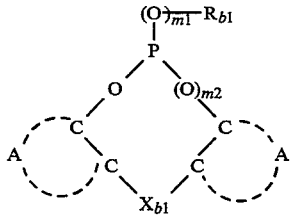

(a-VI-3)

-continued (a-VI-4)

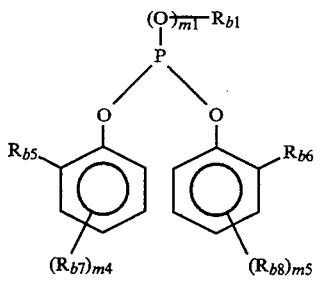

wherein $R_{b1}$, $R_{b2}$, $R_{b3}$, $m_1$, $m_2$ and $m_3$ have the same meaning as in formula (a-VI) respectively; A represents atoms completing a substituted or unsubstituted benzene ring; $X_{b1}$ represents a single bond, a substituted or unsubstituted methylene group, —S—, —O—, —CO—, —N($R_{b9}$)—, —$SO_2$— or —SO—, wherein $R_{b9}$ represents a hydrogen atom, an aliphatic group or an aromatic group: $R_{b5}$, $R_{b6}$, $R_{b7}$, and $R_{b8}$ each represent hydrogen or a substituent, and $m_4$ and $m_5$ each represent 0 or an integer from 1 to 3.

14. The silver halide color photographic material of claim 1, further comprising a discoloration inhibitor.

15. The silver halide color photographic material of claim 1, wherein said compound of formula (a-I), (a-II), (a-III), (a-IV), (a-V), or (a-VI) is present in a proportion of 0.5 to 300 mol % based on the coupler used therewith.

16. The silver halide color photographic material of claim 1, wherein said yellow dye-forming coupler of formula (1), and said compound of formula (a-I), (a-II), (a-III), (a-IV), (a-V), or (a-VI) are present in the same layer.

* * * * *